US012428812B2

(12) United States Patent
Nishikawa et al.

(10) Patent No.: US 12,428,812 B2
(45) Date of Patent: Sep. 30, 2025

(54) WORK MACHINE

(71) Applicant: HITACHI CONSTRUCTION MACHINERY CO., LTD., Tokyo (JP)

(72) Inventors: Shinji Nishikawa, Kasumigaura (JP); Hiroaki Tanaka, Kasumigaura (JP); Masatoshi Morikawa, Ushiku (JP); Akihiro Narazaki, Tsukuba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 137 days.

(21) Appl. No.: 18/025,948

(22) PCT Filed: Jan. 6, 2022

(86) PCT No.: PCT/JP2022/000289
§ 371 (c)(1),
(2) Date: Mar. 13, 2023

(87) PCT Pub. No.: WO2022/163322
PCT Pub. Date: Aug. 4, 2022

(65) Prior Publication Data

US 2023/0366174 A1 Nov. 16, 2023

(30) Foreign Application Priority Data

Jan. 27, 2021 (JP) ..... 2021-010821

(51) Int. Cl.
*E02F 9/20* (2006.01)
*E02F 3/43* (2006.01)
*E02F 9/26* (2006.01)

(52) U.S. Cl.
CPC ..... *E02F 9/2033* (2013.01); *E02F 3/435* (2013.01); *E02F 9/265* (2013.01)

(58) Field of Classification Search
CPC ..... E02F 9/2033; E02F 3/435; E02F 9/265; E02F 9/2296; E02F 9/262; E02F 3/43; E02F 9/2004; B60Y 2200/412
See application file for complete search history.

(56) References Cited

U.S. PATENT DOCUMENTS 10,344,450 B2 7/2019 Sharp et al.
2005/0278636 A1 12/2005 Nomoto
(Continued)

FOREIGN PATENT DOCUMENTS

CN 110805081 A 2/2020
EP 3 128 083 A1 2/2017
(Continued)

OTHER PUBLICATIONS

International Search Report of PCT/JP2022/000289 dated Feb. 22, 2022.
(Continued)

*Primary Examiner* — Brandon D Lee
(74) *Attorney, Agent, or Firm* — Mattingly & Malur, PC

(57) ABSTRACT

A work machine includes a work implement provided to a machine body, a posture sensor that senses posture information regarding the work implement, a controller configured to compute a specific position of the work implement on the basis of the posture information, set a limited area that the work implement is prohibited from entering, compute a movable distance as a distance between the limited area and the specific position of the work implement, and limit operation of the work implement according to the movable distance to prevent the work implement from entering the limited area, and an input device for inputting to the controller input information input by an operation of an operator. The controller includes a storage device that stores boundary information related to a plurality of different kinds of shapes of limited area boundaries, and the controller is
(Continued)

configured to select one from among the plurality of kinds of shapes of limited area boundaries included in the boundary information, on the basis of the input information input from the input device, and set a limited area boundary of the selected kind of shape.

5 Claims, 40 Drawing Sheets

(56) References Cited

U.S. PATENT DOCUMENTS

| | | | | |
|---|---|---|---|---|
| 2016/0215475 | A1* | 7/2016 | Meguriya | E02F 9/2285 |
| 2021/0010236 | A1 | 1/2021 | Nishi | |
| 2021/0230841 | A1* | 7/2021 | Kurosawa | E02F 9/2033 |
| 2022/0106767 | A1* | 4/2022 | Viergutz | E02F 9/2033 |
| 2022/0170242 | A1* | 6/2022 | Maley | G06T 7/70 |

FOREIGN PATENT DOCUMENTS

| | | | |
|---|---|---|---|
| JP | 07-94735 | B2 | 10/1995 |
| JP | 3308450 | B2 | 7/2002 |
| JP | 2006-024184 | A | 1/2006 |
| JP | 2019-157409 | A | 9/2019 |
| JP | 2020-117982 | A | 8/2020 |
| WO | 2019189030 | A1 | 10/2019 |
| WO | 2020080538 | A1 | 4/2020 |

OTHER PUBLICATIONS

International Preliminary Report on Patentability received in corresponding International Application No. PCT/JP2022/000289 dated Aug. 10, 2023.

Chinese Office Action received in corresponding Chinese Application No. 202280006421.8 dated Aug. 5, 2024.

Extended European Search Report received in corresponding European Application No. 22745549.0 dated Aug. 5, 2024.

* cited by examiner

FIG. 15

LIST OF VARIABLES RELATED TO LIMITED AREA SETTINGS

| ITEM | | | | INITIAL VALUE | UNIT (UNIT) | MINIMUM UNIT (RESOLUTION) | REMARKS |
|---|---|---|---|---|---|---|---|
| ENABLED/DISABLED STATE OF AREA LIMITING FUNCTION | | | | 0 | – | 1 | 0:DISABLED, 1:ENABLED |
| KIND OF SHAPE OF LIMITED AREA BOUNDARY | "PLANE 1 (FRONT)" AREA | | | 0 | – | 1 | 0:UNSET, 1:RECTANGULAR SHAPE, 2:TANGENT TO CONCENTRIC CIRCLE, 3:OPTIONAL STRAIGHT LINE |
| | "PLANE 2 (RIGHT)" AREA | | | 0 | – | 1 | 0:UNSET, 1:RECTANGULAR SHAPE, 2:TANGENT TO CONCENTRIC CIRCLE, 3:OPTIONAL STRAIGHT LINE |
| | "PLANE 3 (REAR)" AREA | | | 0 | – | 1 | 0:UNSET, 1:RECTANGULAR SHAPE, 2:TANGENT TO CONCENTRIC CIRCLE, 3:OPTIONAL STRAIGHT LINE |
| | "PLANE 4 (LEFT)" AREA | | | 0 | – | 1 | 0:UNSET, 1:RECTANGULAR SHAPE, 2:TANGENT TO CONCENTRIC CIRCLE, 3:OPTIONAL STRAIGHT LINE |
| PRESENCE OR ABSENCE OF SETTING OF EACH AREA | "PLANE 1 (FRONT)" AREA | | | 0 | – | 1 | 0:ABSENCE OF SETTING (ABSENCE OF AREA), 1:PRESENCE OF SETTING (PRESENCE OF AREA) |
| | "PLANE 2 (RIGHT)" AREA | | | 0 | – | 1 | 0:ABSENCE OF SETTING (ABSENCE OF AREA), 1:PRESENCE OF SETTING (PRESENCE OF AREA) |
| | "PLANE 3 (REAR)" AREA | | | 0 | – | 1 | 0:ABSENCE OF SETTING (ABSENCE OF AREA), 1:PRESENCE OF SETTING (PRESENCE OF AREA) |
| | "PLANE 4 (LEFT)" AREA | | | 0 | – | 1 | 0:ABSENCE OF SETTING (ABSENCE OF AREA), 1:PRESENCE OF SETTING (PRESENCE OF AREA) |
| COORDINATES OF COORDINATE POINTS SPECIFYING AREA BOUNDARY | "PLANE 1 (FRONT)" AREA | FIRST COORDINATE POINT DISTANCE | V1PosR1 | 0 | m | 0.1 | |
| | | FIRST COORDINATE POINT ANGLE | V1PosT1 | 0 | ° | 1 | |
| | | SECOND COORDINATE POINT DISTANCE | V1PosR2 | 0 | m | 0.1 | |
| | | SECOND COORDINATE POINT ANGLE | V1PosT2 | 0 | ° | 1 | |
| | "PLANE 2 (RIGHT)" AREA | FIRST COORDINATE POINT DISTANCE | V2PosR1 | 0 | m | 0.1 | |
| | | FIRST COORDINATE POINT ANGLE | V2PosT1 | 0 | ° | 1 | |
| | | SECOND COORDINATE POINT DISTANCE | V2PosR2 | 0 | m | 0.1 | |
| | | SECOND COORDINATE POINT ANGLE | V2PosT2 | 0 | ° | 1 | |
| | "PLANE 3 (REAR)" AREA | FIRST COORDINATE POINT DISTANCE | V3PosR1 | 0 | m | 0.1 | |
| | | FIRST COORDINATE POINT ANGLE | V3PosT1 | 0 | ° | 1 | |
| | | SECOND COORDINATE POINT DISTANCE | V3PosR2 | 0 | m | 0.1 | |
| | | SECOND COORDINATE POINT ANGLE | V3PosT2 | 0 | ° | 1 | |
| | "PLANE 4 (LEFT)" AREA | FIRST COORDINATE POINT DISTANCE | V4PosR1 | 0 | m | 0.1 | |
| | | FIRST COORDINATE POINT ANGLE | V4PosT1 | 0 | ° | 1 | |
| | | SECOND COORDINATE POINT DISTANCE | V4PosR2 | 0 | m | 0.1 | |
| | | SECOND COORDINATE POINT ANGLE | V4PosT2 | 0 | ° | 1 | |
| FUNCTION PARAMETERS REPRESENTING AREA BOUNDARY | "PLANE 1 (FRONT)" AREA | FIRST COORDINATE POINT X-COORDINATE | V1PosX1 | 0 | m | 0.001 | |
| | | FIRST COORDINATE POINT Y-COORDINATE | V1PosY1 | 0 | m | 0.001 | |
| | | SECOND COORDINATE POINT X-COORDINATE | V1PosX2 | 0 | m | 0.001 | |
| | | SECOND COORDINATE POINT Y-COORDINATE | V1PosY2 | 0 | m | 0.001 | |
| | "PLANE 2 (RIGHT)" AREA | FIRST COORDINATE POINT X-COORDINATE | V2PosX1 | 0 | m | 0.001 | |
| | | FIRST COORDINATE POINT Y-COORDINATE | V2PosY1 | 0 | m | 0.001 | |
| | | SECOND COORDINATE POINT X-COORDINATE | V2PosX2 | 0 | m | 0.001 | |
| | | SECOND COORDINATE POINT Y-COORDINATE | V2PosY2 | 0 | m | 0.001 | |
| | "PLANE 3 (REAR)" AREA | FIRST COORDINATE POINT X-COORDINATE | V3PosX1 | 0 | m | 0.001 | |
| | | FIRST COORDINATE POINT Y-COORDINATE | V3PosY1 | 0 | m | 0.001 | |
| | | SECOND COORDINATE POINT X-COORDINATE | V3PosX2 | 0 | m | 0.001 | |
| | | SECOND COORDINATE POINT Y-COORDINATE | V3PosY2 | 0 | m | 0.001 | |
| | "PLANE 4 (LEFT)" AREA | FIRST COORDINATE POINT X-COORDINATE | V4PosX1 | 0 | m | 0.001 | |
| | | FIRST COORDINATE POINT Y-COORDINATE | V4PosY1 | 0 | m | 0.001 | |
| | | SECOND COORDINATE POINT X-COORDINATE | V4PosX2 | 0 | m | 0.001 | |
| | | SECOND COORDINATE POINT Y-COORDINATE | V4PosY2 | 0 | m | 0.001 | |

| INPUT | |
|---|---|
| V1PosR1 | 7.0 |
| V1PosT1 | 30 |

| OUTPUT | |
|---|---|
| V1PosX1 | 3.500 |
| V1PosY1 | 6.062 |
| V1PosX2 | 0.000 |
| V1PosY2 | 8.083 |

FIG. 26

TABLE ITEM SELECTIONS OF VARIOUS KINDS OF STATE INFORMATION ACCORDING TO PRESENCE OR ABSENCE OF NUMERICAL VALUE INPUT TO NUMERICAL VALUE INPUT FIELD

○ : PRESENCE OF NUMERICAL VALUE INPUT, BLANK: ABSENCE OF NUMERICAL VALUE INPUT

| COMBINATION PATTERN | PRESENCE OR ABSENCE OF NUMERICAL VALUE INPUT TO NUMERICAL VALUE INPUT FIELD | | | | DEPRESSION-ENABLED/DISABLED STATE OF AREA DETERMINATION SWITCH | PRESENCE OR ABSENCE OF SETTING OF LIMITED AREA (※1) | KIND OF SHAPE (※2) |
|---|---|---|---|---|---|---|---|
| | FIRST DISTANCE | FIRST ANGLE | SECOND DISTANCE | SECOND ANGLE | | | |
| 1 | | | | | DISABLED | ABSENCE OF SETTING | UNSET |
| 2 | ○ | | | | ENABLED | PRESENCE OF SETTING | RECTANGULAR SHAPE |
| 3 | | ○ | | | DISABLED | ABSENCE OF SETTING | UNSET |
| 4 | | | ○ | | DISABLED | ABSENCE OF SETTING | UNSET |
| 5 | | | | ○ | DISABLED | ABSENCE OF SETTING | UNSET |
| 6 | ○ | ○ | | | ENABLED | PRESENCE OF SETTING | TANGENT TO CONCENTRIC CIRCLE |
| 7 | ○ | | ○ | | DISABLED | ABSENCE OF SETTING | UNSET |
| 8 | ○ | | | ○ | DISABLED | ABSENCE OF SETTING | UNSET |
| 9 | | ○ | ○ | | DISABLED | ABSENCE OF SETTING | UNSET |
| 10 | | ○ | | ○ | DISABLED | ABSENCE OF SETTING | UNSET |
| 11 | | | ○ | ○ | DISABLED | ABSENCE OF SETTING | UNSET |
| 12 | ○ | ○ | ○ | | DISABLED | ABSENCE OF SETTING | UNSET |
| 13 | ○ | ○ | | ○ | DISABLED | ABSENCE OF SETTING | UNSET |
| 14 | ○ | | ○ | ○ | DISABLED | ABSENCE OF SETTING | UNSET |
| 15 | | ○ | ○ | ○ | DISABLED | ABSENCE OF SETTING | UNSET |
| 16 | ○ | ○ | ○ | ○ | ENABLED | PRESENCE OF SETTING | OPTIONAL STRAIGHT LINE |

※1: A CHANGE FROM THE "ABSENCE OF A SETTING" TO THE "PRESENCE OF A SETTING" AS TO THE PRESENCE OR ABSENCE OF A SETTING OF THE LIMITED AREA IS MADE WHEN THE AREA DETERMINATION SWITCH IS DEPRESSED.
THE "ABSENCE OF A SETTING" IS MAINTAINED UNTIL THE AREA DETERMINATION SWITCH IS DEPRESSED.

※2: A CHANGE TO OTHER THAN "UNSET" AS TO THE KIND OF SHAPE OF THE LIMITED AREA BOUNDARY IS MADE WHEN THE AREA DETERMINATION SWITCH IS DEPRESSED.
"UNSET" IS MAINTAINED UNTIL THE AREA DETERMINATION SWITCH IS DEPRESSED.

WORK MACHINE

TECHNICAL FIELD

The present invention relates to a work machine.

BACKGROUND ART

A work machine typified by a hydraulic excavator rarely operates in a state in which there is no obstacle within a work range reachable by a front work implement. For example, there may be an electric wire or a roof of a building in an upward direction of the work machine, there may be a wall or a vehicle such as a dump truck in a forward direction of the work machine, there may be a wall or a walkway in a left-right direction of the work machine, or there may be a buried pipe in a downward direction of the work machine. As described above, the work machine often operates in an environment in which there are many obstacles within the work range. In addition, even when there are no obstacles within the work range at a time of work by the work machine, a fine operation is required to form a slope face with an error in a determined tolerance range or excavate a straight groove, for example.

Hence, an operator of the work machine needs to pay attention to a work area and work accuracy at all times. This leads to fatigue of the operator. In addition, skillfulness of the operator is desired for work performed while attention is paid to the work area and the work accuracy.

In order to remedy this, there has been proposed a work machine which has a function referred to as what is generally called a machine control function or an area limiting function, which involves setting in advance an area (limited area) that the work machine is prohibited from entering and automatically performing speed control of actuators according to a distance between the area and a machine body.

For example, Patent Document 1 proposes a work machine including a controller that has functions of disabling the operation of the hydraulic excavator by the operator and automatically stopping a work implement when the work implement is about to deviate from a predetermined area, and further prevents an abrupt stop by limiting a lever operation amount moderately according to a distance between the work implement and a limited area.

Patent Document 2 proposes a work machine including a controller that can select one of two setting methods, that is, a method (numerical value input setting method) in which a specific distance numerical value is input by a numerical value input switch and a limited area is set on the basis of the input numerical value and a method (direct teaching setting method) in which a limited area is set on the basis of the current position of a bucket, by pressing a direct setting switch.

Patent Document 3 proposes an excavator including a controller that sets a virtual wall on the basis of the arrangement of objects (for example, road cones) on the periphery of an excavator and limits the operation of an actuator such that the excavator does not cross the virtual wall.

PRIOR ART DOCUMENT

Patent Documents

Patent Document 1: JP-H07-094735-A
Patent Document 2: Japanese Patent No. 3308450
Patent Document 3: PCT Patent Publication No. WO2019-189030

SUMMARY OF THE INVENTION

Problems to be Solved by the Invention

The technologies described in Patent Documents 1, 2, and 3 each have a commonality in that the limited area is set according to an intention of the operator. This is because, as an assumed usage, the area desired to be limited changes according to work conditions and a work environment at different times. When consideration is thus given, it is conceivable that there would be a desire to set not only a limited area of a simple shape but also a limited area of a complex shape. However, it is also conceivable that, when a limited area of a complex shape is to be set, time and effort taken for an operation by the operator of inputting information necessary to set the limited area becomes enormous. For example, when a limited area is indicated in a coordinate system having the swing center of the machine body as an origin, having an X-axis in the left-right direction of the machine body, and having a Y-axis in the forward-rearward direction of the machine body, the operator needs to input many coordinate points (combinations of X and Y) to indicate the complex area, taking much time for a preparatory stage before actual work.

As one means for facilitating the setting of a limited area of a complex shape, the technology described in Patent Document 3 senses specific objects (for example, road cones) by image recognition or the like, automatically converts the specific objects into coordinate points, and sets a limited area, thus obviating a need for numerical value input operation by the operator. However, time and effort for arranging the objects is incurred. In addition, there occurs anew a fear of being unable to recognize the objects when the field of view of a camera is interrupted by an obstacle, for example. Further, while the setting of a limited area of a complex shape is enabled, there is another problem in that more time and effort than that of numerical value input is involved in setting a simple area, as in "setting a virtual wall 5 m forward of the machine body."

The area limiting function that limits the operation of the work implement in order to prevent the work implement from entering a limited area is a work support function that assists the operator. Therefore, the usability of the area limiting function is an important requirement, and it is necessary to achieve a high level of balance between the time and effort of the operator and effects of the area limiting function.

The present invention has been devised to solve the above problems. It is an object of the present invention to provide a work machine that enables an easy setting of a limited area of a shape corresponding to work conditions and a work environment and thus provides an easy-to-use area limiting function.

Means for Solving the Problems

A work machine according to one aspect of the present invention includes a work implement provided to a machine body, a posture sensor that senses posture information regarding the work implement, a controller configured to compute a specific position of the work implement on the basis of the posture information from the posture sensor, set a limited area that the work implement is prohibited from entering, compute a movable distance as a distance between the limited area and the specific position of the work implement, and limit operation of the work implement according to the movable distance to prevent the work implement from entering the limited area, and an input device for inputting to the controller input information input by an operation of an operator. The controller includes a storage device that stores boundary information related to a plurality of different kinds of shapes of limited area boundaries, and the controller is configured to select one from among the plurality of kinds of shapes of limited area boundaries included in the boundary information, on the basis of the input information input from the input device, and set a limited area boundary of the selected kind of shape.

Advantages of the Invention

According to the present invention, it is possible to provide a work machine that enables an easy setting of a limited area of a shape corresponding to work conditions and a work environment (a simple shape or a complex shape) and thus provides an easy-to-use area limiting function.

BRIEF DESCRIPTION OF THE DRAWINGS

FIG. 15 is a diagram illustrating a list of variables related to limited area settings which is used in the present embodiment.

FIG. 26 is a diagram illustrating a table of selection items of various kinds of state information according to the presence or absence of numerical value input to a numerical value input field in the second embodiment of the present invention.

MODES FOR CARRYING OUT THE INVENTION

Work machines according to embodiments of the present invention will be described with reference to the drawings.

First Embodiment (Hydraulic Excavator)

Figure 1:
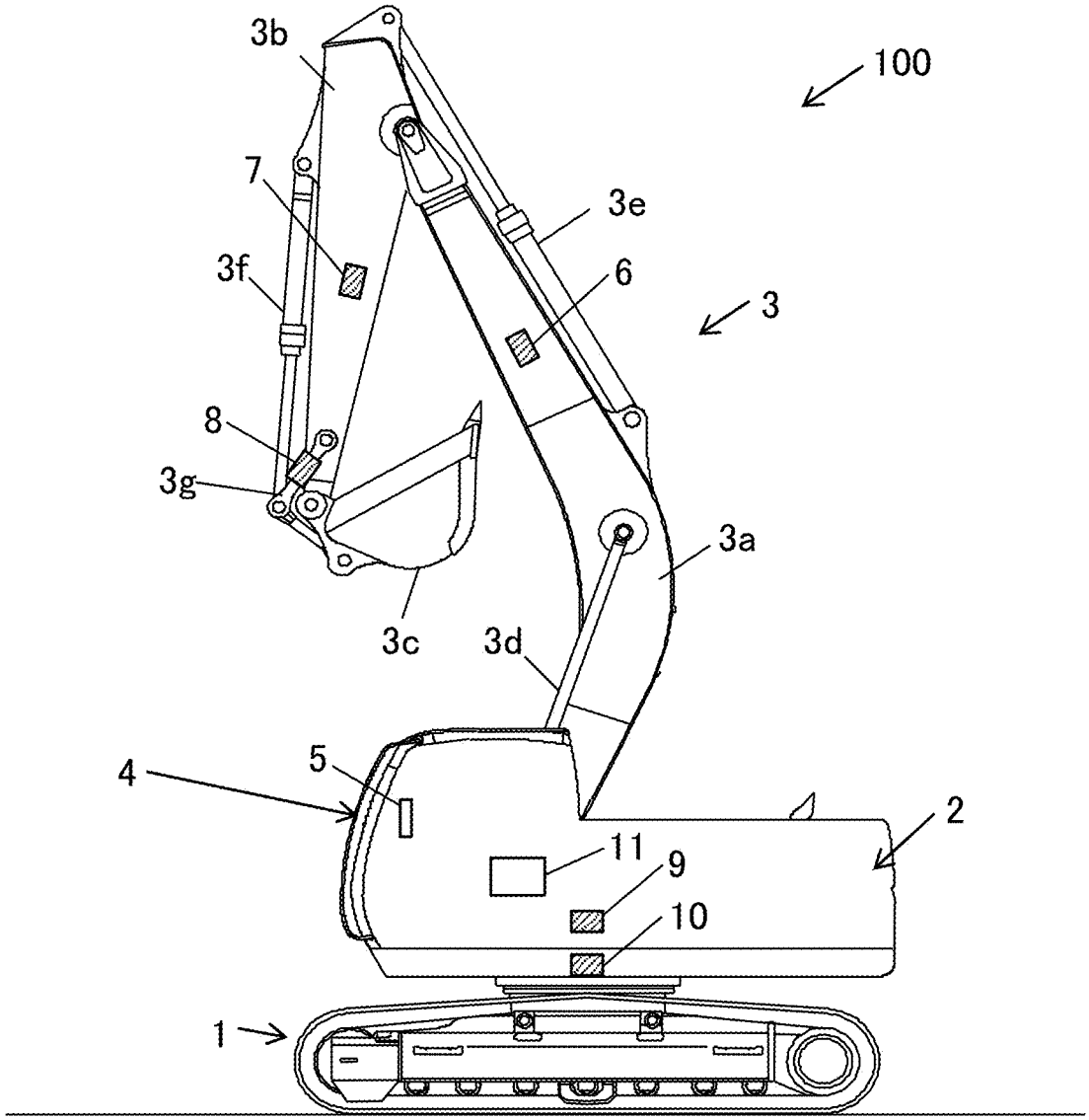
FIG. 1 is a diagram illustrating an external appearance of a hydraulic excavator illustrated as an example of a work machine according to a first embodiment of the present invention.

FIG. 1 is a diagram illustrating an external appearance of a hydraulic excavator 100 illustrated as an example of a work machine according to a first embodiment of the present invention. As illustrated in FIG. 1, the hydraulic excavator 100 includes a crawler type lower track structure 1, an upper swing structure 2 provided in a swingable manner to the lower track structure 1, and a front work implement 3 attached to the upper swing structure 2. In the present embodiment, the lower track structure 1 and the upper swing structure 2 constitute a machine body of the hydraulic excavator 100.

A pair of left and right travelling hydraulic motors (not illustrated) is arranged in the lower track structure 1. The travelling hydraulic motors and reduction gear mechanisms thereof or the like rotationally drive respective crawlers independently of each other, so that the crawlers travel forward or rearward.

The upper swing structure 2 is provided with a cab 4 in which operation devices for performing various kinds of operations of the hydraulic excavator 100, a cab seat for seating an operator, and the like are arranged. In addition, the upper swing structure 2 is mounted with a prime mover such as an engine, a hydraulic pump, a swing motor (not illustrated), and the like. The upper swing structure 2 is swung in a right direction or a left direction with respect to the lower track structure 1 by the swing motor. Provided within the cab 4 is a display device 5 that displays various kinds of meters and machine body information. Hence, the operator aboard the cab 4 can check operation conditions of the hydraulic excavator 100 by viewing information displayed on the display device 5.

The front work implement 3 is an articulated work implement attached to the upper swing structure 2 constituting the machine body. The front work implement 3 includes a plurality of hydraulic actuators and a plurality of driven members (front implement members) driven by the plurality of hydraulic actuators. The front work implement 3 has a configuration in which three driven members (a boom 3*a*, an arm 3*b*, and a bucket 3*c*) are coupled in series with each other. A proximal end portion of the boom 3*a* is rotatably connected to a front portion of the upper swing structure 2 via a boom pin. A proximal end portion of the arm 3*b* is rotatably connected to a distal end portion of the boom 3*a* via an arm pin. The bucket 3*c* is rotatably connected to a distal end portion of the arm 3*b* via a bucket pin.

The boom 3*a* is rotationally driven by expanding and contracting operations of a boom cylinder 3*d* as a hydraulic actuator (hydraulic cylinder). The arm 3*b* is rotationally driven by expanding and contracting operations of an arm cylinder 3*e* as a hydraulic actuator (hydraulic cylinder). The bucket 3*c* is rotationally driven by expanding and contracting operations of a bucket cylinder 3*f* as a hydraulic actuator (hydraulic cylinder).

(Posture Sensor)

The hydraulic excavator 100 is provided with a posture sensor 102 (see FIG. 2) including a plurality of posture sensors 6 to 10 that sense information regarding the posture of the hydraulic excavator 100 (the posture of the front work implement 3, the posture of the upper swing structure 2, and the posture of the lower track structure 1) (which will hereinafter also be described as posture information). The plurality of posture sensors 6 to 10 include IMUs (Inertial Measurement Units) 6, 7, and 8 and angle sensors 9 and 10.

The IMU 6 for the boom is attached to a side surface of the boom 3*a*. The IMU 7 for the arm is attached to a side surface of the arm 3*b*. The IMU 8 for the bucket is attached to a side surface of a bucket link 3*g*. The IMUs 6, 7, and 8 obtain angular velocities and accelerations of the boom 3*a*, the arm 3*b*, and the bucket 3*c* on three orthogonal axes, and output the angular velocities and the accelerations to a main controller 11.

Attached onto a frame of the upper swing structure 2 is the inclination angle sensor 9 that senses an inclination angle in a front-rear direction of the upper swing structure 2 with respect to a reference plane (for example, a horizontal plane) (which will hereinafter also be described as a pitch angle) and an inclination angle in a left-right direction of the upper swing structure 2 with respect to the reference plane (which will hereinafter also be described as a roll angle), and outputs a result of the sensing to the main controller 11. Attached to a center joint (not illustrated) that connects the lower track structure 1 and the upper swing structure 2 to each other is the swing angle sensor 10 that senses a relative angle of the upper swing structure 2 with respect to the lower track structure 1 (which will hereinafter also be described as a swing angle), and outputs a result of the sensing to the main controller 11.

The main controller (machine controller) 11 that controls operation of various parts of the hydraulic excavator 100 is mounted within the cab 4 of the hydraulic excavator 100. The main controller 11 has a function of receiving signals input from various kinds of sensors, a function of outputting signals for driving hydraulic apparatuses such as a hydraulic pump and a control valve, a function of communicating with other vehicle-mounted controllers such as an engine controller, and the like.

In the present embodiment, the IMUs 6, 7, and 8, the inclination angle sensor 9, and the swing angle sensor 10 are electrically connected to the main controller 11. On the basis of signals from the IMUs 6, 7, and 8, the inclination angle sensor 9, and the swing angle sensor 10, the main controller 11 computes the rotational angle of the boom 3*a* with respect to the upper swing structure 2 (boom angle), the rotational angle of the arm 3*b* with respect to the boom 3*a* (arm angle), and the rotational angle of the bucket 3*c* with respect to the arm 3*b* (bucket angle) as well as the pitch angle, the roll angle, and the swing angle of the upper swing structure 2.

(Description of System Configuration and Apparatuses Mounted in Hydraulic Excavator)

Figure 2:
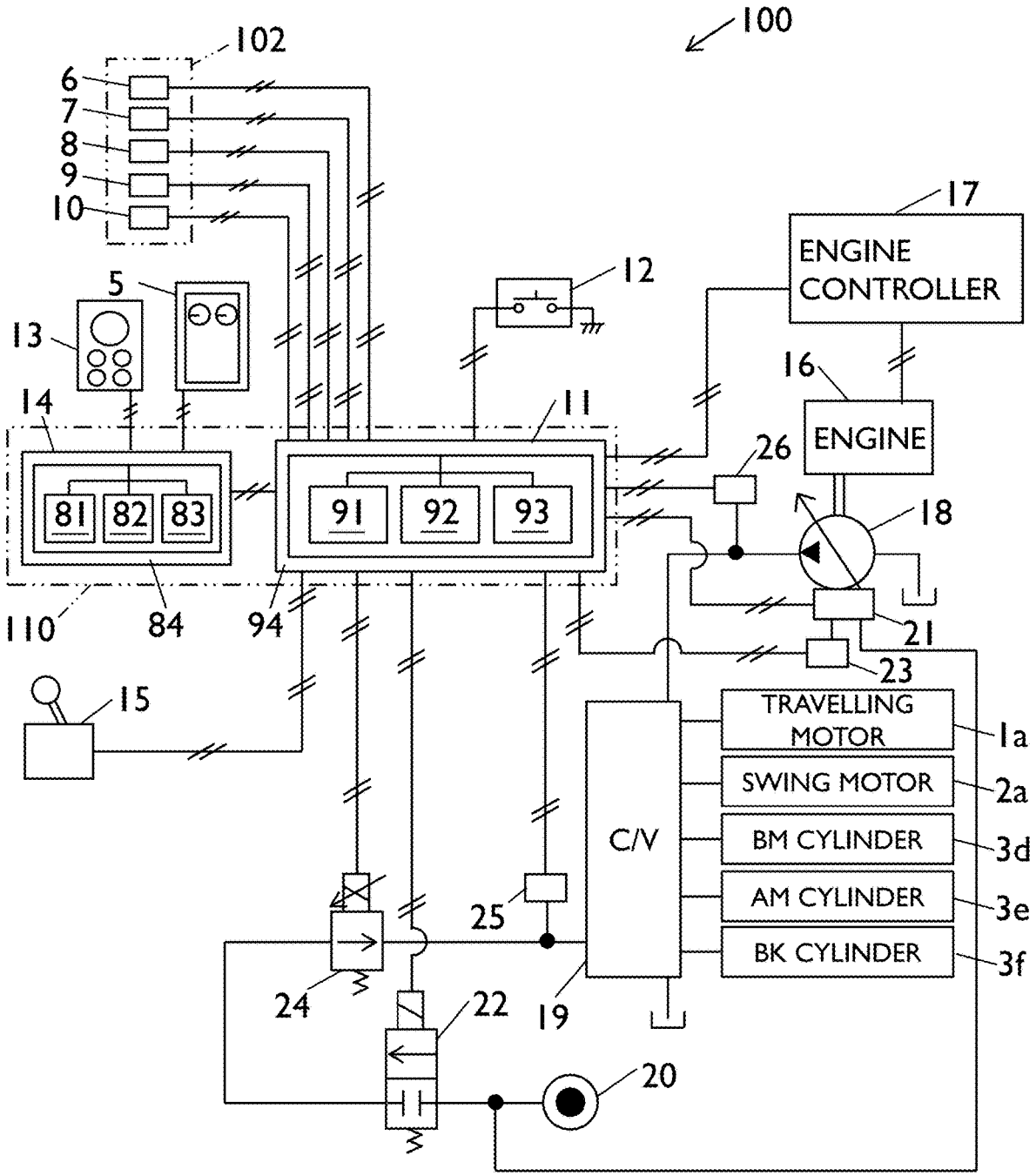
FIG. 2 is a diagram illustrating a system configuration of the hydraulic excavator.

FIG. 2 is a diagram illustrating a system configuration of the hydraulic excavator 100. Provided within the cab 4 of the hydraulic excavator 100 according to the present embodiment are the main controller 11 that controls operation of the whole of the hydraulic excavator 100; a lock switch 12 as a lever type switch for operating a lock valve 22; the display device 5 that displays various kinds of meters and machine body information so as to enable the operator to check the conditions of the hydraulic excavator 100; a switch box 13 for manually changing an engine speed (rotational speed) and operating the display device 5; and a monitor controller 14 that receives various kinds of switch inputs of the switch box 13 and changes display contents of the display device 5.

Each of the monitor controller 14 and the main controller 11 is constituted by a computer including a processor 81 or 91 such as a CPU (Central Processing Unit), an MPU (Micro Processing Unit), or a DSP (Digital Signal Processor), a nonvolatile memory 82 or 92 as a storage device such as a ROM (Read Only Memory), a flash memory, and a hard disk drive, a volatile memory 83 or 93 referred to as what is generally called a RAM (Random Access Memory), an input-output interface 84 or 94, and a bus that electrically connects these apparatuses to one another. Incidentally, each of the monitor controller 14 and the main controller 11 may be constituted by one computer, or may be constituted by a plurality of computers.

The nonvolatile memories 82 and 92 store a program that can perform various kinds of computations. That is, the nonvolatile memories 82 and 92 are storage media from which programs for implementing functions of the present embodiment are readable. The processors 81 and 91 are processing devices that expand the programs stored in the nonvolatile memories 82 and 92 into the volatile memories 83 and 93, and compute and execute the programs. The processors 81 and 91 perform predetermined computation processing on signals taken in from the input-output interfaces 84 and 94, the nonvolatile memories 82 and 92, and the volatile memories 83 and 93 according to the programs.

Input units of the input-output interfaces 84 and 94 convert signals input from external devices (the switch box 13, an operation device 15, the lock switch 12, various kinds of sensors 6 to 10, 23, 25, and 26, and the like) into signals that can be computed by the processors 81 and 91. In addition, output units of the input-output interfaces 84 and 94 generate signals for output according to computation results in the processors 81 and 91, and output the signals to external devices (the display device 5, a pilot pressure control pressure reducing valve 24, the lock valve 22, a pump regulator 21, and the like).

As described earlier, the operation devices for performing various kinds of operations of the hydraulic excavator 100 are provided within the cab 4 of the hydraulic excavator 100. FIG. 2 representatively illustrates the operation device 15 representing one of the plurality of operation devices for performing a boom raising operation, a boom lowering operation, an arm crowding operation, an arm dumping operation, a bucket crowding operation, a bucket dumping operation, a left swing operation, a right swing operation, a right forward travelling operation, a right backward travelling operation, a left forward travelling operation, and a left backward travelling operation, respectively.

The hydraulic excavator 100 according to the present embodiment includes an engine 16 as a prime mover. An engine controller 17 electrically connected to the engine 16 identifies the state of the engine 16 on the basis of signals output from a temperature sensor, a pickup sensor, and the like incorporated in the engine 16, and controls the revolution speed and torque of the engine 16 by controlling a valve or the like.

The main controller 11, the monitor controller 14, and the engine controller 17 are connected to each other by CAN communication, and each transmit and receive necessary information. For example, with regard to engine speed control, the main controller 11 determines an engine target speed according to an engine control dial voltage, the operation state of the operation device 15, and the load state and temperature condition of a hydraulic pump 18, and transmits the engine target speed to the engine controller 17. The engine controller 17 controls the engine 16 such that an engine actual speed becomes the engine target speed. The engine controller 17 computes the engine actual speed from the signal of the pickup sensor incorporated in the engine 16, and transmits the engine actual speed to the main controller 11.

The monitor controller 14 controls the display device 5 on the basis of information from the switch box 13, the main controller 11, the engine controller 17, the various kinds of sensors, and the like. The monitor controller 14 can obtain the engine target speed and the engine actual speed on the CAN communication. Thus, the monitor controller 14 can display, on the display device 5, the engine target speed and the engine actual speed as one of pieces of information indicating the operation state of the hydraulic excavator 100.

The hydraulic pump 18 is a variable displacement hydraulic pump driven by the engine 16. The hydraulic pump 18 delivers a hydraulic operating fluid as a working fluid. The hydraulic operating fluid delivered from the hydraulic pump 18 goes through a control valve 19 for controlling a flow of oil to each hydraulic actuator, and is supplied to a travelling motor 1*a*, a swing motor 2*a*, the boom cylinder 3*d*, the arm cylinder 3*e*, and the bucket cylinder 3*f*. Incidentally, while the hydraulic excavator is generally mounted with a plurality of hydraulic pumps in consideration of conditions in which a plurality of actuators are operated simultaneously, for example, FIG. 2 representatively illustrates one of the plurality of hydraulic pumps.

In the present embodiment, the operation device 15 is an electric control lever device including a tiltable control lever. A PWM output signal corresponding to an operation amount of the control lever is input from the operation device 15 to the main controller 11.

A hydraulic operating fluid delivered from a hydraulic fluid source 20 such as a pilot pump that is driven by the engine 16 is supplied to the pump regulator 21 and the lock valve 22. The hydraulic fluid source 20 and a pilot primary pressure introduced into the pump regulator 21 and the lock valve 22 are maintained at a predetermined pressure (for example, 4 MPa) by a pilot relief valve not illustrated.

The pump regulator 21 has a pump flow control valve as a solenoid proportional valve for reducing and using the pilot primary pressure from the hydraulic fluid source 20. The pump flow control valve reduces the pilot primary pressure according to a current (mA) output by the main controller 11, and outputs a secondary pressure. The pump regulator 21 includes a tilting (displacement volume) control mechanism for the hydraulic pump 18. The pump regulator 21 controls the volume, that is, the delivery flow rate, of the hydraulic pump 18 according to a pump flow rate control pressure as the output of the pump flow control valve (secondary pressure).

The pump regulator 21 minimizes the pump volume when the pump flow rate control pressure is at a minimum (0 MPa). The pump regulator 21 maximizes the pump volume when the pump flow rate control pressure is at a maximum (4 MPa). The pump flow control valve is at an interruption position (0 MPa) in a non-control state (0 mA). The pump flow control valve increases the pump flow rate control pressure as a command current from the main controller 11 is increased.

The pump regulator 21 has a pump flow rate control pressure sensor 23 for sensing the pump flow rate control pressure. A signal of the pump flow rate control pressure sensor 23 is input to the main controller 11. The main controller 11 refers to a characteristic of the pump volume with respect to the pump flow rate control pressure, computes the pump volume on the basis of the pump flow rate control pressure input to the main controller 11, and computes the delivery flow rate of the hydraulic pump 18 by multiplying together a result of the computation and the engine speed.

The lock valve 22 is an operation lock device that can switch between the enabling and disabling of operation of all of the hydraulic actuators provided to the hydraulic excavator 100. The lock valve 22 is switched between an interruption position and a communication position by a solenoid driven by the main controller 11. When a lock lever installed within the cab 4 is at a lock position, the lock switch 12 is in an OFF (open between terminals) state. When the lock lever installed within the cab 4 is at a lock releasing position, the lock switch 12 is in an ON (conduction between the terminals) state.

The main controller 11 monitors the state of the lock switch 12, and sets the lock valve 22 to a circuit interruption position in a non-energized state when the lock switch 12 is OFF. The main controller 11 monitors the state of the lock switch 12, and sets the lock valve 22 to a circuit communication position in an energized state by applying 24 V to the lock valve 22 when the lock switch 12 is ON.

A pilot circuit between the lock valve 22 and the control valve 19 is provided with the pilot pressure control pressure reducing valve 24. The main controller 11 drives the pilot pressure control pressure reducing valve 24 according to the magnitude of a lever operation amount as an input signal of the operation device 15.

When the lock valve 22 is at the circuit communication position, the pilot pressure control pressure reducing valve 24 is supplied with the pilot primary pressure, and the pilot pressure control pressure reducing valve 24 generates a pilot operation pressure. The pilot operation pressure generated by the pilot pressure control pressure reducing valve 24 moves a plurality of spools (directional control valves) provided within the control valve 19, and thereby adjusts flows of the hydraulic operating fluid delivered from the hydraulic pump 18, enabling operation of the corresponding actuators.

When the lock valve 22 is at the circuit interruption position, the pilot pressure control pressure reducing valve 24 is not supplied with the pilot primary pressure. Consequently, the pilot operation pressure is not generated (the pilot operation pressure becomes 0 MPa), so that the operation of the actuators (the travelling motor 1*a*, the swing motor 2*a*, the boom cylinder 3*d*, the arm cylinder 3*e*, and the bucket cylinder 3*f*) is disabled.

A pilot circuit between the pilot pressure control pressure reducing valve 24 and the control valve 19 is provided with an operation pressure sensor 25 for sensing the pilot operation pressure. A signal of the operation pressure sensor 25 is input to the main controller 11. The main controller 11 monitors the operation conditions of the hydraulic excavator 100 and whether the pilot pressure control pressure reducing valve 24 is operating normally.

A delivery circuit between the hydraulic pump 18 and the control valve 19 is provided with a pump delivery pressure sensor 26 for sensing a pump delivery pressure. A signal of the pump delivery pressure sensor 26 is input to the main controller 11. The main controller 11 monitors a load on the hydraulic pump 18 of the hydraulic excavator 100.

The main controller 11 computes a pump target flow rate based on an operation, according to the engine speed and the input of the operation device 15. The main controller 11 computes a limited horsepower (kW) according to the engine speed, the operation conditions, and other machine body states (temperature and the like), and computes a pump upper limit flow rate based on a horsepower limitation from the input of the pump delivery pressure sensor 26 and the limited horsepower. The main controller 11 selects the lower of the pump target flow rate based on the operation and the pump upper limit flow rate based on the horsepower limitation, as a pump target flow rate, and drives the pump flow control valve of the pump regulator 21 so as to achieve the flow rate.

(Operator User Interface of Area Limiting Function)

Figure 3:
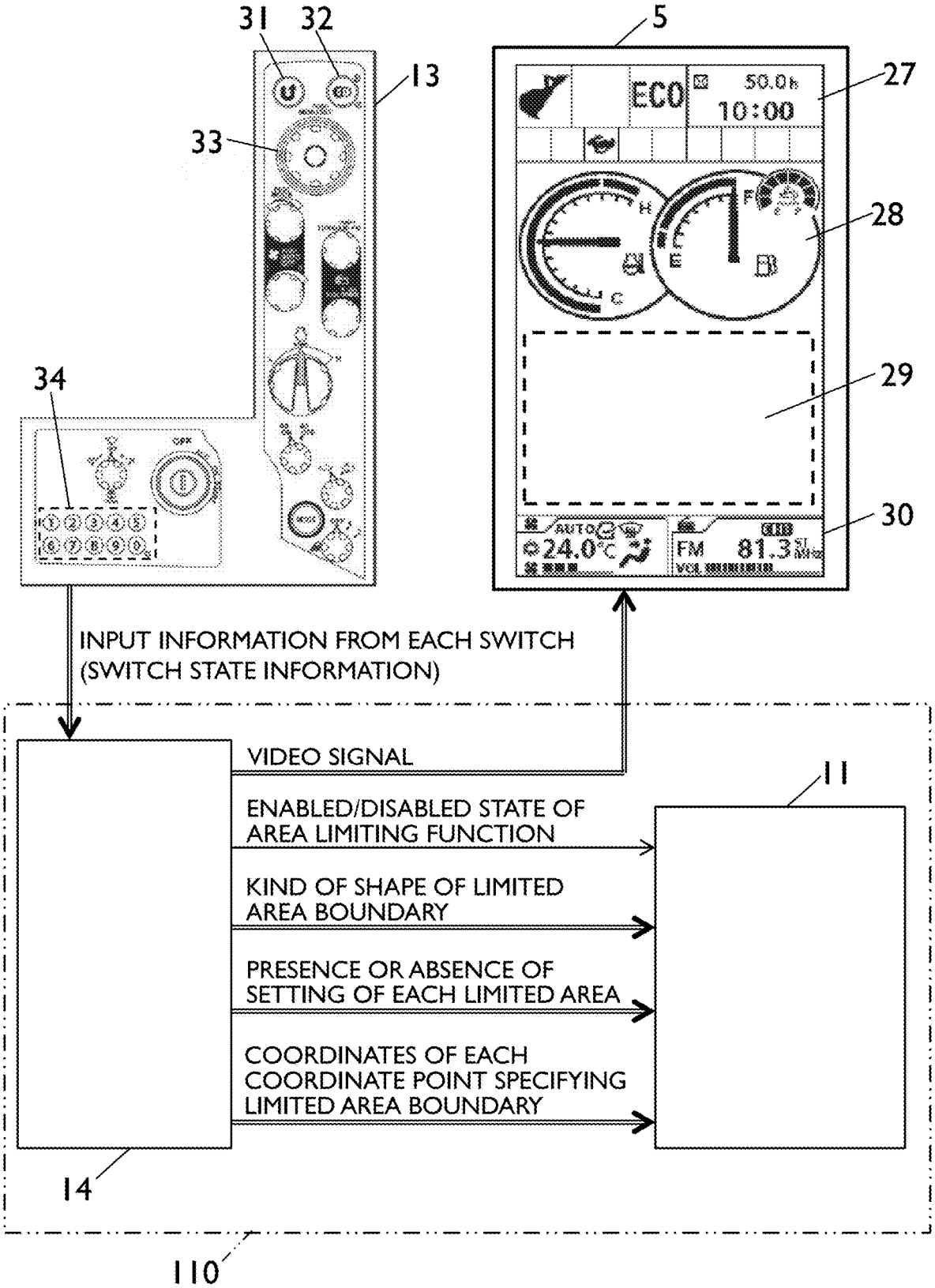
FIG. 3 is a diagram illustrating an operator user interface of an area limiting function.

FIG. 3 is a diagram illustrating an operator user interface of an area limiting function. The monitor controller 14 receives state information (input information) of each switch from the switch box 13, and changes various kinds of information accordingly. The monitor controller 14 outputs these pieces of information as video data to the display device 5. The operator can get hold of various kinds of state information regarding the hydraulic excavator 100 by viewing video (a still image or a moving image) displayed on a display screen of the display device 5. When the operator makes various kinds of settings such as the setting of the area limiting function, the operator can perform input operations for the various kinds of settings while viewing related information displayed on the display device 5.

The monitor controller 14 and the main controller 11 intercommunicate with each other by CAN communication. In the present embodiment, the main controller 11 that performs control for exerting the area limiting function (area limiting control) and the monitor controller 14 that transmits information regarding the area limiting function to the main controller 11 constitute a controller 110. The information regarding the area limiting function includes information regarding the enabled/disabled state of the area limiting function, information related to a kind of shape of a limited area boundary, information regarding the presence or absence of a setting of each of a plurality of limited areas, and information regarding the coordinates of each coordinate point specifying the limited area boundary (position specifying information specifying the position of a plane forming the limited area). Details of these pieces of information will be described later. Incidentally, the limited area is an area that the front work implement 3 and the upper swing structure 2 are prohibited from entering.

In addition, information regarding kinds of shapes of limited area boundaries to be described later (which will hereinafter also be described as boundary information) is stored in the nonvolatile memory 82 of the monitor controller 14 in advance. The switch box 13 inputs, to the monitor controller 14, input information input by an operation of the operator. For example, when a kind of shape of a limited area boundary is selected by an operation of the switch box 13 by the operator, the selected information is input as input information to the monitor controller 14. Accordingly, the monitor controller 14 refers to the boundary information stored in the nonvolatile memory 82, on the basis of the input information input to the monitor controller 14, and selects one from among a plurality of different kinds of shapes of limited area boundaries. That is, the monitor controller 14 select one from among the plurality of kinds of shapes of limited area boundaries included in the boundary information, on the basis of the input information. Further, the monitor controller 14 displays an area setting screen (FIG. 12A, FIG. 13A, FIG. 14A, or the like) corresponding to the selected kind of shape of a limited area boundary on the display device 5. Details of a limited area setting method will be described later.

The display device 5 has a display screen such as a liquid crystal display. The display device 5 is controlled by the monitor controller 14. The display screen of the display device 5 displays a basic screen as one illustrated in FIG. 3. On the basic screen, a state display section 27 is disposed in an uppermost portion of the basic screen, a meter display section 28 is disposed below the state display section 27, a camera video display section 29 is disposed below the meter display section 28, and an air conditioner/radio information display section 30 is disposed in a lowermost portion of the basic screen. The state display section 27 displays various kinds of states of the hydraulic excavator 100 such as a current work mode, a power mode, an hour meter, and a travelling mode (high speed/low speed). The meter display section 28 displays a cooling water temperature and a remaining fuel amount. The camera video display section 29 displays video of a periphery monitoring camera. The air conditioner/radio information display section 30 displays the states of an air conditioner and a radio.

As will be described later, when the operator makes various kinds of settings of the area limiting function, for example, the monitor controller 14 displays a dedicated screen (an area setting screen to be described later or the like) on the display screen of the display device 5 irrespective of the display pattern of the basic screen.

The switch box 13 is an input device for performing operations of the display device 5 and various kinds of setting operations related to the area limiting function. The switch box 13 includes a previous screen return switch 31, a basic screen return switch 32, and a selection/determination switch 33. The switch box 13 outputs, as input information, information input by an operation on each switch. The input information output from the switch box 13 is input to the monitor controller 14. The selection/determination switch 33 is a switch that can be rotated left or right and depressed.

When the selection/determination switch 33 is depressed in a state in which the basic screen is displayed on the display device 5, a transition is made to a setting menu screen on which to make various kinds of settings. Incidentally, a setting procedure related to the area limiting function will be described later. The switch box 13 is also provided with numeric keys 34. The numeric keys 34 are used when the operator performs a numerical value input operation.

(Functions of Main Controller)

Figure 4:
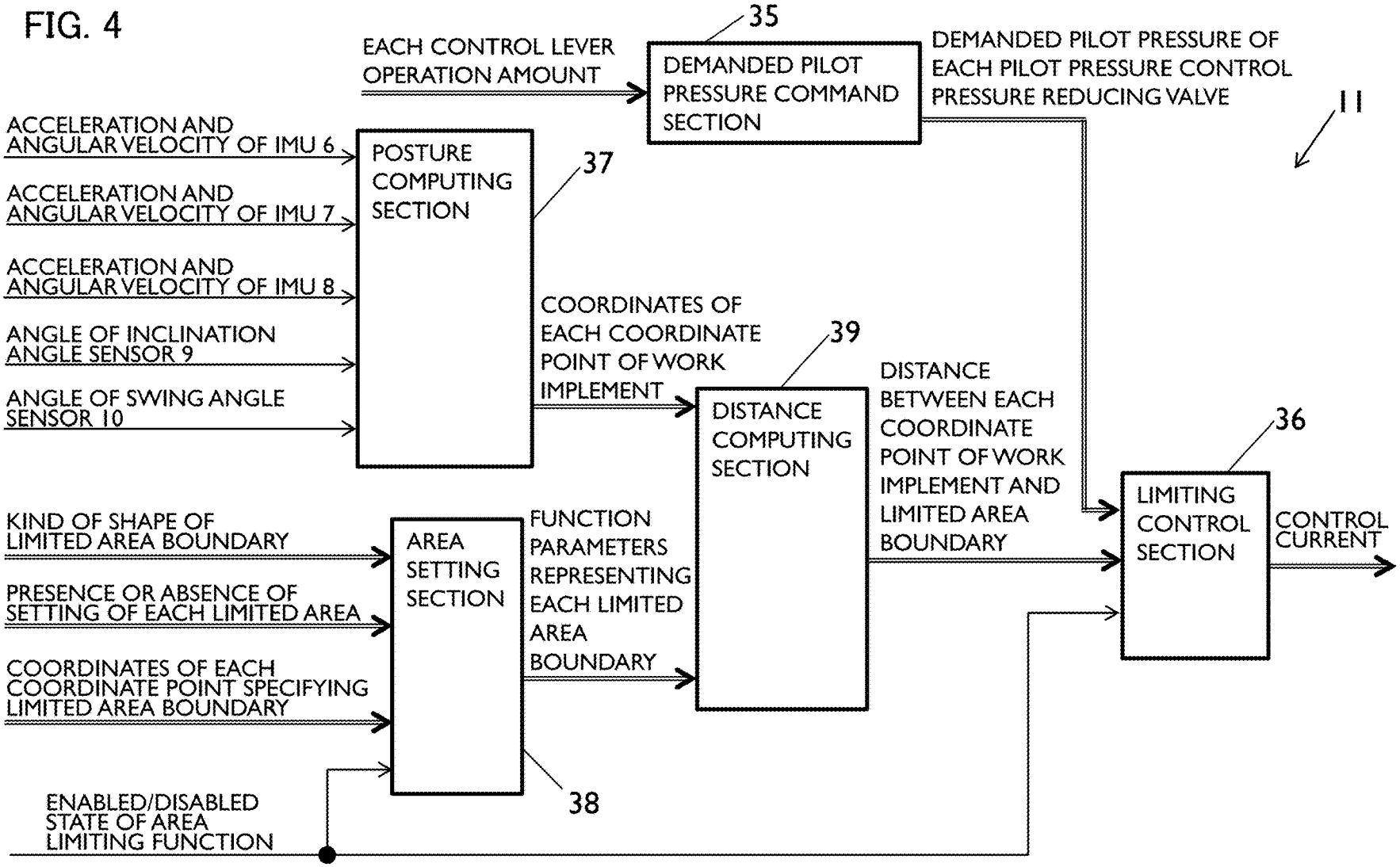
FIG. 4 is a functional block diagram of a main controller related to the area limiting function.

FIG. 4 is a functional block diagram of the main controller 11 related to the area limiting function. As illustrated in FIG. 4, the main controller 11 functions as a demanded pilot pressure command section 35, a limiting control section 36, a posture computing section 37, an area setting section 38, and a distance computing section 39.

The main controller 11 receives a PWM signal from the operation device 15, and converts the PWM signal into a control lever operation amount. The control lever operation amount is indicated by a value that, for example, becomes 0% at a time of lever neutral and becomes 100% at a time of a full lever operation (maximum operation).

The demanded pilot pressure command section 35 determines a demanded pilot pressure (secondary pressure) of the pilot pressure control pressure reducing valve 24 from each control lever operation amount. The demanded pilot pressure based on lever operation is input to the limiting control section 36. The limiting control section 36 converts the demanded pilot pressure into a proportional solenoid valve current value corresponding to the demanded pilot pressure, outputs a control current to a solenoid of the pilot pressure control pressure reducing valve 24, and drives the pilot pressure control pressure reducing valve 24. Thus, the hydraulic excavator 100 operates according to the lever operation intended by the operator.

The main controller 11 is connected with the IMUs 6, 7, and 8, the inclination angle sensor 9, and the swing angle sensor 10 constituting the posture sensor 102. Signals of these sensors are input to the posture computing section 37. The storage device such as the nonvolatile memory 92 of the main controller 11 stores constants of various kinds of dimension data and angle data of the hydraulic excavator 100. On the basis of these constants and the signals from the posture sensors (6 to 10) (posture information), the posture computing section 37 computes specified positions of the front work implement 3 and the upper swing structure 2 (which will hereinafter also be described as specific positions) in a case where an origin O in a hydraulic excavator reference coordinate system (the origin in the present embodiment is immediately below the swing center of the hydraulic excavator 100 and on the lower surface of the lower track structure) is set as a reference, and the posture computing section 37 computes in which range the front work implement 3 and the upper swing structure 2 of the hydraulic excavator 100 are present in a work space.

The posture computing section 37 computes the coordinates (X, Y, Z) of coordinate points of the specific positions (for example, both a left end and a right end of a claw tip of the bucket 3*c* or the like) of the front work implement 3 which are set in advance. The posture computing section 37 outputs the computed coordinates of each coordinate point to the distance computing section 39.

The area setting section 38 receives information regarding the kind of shape of a limited area boundary, information regarding the presence or absence of a setting of each of a plurality of limited areas, information regarding the coordinates of each coordinate point specifying the limited area boundary, and information regarding the enabled/disabled state of the area limiting function, these pieces of information being transmitted from the monitor controller 14, computes, from these pieces of information, parameters of a function representing the limited area boundary (plane forming a limited area) (which will hereinafter be described as function parameters), and outputs the computed function parameters to the distance computing section 39.

For example, when a limited area boundary is represented by a straight line passing through two points, the area setting section 38 computes numerical values indicating the X-coordinate and the Y-coordinate of each of the two points, as function parameters indicating the limited area boundary. The limited area boundary is determined when the function parameters are determined. That is, the area setting section 38 sets the limited area boundary (that is, sets a limited area) by computing the function parameters. An area on a side on which the hydraulic excavator 100 is present with respect to the limited area boundary is an area in which the hydraulic excavator 100 can operate (non-limited area). An area on a side on which the hydraulic excavator 100 is not present with respect to the limited area boundary is a limited area that the front work implement 3 and the upper swing structure 2 are prohibited from entering.

As will be described later in detail, when information regarding the coordinates of each coordinate point specifying the limited area boundary (position specifying information) is input to the area setting section 38, the area setting section 38 sets the limited area boundary (plane forming a limited area) by computing the function parameters (numerical values) indicating the limited area boundary, on the basis of the position specifying information and a position specifying method corresponding to a selected kind of shape. Incidentally, the position specifying method is determined according to the kind of shape of the limited area boundary, and is stored in the nonvolatile memory 92 in advance. When information regarding the kind of shape of the limited area boundary is input to the area setting section 38, the area setting section 38 refers to the nonvolatile memory 92 and selects the position specifying method corresponding to the input kind of shape of the limited area boundary, on the basis of the information.

The distance computing section 39 receives the coordinates of the respective coordinate points of the front work implement 3 and the upper swing structure 2, the coordinates being output by the posture computing section 37, and the function parameters indicating each limited area boundary, the function parameters being output by the area setting section 38. On the basis of the received information, the distance computing section 39 computes and outputs a movable distance d as a distance between the coordinate point of each of the specific positions of the front work implement 3 and the upper swing structure 2 and the limited area boundary (plane forming a limited area). The distance computing section 39 computes the distance (movable distance d) between each of the coordinate points of the respective specific positions of the front work implement 3 and the upper swing structure 2 and the limited area boundary represented by the input function parameters and a function (equation) determined in advance, and transmits the movable distance d to the limiting control section 36.

The limiting control section 36 is supplied with the demanded pilot pressure of the pilot pressure control pressure reducing valve 24 from the demanded pilot pressure command section 35, the distance (movable distance d) between the coordinate point of each of the specific positions of the front work implement 3 and the upper swing structure 2 and the limited area boundary from the distance computing section 39, and the information regarding the enabled/disabled state of the area limiting function from the monitor controller 14.

The enabled/disabled state of the area limiting function is selected by the operator operating various kinds of switches of the switch box 13 while viewing a setting menu of the display device 5. When the area limiting function is set in a disabled state, the limiting control section 36 determines the output of the pilot pressure control pressure reducing valve 24 in such a manner as to generate the demanded pilot pressure of the pilot pressure control pressure reducing valve 24 from the demanded pilot pressure command section 35 at all times, irrespective of the distance (movable distance d) between the coordinate point of each of the specific positions of the front work implement 3 and the upper swing structure 2 and the limited area boundary.

When the area limiting function is set in an enabled state, the limiting control section 36 limits an upper limit of the output of the pilot pressure control pressure reducing valve 24 according to the movable distance d. The limiting control section 36 decreases the upper limit of the output (secondary pressure) of the pilot pressure control pressure reducing valve 24 as the movable distance d is decreased. Consequently, the front work implement 3 decelerates when approaching the limited area during excavation work, for example, and the front work implement 3 can be stopped before reaching the limited area. Thus, the main controller 11 limits the operation of the front work implement 3 according to the movable distance d in order to prevent the front work implement 3 from entering the limited area. In other words, the main controller 11 suppresses the operation of the front work implement 3 such that the front work implement 3 does not deviate from an operable area (non-limited area) to the limited area side. Incidentally, when the upper swing structure 2 is swung, the operation of the upper swing structure 2 is limited according to the movable distance d.

The limiting control section 36 limits the upper limit of the output of the pilot pressure control pressure reducing valve 24 only when an operation of moving the front work implement 3 in a direction of entering the limited area (direction of bringing the front work implement 3 close to the limited area) is performed. That is, the limiting control section 36 does not place a limitation on the upper limit of the output of the pilot pressure control pressure reducing valve 24 for an operation of bringing back the front work implement 3 from the limited area side to the non-limited area side or an operation in a direction of separating the front work implement 3 from the limited area.

(Description of Coordinate Systems)

Figure 5:
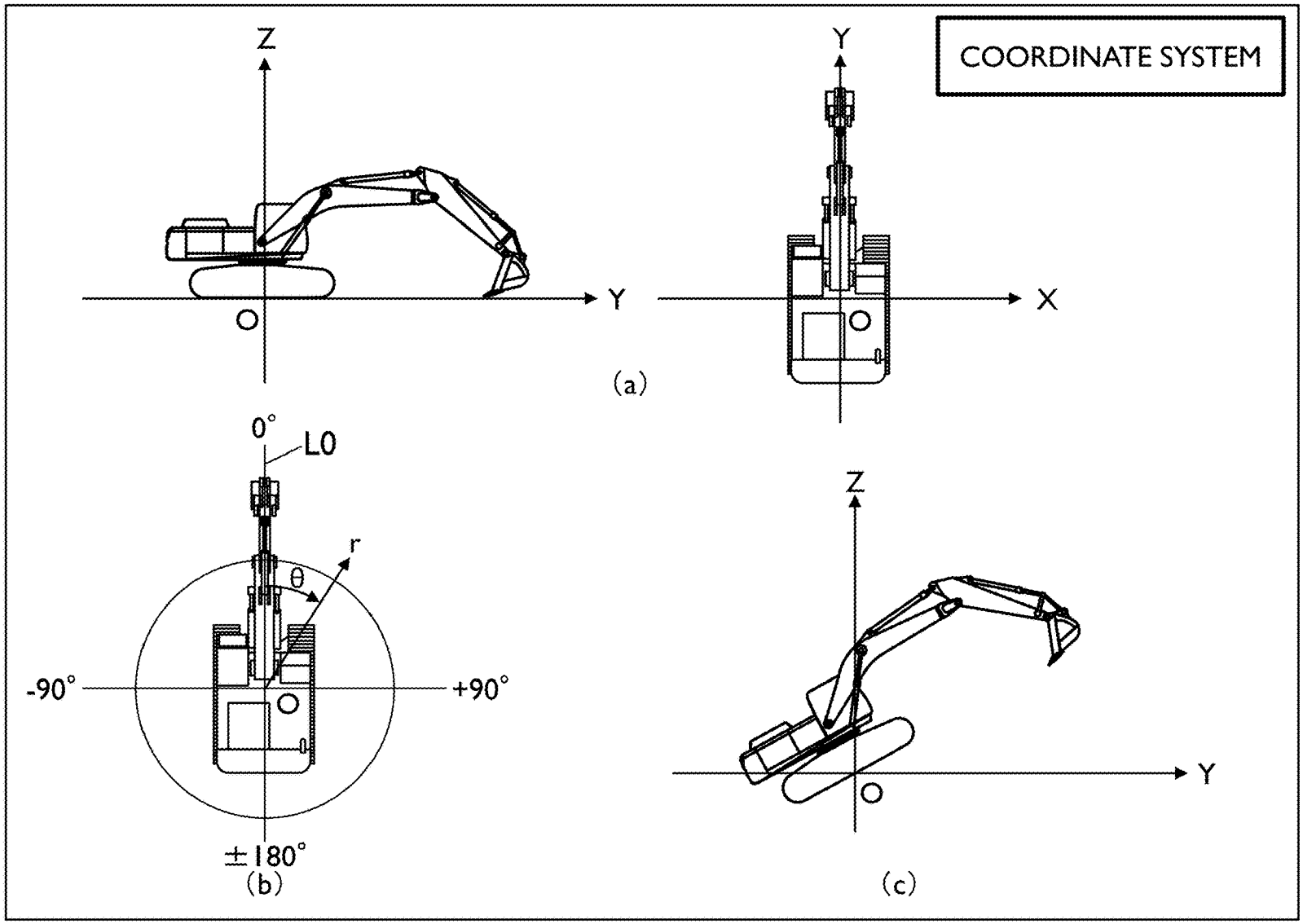
FIG. 5 depicts diagrams illustrating coordinate systems of the hydraulic excavator in relation to the area limiting function.

FIG. 5 depicts diagrams illustrating coordinate systems of the hydraulic excavator 100 in relation to the area limiting function. In the present embodiment, a rectangular coordinate system and a cylindrical coordinate system are used to set a limited area. The main controller 11 sets the origin O of the coordinate systems for setting a limited area boundary.

In the present embodiment, the main controller 11 sets a point of intersection of the swing central axis of the hydraulic excavator 100 and the lower surface of the lower track structure 1 as the origin O of the rectangular coordinate system and the cylindrical coordinate system.

As illustrated in FIG. 5(*a*), the rectangular coordinate system is a three-dimensional coordinate system formed by an X-axis, a Y-axis, and a Z-axis orthogonal to each other, and a position is indicated by an X-coordinate, a Y-coordinate, and a Z-coordinate. The Y-axis is a coordinate axis extending in a longitudinal horizontal direction (travelling direction) of the lower track structure 1 from the origin O. A positive direction of the Y-axis is a forward direction of the lower track structure 1 from the origin O. A negative direction of the Y-axis is a rearward direction of the lower track structure 1 from the origin O. The X-axis is a coordinate axis extending in a lateral horizontal direction of the lower track structure 1 from the origin O. A positive direction of the X-axis is a right direction of the lower track structure 1. A negative direction of the X-axis is a left direction of the lower track structure 1. The Z-axis is a coordinate axis extending in a gravitational direction of an upward-downward direction (that is, a vertical direction) from the origin O. A positive direction of the Z-axis is an upward direction from the origin O. A negative direction of the Z-axis is a downward direction from the origin O.

As illustrated in FIG. 5(*b*), the cylindrical coordinate system is a three-dimensional coordinate system formed by an r-axis, a θ-axis, and a Z-axis, and a position is indicated by an r-coordinate, a θ-coordinate, and a Z-coordinate. The Z-axis is the same as the Z-axis of the above-described rectangular coordinate system. The r-coordinate corresponds to a horizontal distance in a radial direction from the origin O. The θ-coordinate corresponds to an angle from an angle reference line L0 when a horizontal line extending in the forward direction of the lower track structure 1 from the origin O is set as the angle reference line L0 (0°). A direction in which the upper swing structure 2 swings clockwise from the angle reference line L0 is a positive direction of the θ-axis. A direction in which the upper swing structure 2 swings counterclockwise from the angle reference line L0 is a negative direction of the θ-axis. The range of an angle θ is ±180°.

Incidentally, in the rectangular coordinate system and the cylindrical coordinate system, as illustrated in FIG. 5(*c*), an XY-direction is defined as a direction parallel with a horizontal ground irrespective of the pitch angle and the roll angle of the upper swing structure 2.

(Description of Limited Area)

Figure 6:
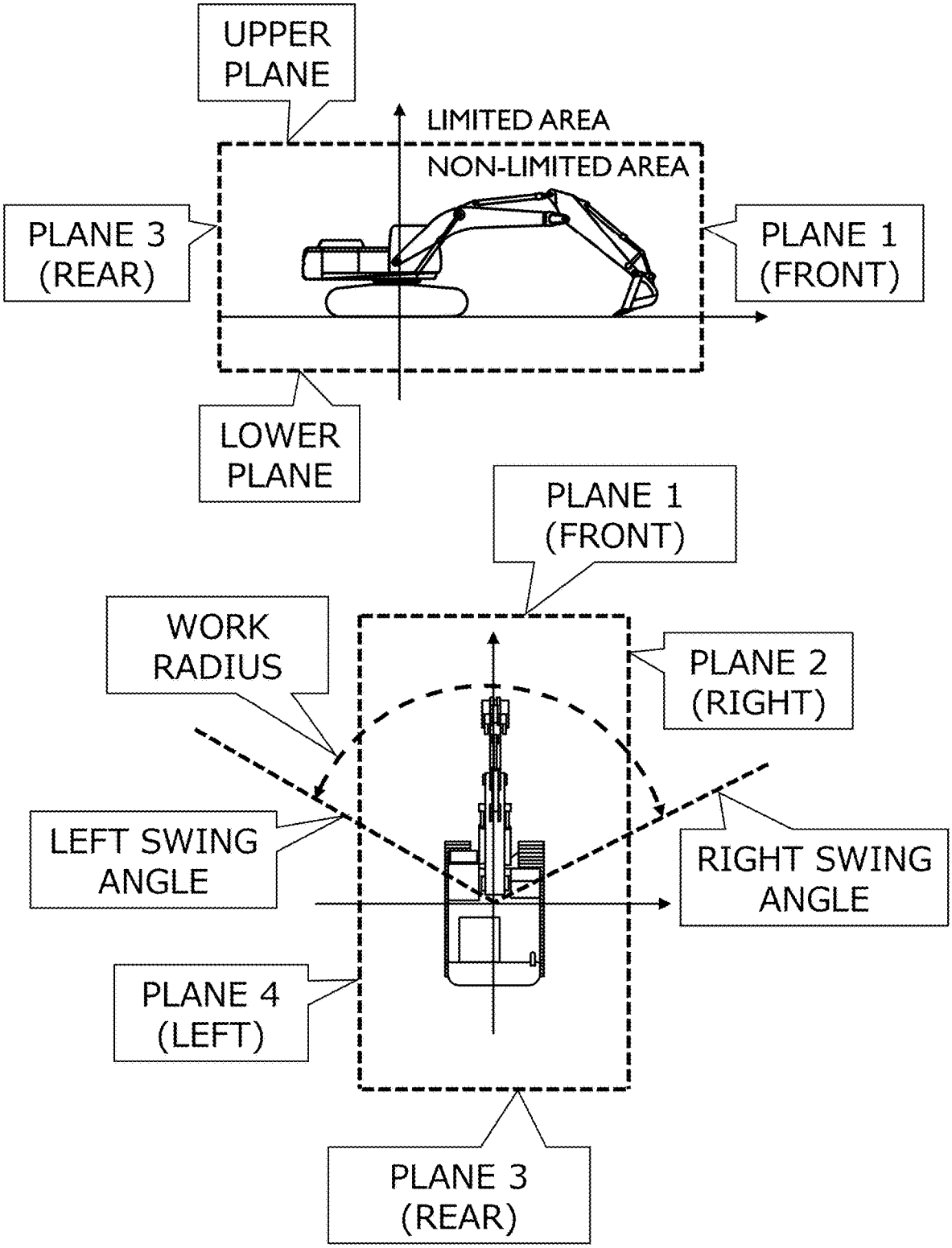
FIG. 6 is a diagram illustrating an example of limited areas.

An example of limited areas will be described with reference to FIG. 6. As illustrated in FIG. 6, a limited area is, for example, set as an area outside a rectangular parallelepipedic space enclosed by six planes, that is, an upper plane, a lower plane, a front plane, a right plane, a rear plane, and a left plane. In the following, such a limited area will be defined as a polygonal area. In addition, a limited area is set as an area outside a space enclosed by an upper plane, a lower plane, and the surfaces of a columnar body having a sectorial bottom surface defined by a work radius, a left swing angle, and a right swing angle. In the following, such a limited area will be defined as a cylindrical area.

In the present embodiment, hereinafter, description will be made with focus placed particularly on limited areas in the forward-rearward direction and the left-right direction of the machine body in the "polygonal area." In the following, the front plane as a limited area boundary on the front side of the lower track structure 1 (plane forming the limited area in the forward direction of the machine body) will also be described as a "plane 1 (front)," the right plane as a limited area boundary on the right side of the lower track structure 1 (plane forming the limited area in the right direction of the machine body) will also be described as a "plane 2 (right)," the rear plane as a limited area boundary on the rear side of the lower track structure 1 (plane forming the limited area in the rearward direction of the machine body) will also be described as a "plane 3 (rear)," and the left plane as a limited area boundary on the left side of the lower track structure 1 (plane forming the limited area in the left direction of the machine body) will also be described as a "plane 4 (left)." Incidentally, in the "polygonal area," the "plane 1 (front)," the "plane 2 (right)," the "plane 3 (rear)," and the "plane 4 (left)" do not necessarily need to be closed in a rectangular shape, and the polygonal area is an area formed by a maximum of four planes.

The limited areas are set by the main controller 11. When a plurality of planes as limited area boundaries are set, the main controller 11 sets areas outside an area enclosed by each plane as limited areas.

(Functions Representing Respective Limited Area Boundaries and Function Parameters)

Description will next be made of functions (equations) representing limited area boundaries in the distance computing section 39 and function parameters (numerical values) transmitted from the area setting section 38.

(Limited Areas Above and Below Machine Body)

The upper plane forming a limited area in the upward direction of the hydraulic excavator 100 (limited area boundary on the upper side of the machine body) and the lower plane forming a limited area in the downward direction of the hydraulic excavator 100 (limited area boundary on the lower side of the machine body) are defined as planes parallel with an XY plane.

A function representing the upper plane as the limited area boundary on the upper side of the machine body is expressed by the following equation.

$$z = Vu\mathrm{PosZ}$$

A function representing the lower plane as the limited area boundary on the lower side of the machine body is expressed by the following equation.

$$z = Vd\mathrm{PosZ}$$

Here, VuPosZ and VdPosZ are scalars having a unit of m (meters), and are transmitted as function parameters of values in units of 0.1 m from the area setting section 38 to the distance computing section 39.

(Limited Areas Forward, Rearward, Leftward, and Rightward of Machine Body)

The "plane 1 (front)," the "plane 2 (right)," the "plane 3 (rear)," and the "plane 4 (left)" are defined as planes perpendicular to the XY plane (that is, planes parallel with the vertical direction).

A function representing the "plane 1 (front)" is expressed by the following equation.

$$(V1\mathrm{Pos}X2 - V1\mathrm{Pos}X1)(y - V1\mathrm{Pos}Y1) = (V1\mathrm{Pos}Y2 - V1\mathrm{Pos}Y1)(x - V1\mathrm{Pos}X1)$$

A function representing the "plane 2 (right)" is expressed by the following equation.

$$(V2\mathrm{Pos}X2 - V2\mathrm{Pos}X1)(y - V2\mathrm{Pos}Y1) = (V2\mathrm{Pos}Y2 - V2\mathrm{Pos}Y1)(x - V2\mathrm{Pos}X1)$$

A function representing the "plane 3 (rear)" is expressed by the following equation.

$$(V3PosX2-V3PosX1)(y-V3PosY1)=(V3PosY2-V3PosY1)(x-V3PosX1)$$

A function representing the "plane 4 (left)" is expressed by the following equation.

$$(V4PosX2-V4PosX1)(y-V4PosY1)=(V4PosY2-V4PosY1)(x-V4PosX1)$$

Here, V1PosX1, V1PosX2, V1PosY1, V1PosY2, V2PosX1, V2PosX2, V2PosY1, V2PosY2, V3PosX1, V3PosX2, V3PosY1, V3PosY2, V4PosX1, V4PosX2, V4PosY1, and V4PosY2 are scalars having a unit of m (meters), and are transmitted as function parameters of values in units of 0.001 m from the area setting section 38 to the distance computing section 39.

Figure 7:
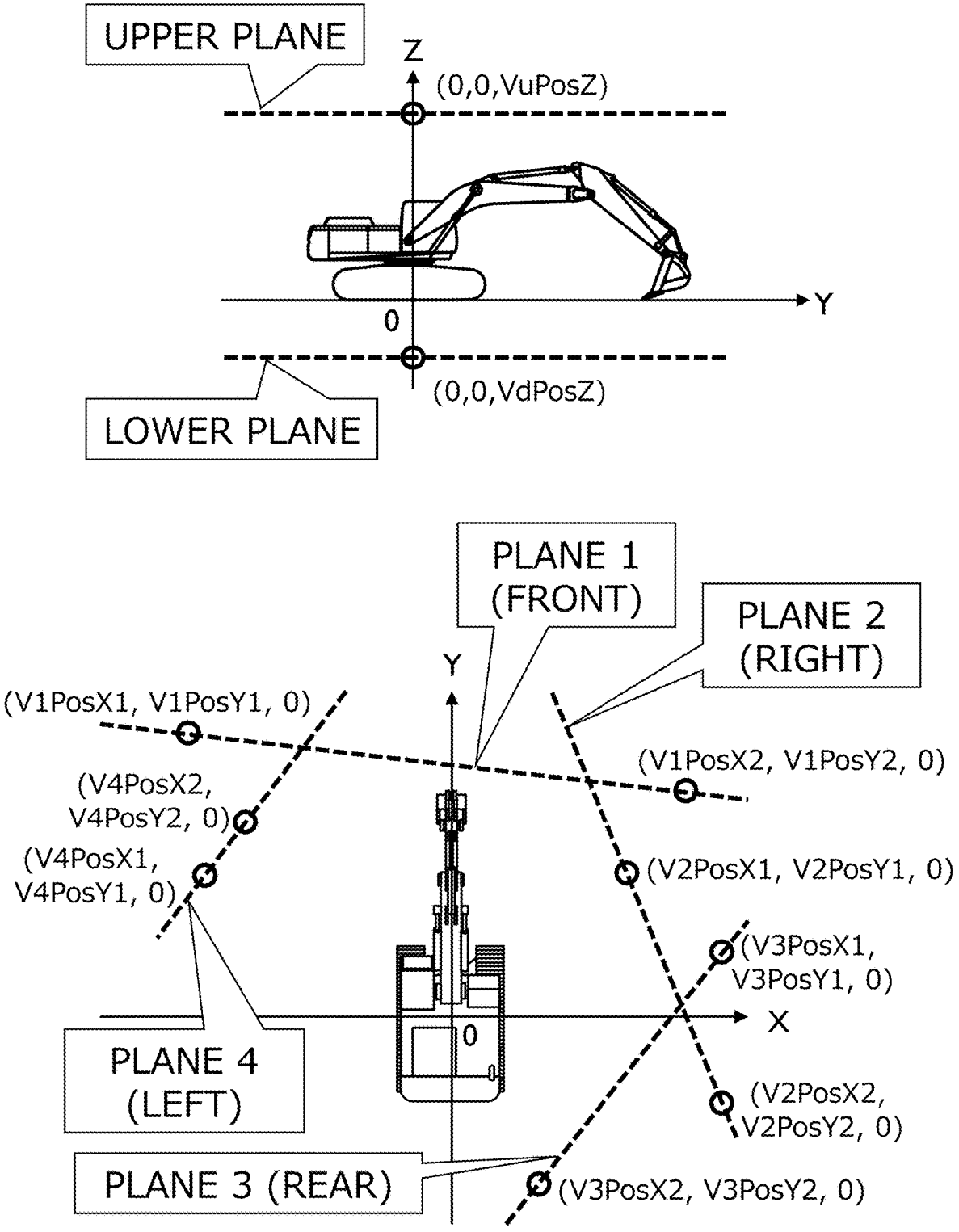
FIG. 7 is a diagram illustrating an example in a case where limited areas are set in a "polygonal area."

FIG. 7 is a diagram illustrating an example in a case where limited areas are set in the "polygonal area." Incidentally, in FIG. 7, the coordinates of coordinate points representing the positions of limited area boundaries (planes forming the limited areas) are expressed by (X, Y, Z). As illustrated in FIG. 7, in the "polygonal area," the "plane 1 (front)," the "plane 2 (right)," the "plane 3 (rear)," and the "plane 4 (left)" do not necessarily need to be closed in a rectangular shape. When each plane is set as illustrated in FIG. 7, an area clockwise from the left front of the machine body to the right rear of the machine body is limited by the limited areas formed by the four planes, whereas an area in the left rear of the machine body is not limited.

(Coordinates of Coordinate Points Specifying Respective Limited Area Boundaries and Coordinate Transformation into Function Parameters)

Description will next be made of the "coordinates of each coordinate point specifying the limited area boundary," which are transmitted from the monitor controller 14 to the main controller 11.

As described earlier, information regarding two coordinate points is necessary for each of planes forming a limited area which are arranged forward, rearward, leftward, and rightward of the machine body. Hence, in order to set the limited area, information regarding a total of eight coordinate points is necessary for four planes forming the limited areas.

The operator needs to determine in which position the limited area is to be disposed. The operator performs numerical value input by operating the switch box 13 while viewing the screen of the display device 5. A numerical value is thereby set in the monitor controller 14.

In the present embodiment, in consideration of convenience at a time when the operator inputs a coordinate point, information input by the operator is a distance r from the origin O and an angle θ from the angle reference line L0 in the cylindrical coordinate system rather than the X-coordinate and the Y-coordinate of the coordinate point. When the operator performs work by the hydraulic excavator 100, the operator operates the hydraulic excavator 100 while taking heed of the work radius of the front work implement 3 (distance from the swing center to a distal end of the front work implement) and the swing angle. Hence, inputting the distance and the angle is easier for the operator to understand, when the position of the limited area is to be input.

Figure 8:
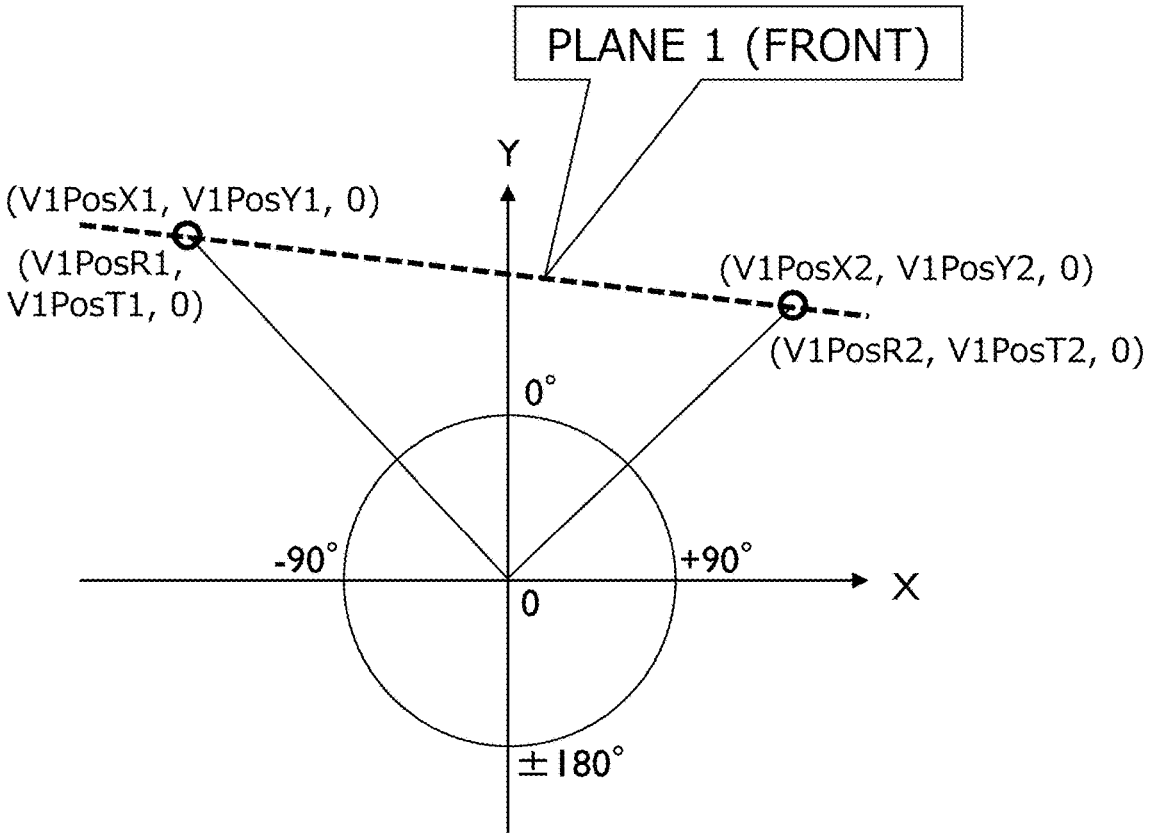
FIG. 8 is a diagram extracting only a "plane 1 (front)" of the limited areas illustrated in FIG. 7.

FIG. 8 is a diagram extracting only the "plane 1 (front)" of the limited areas illustrated in FIG. 7. Two coordinate points for specifying the position of the "plane 1 (front)" as a limited area boundary are expressed as follows in the rectangular coordinate system.

$$\text{First Point}(x,y)=(V1PosX1,V1PosY1)$$

$$\text{Second Point}(x,y)=(V1PosX2,V1PosY2)$$

In addition, the positions of the same coordinate points are expressed as follows in the cylindrical coordinate system.

$$\text{First Point}(r,\theta)=(V1PosR1,V1PosT1)$$

$$\text{Second Point}(r,\theta)=(V1PosR2,V1PosT2)$$

Here, V1PosR1 and V1PosR2 are scalars having a unit of m (meters), and are transmitted as values in units of 0.1 m from the monitor controller 14 to the area setting section 38 of the main controller 11. In addition, V1PosT1 and V1PosT2 are scalars having a unit of ° (degrees), and are transmitted as values in units of 1° from the monitor controller 14 to the area setting section 38 of the main controller 11.

Similarly, two coordinate points for specifying the position of the "plane 2 (right)" as a limited area boundary are expressed as follows in the cylindrical coordinate system.

$$\text{First Point}(r,\theta)=(V2PosR1,V2PosT1)$$

$$\text{Second Point}(r,\theta)=(V2PosR2,V2PosT2)$$

Similarly, two coordinate points for specifying the position of the "plane 3 (rear)" as a limited area boundary are expressed as follows in the cylindrical coordinate system.

$$\text{First Point}(r,\theta)=(V3PosR1,V3PosT1)$$

$$\text{Second Point}(r,\theta)=(V3PosR2,V3PosT2)$$

Similarly, two coordinate points for specifying the position of the "plane 4 (left)" as a limited area boundary are expressed as follows in the cylindrical coordinate system.

$$\text{First Point}(r,\theta)=(V4PosR1,V4PosT1)$$

$$\text{Second Point}(r,\theta)=(V4PosR2,V4PosT2)$$

Thus, each plane forming a limited area is expressed by coordinate points (position specifying information) in the cylindrical coordinate system.

(Transformation from Coordinates in Cylindrical Coordinate System to Function Parameters in Rectangular Coordinate System)

Coordinate transformation between the rectangular coordinate system and the cylindrical coordinate system can be performed by calculation. For example, the two coordinate points related to the "plane 1 (front)" can be transformed by the following equation.

$$V1PosX1=V1PosR1\cdot\sin(V1PosT1\times\pi/180)$$

$$V1PosY1=V1PosR1\cdot\cos(V1PosT1\times\pi/180)$$

$$V1PosX2=V1PosR2\cdot\sin(V1PosT2\times\pi/180)$$

$$V1PosY2=V1PosR2\cdot\cos(V1PosT2\times\pi/180)$$

Incidentally, coordinate transformation of the coordinate points representing the positions of the "plane 2 (right)," the "plane 3 (rear)," and the "plane 4 (left)" can also be performed by calculation as with the "plane 1 (front)." The area setting section 38 performs the above-described coordinate transformation, and outputs the function parameters representing the limited area boundaries to the distance computing section 39.

(Area Limiting Function Setting Menu Configuration)

Figure 9:
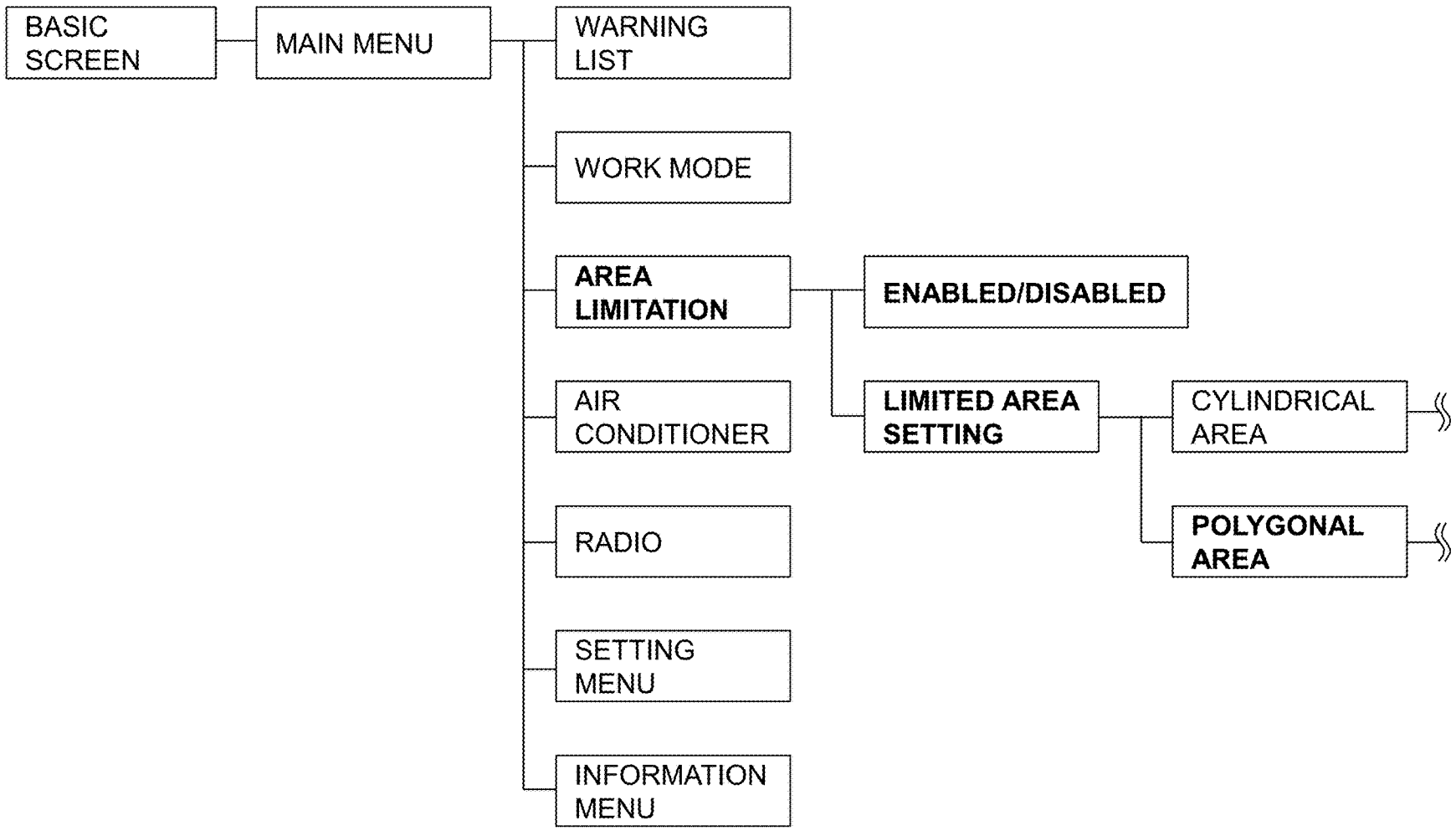
FIG. 9 is a diagram illustrating the hierarchy of a monitor menu related to an area limiting function enabling/disabling procedure.

FIG. 9 is a diagram illustrating the hierarchy of a monitor menu related to an area limiting function enabling/disabling procedure. When the selection/determination switch 33 is depressed in a state in which the basic screen is displayed on the display device 5, the screen of the display device 5 makes a transition to a main menu screen that displays a list of monitor function items. The items displayed on the main menu screen include, for example, such items as a "warning list" and a "work mode." When the "warning list" is selected, the screen makes a transition to a warning list screen that makes it possible to check warning information currently generated in the hydraulic excavator 100 (for example, a charge warning displayed when an amount of electric power generation of an alternator is low and the like). When the "work mode" is selected, the screen makes a transition to a work mode setting change screen for using a breaker or a crusher.

The items displayed on the main menu screen include such an item as "area limitation" for making a transition to a screen for changing settings related to the area limiting function. The screen makes a transition to an area limitation screen when the operator selects the item "area limitation" by rotating the selection/determination switch 33, and depresses the selection/determination switch 33 in that state.

The area limitation screen displays two items "enabled/disabled" and "limited area setting." When the operator depresses the selection/determination switch 33 in a state in which "enabled/disabled" is selected, the screen makes a transition to an enabling/disabling switching screen for switching between the enabling and disabling of the area limiting function. When the operator depresses the selection/determination switch 33 in a state in which the "limited area setting" is selected, a transition is made to a screen for specifying a kind of shape of a limited area boundary and the position of a limited area as a screen for setting the limited area.

The "cylindrical area" and the "polygonal area" described earlier can be selected as the shape of a limited area. However, the description of the present embodiment will be made with focus placed on the "polygonal area," and the description will be made with focus placed particularly on limited areas forward, rearward, leftward, and rightward of the machine body in the polygonal area.

(Switching Between Enabling and Disabling of Area Limiting Function)

Figure 10:
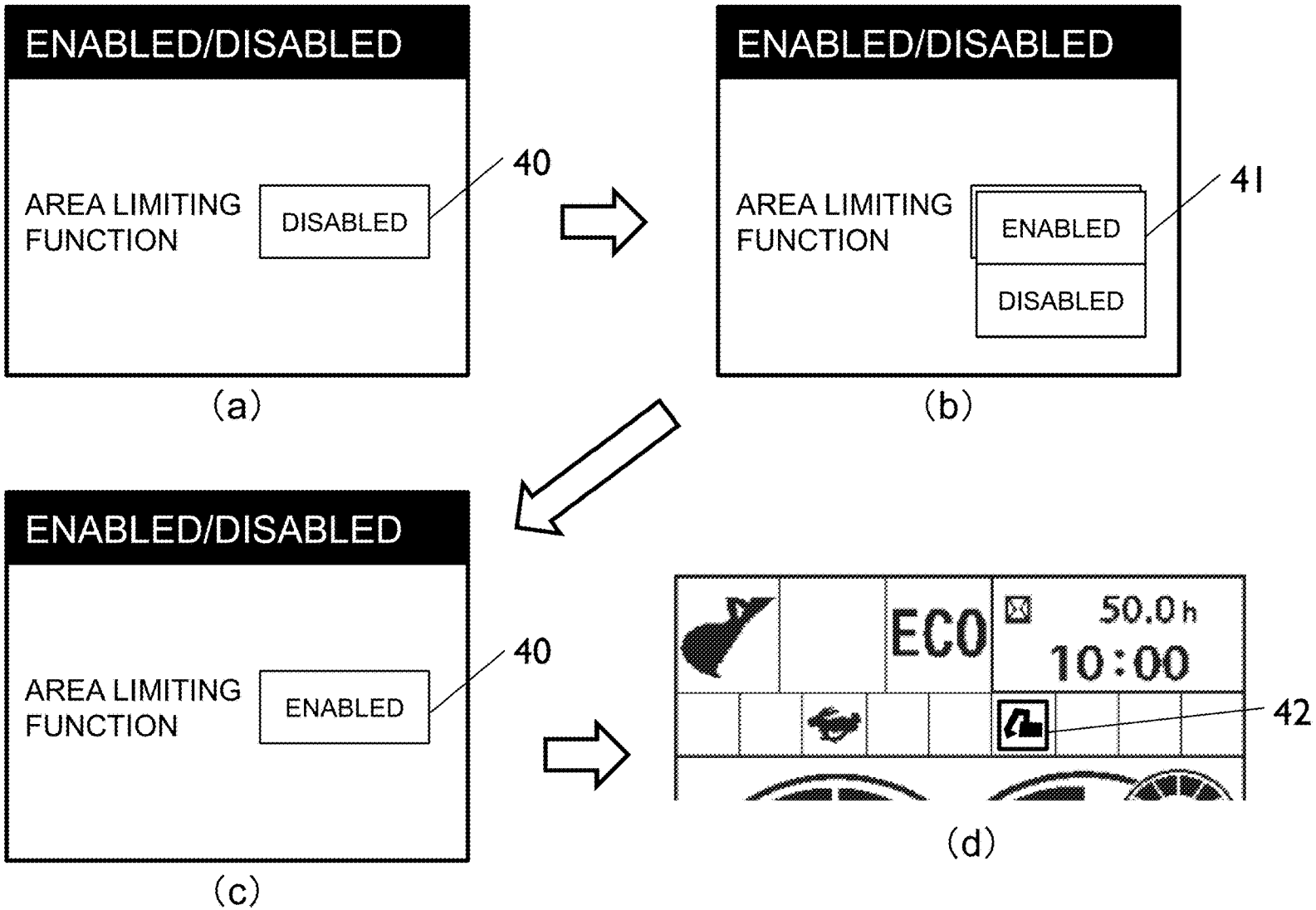
FIG. 10 depicts diagrams illustrating an example of an enabling/disabling switching screen for the area limiting function.

FIG. 10 depicts diagrams illustrating an example of the enabling/disabling switching screen for the area limiting function. The monitor controller 14 sets the area limiting function in an enabled or disabled state on the basis of the input information input from the switch box 13. When a transition is made from the main menu screen to the enabling/disabling switching screen of the "area limitation," a screen of FIG. 10(*a*) is displayed. The area limiting function is disabled in an initial setting at a time of a start of the engine.

When the area limiting function is disabled, as illustrated in FIG. 10(*a*), "disabled" is displayed in a display region 40 as display indicating the current enabled/disabled state of the area limiting function. When the operator moves a cursor to the display region 40 by rotating the selection/determination switch 33 and depresses the selection/determination switch 33, a selection screen 41 is displayed, as illustrated in FIG. 10(*b*).

When the operator selects "enabled" by rotating the selection/determination switch 33 in this state and depresses the selection/determination switch 33, the monitor controller 14 sets the area limiting function in an enabled state. Consequently, as illustrated in FIG. 10(*c*), the display of the display region 40 is switched to "enabled."

When the area limiting function is in an enabled state, the monitor controller 14 displays an enabled state icon 42 indicating that the area limiting function is in an enabled state on the basic screen of the display device 5, as illustrated in FIG. 10(*d*), in order to notify the operator of the state.

The monitor controller 14 transmits the enabled or disabled state of the area limitation as a CAN signal to the main controller 11. Here, suppose that the value of the enabled/disabled state is a numerical value of 0 or 1, and suppose that the value is 0 at a time of a disabled state and is 1 at a time of an enabled state.

(Selection of Limited Area from Plurality of Different Shapes)

Figure 11:
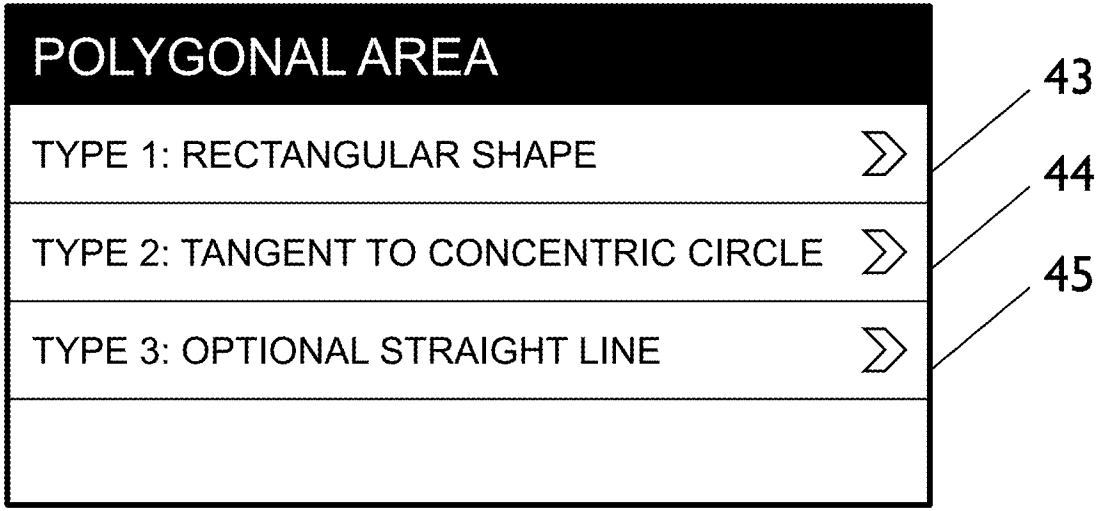
FIG. 11 is a diagram illustrating an example of a limited area selection screen.

FIG. 11 is a diagram illustrating an example of the limited area selection screen. The limited area selection screen is a screen for prompting the operator to select a kind of shape of a limited area boundary. This limited area selection screen is displayed when the "polygonal area" is selected from the "area limitation setting" in the hierarchy of the monitor menu illustrated in FIG. 9. As illustrated in FIG. 11, the limited area selection screen displays a type 1 selection switch 43, a type 2 selection switch 44, and a type 3 selection switch 45 for selecting one from among a plurality of different kinds of shapes of limited area boundaries. The operator selects one of the switches (43 to 45) by rotating the selection/determination switch 33 according to the shape of a limited area which the operator himself/herself intends to create, and makes a determination by pressing the selection/determination switch 33.

When the selection/determination switch 33 is pressed, the monitor controller 14 selects the kind of shape of the limited area. When the kind of shape of the limited area boundary is selected, the screen of the display device 5 makes a transition, and a value indicating the kind of shape of the limited area boundary, which is information transmitted from the monitor controller 14 to the main controller 11, is changed. Here, the kind of shape of the limited area boundary (first to third shapes) is indicated by a numerical value of 1 to 3. This numerical value is 1 when a "type 1: rectangular shape" as a first shape is selected, the numerical value is 2 when a "type 2: tangent to a concentric circle" as a second shape is selected, and the numerical value is 3 when a "type 3: optional straight line" as a third shape is selected. When the kind of shape of the limited area boundary is selected, the monitor controller 14 displays a limited area setting screen corresponding to the selected kind of shape on the display device 5. The limited area setting screen is a screen for prompting the operator to perform an operation of inputting position specifying information specifying the position of the limited area boundary.

Incidentally, when the "type 1: rectangular shape" is selected, the controller 110 sets, as a limited area boundary forward of the machine body, on the basis of the distance r, a plane that is disposed at a position separated from the origin O in a predetermined direction (for example, in the forward direction of the machine body) by the distance r and is in parallel with the vertical direction but orthogonal to the predetermined direction (for example, the forward direction of the machine body). The controller 110 similarly sets a limited area boundary also in each of the right direction of the machine body, the rearward direction of the machine body, and the left direction of the machine body. A non-limited area in a rectangular shape and a limited area outside the non-limited area are set by the limited area boundaries being set forward, rearward, leftward, and rightward of the machine body. In addition, when the "type 2: tangent to a concentric circle" is selected, the controller 110 sets a tangent plane tangent at one coordinate point to a circular cylinder having a vertical axis passing through the origin O as a central axis, as a limited area boundary, on the basis of information regarding the above-described one coordinate point. A non-limited area in a polygonal shape and a limited area outside the non-limited area are set by a plurality of limited area boundaries being set. When the "type 3: optional straight line" is selected, the controller 110 sets an optional plane passing through two coordinate points and parallel with the vertical direction, as a limited area boundary, on the basis of information regarding the two coordinate points. A non-limited area in a polygonal shape and a limited area outside the non-limited area are set by a plurality of limited area boundaries being set. In the following, detailed description will be made of each of area setting methods used in cases where the types 1 to 3 are selected as kinds of shapes of limited area boundaries.

Figure 12A:
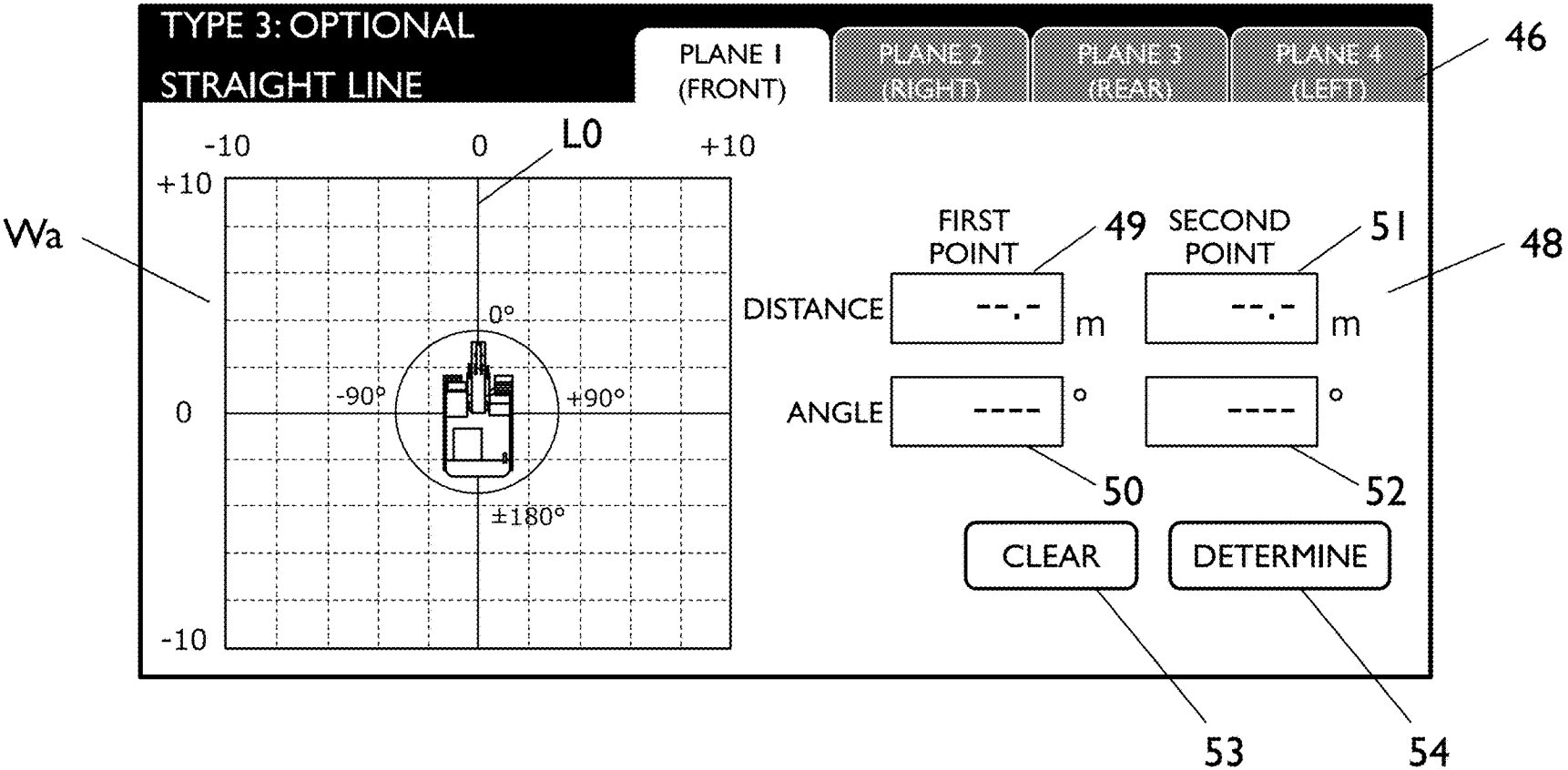
FIG. 12A is a diagram illustrating a limited area setting screen displayed when a "type 3: optional straight line" is selected on the limited area selection screen of FIG. 11, and illustrates a state in which no limited area is set (initial state).
Figure 12B:
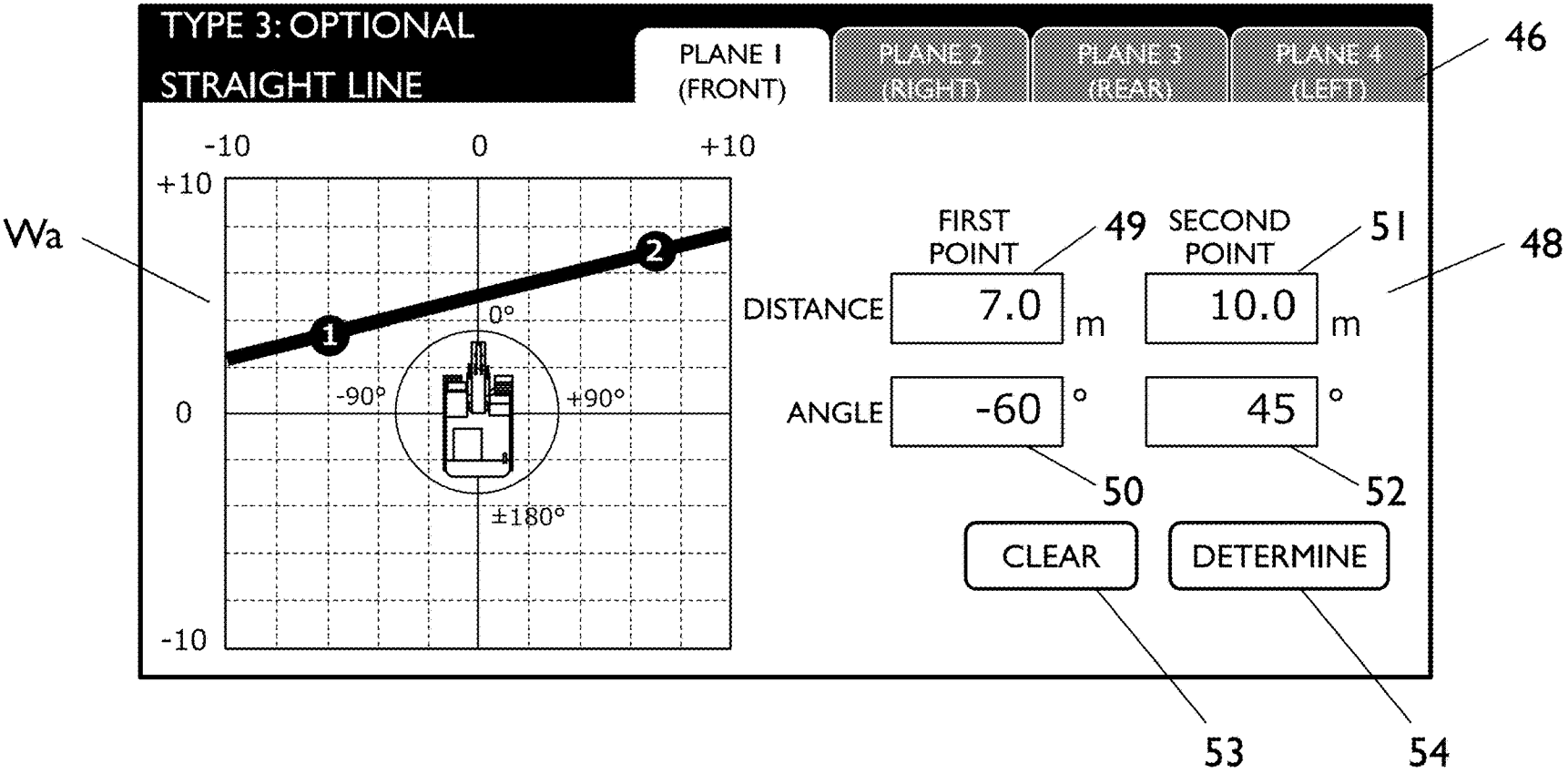
FIG. 12B is a diagram illustrating the limited area setting screen displayed when the "type 3: optional straight line" is selected on the limited area selection screen of FIG. 11, and illustrates an example of a state in which only the "plane 1 (front)" is set as a plane forming a limited area.
Figure 12C:
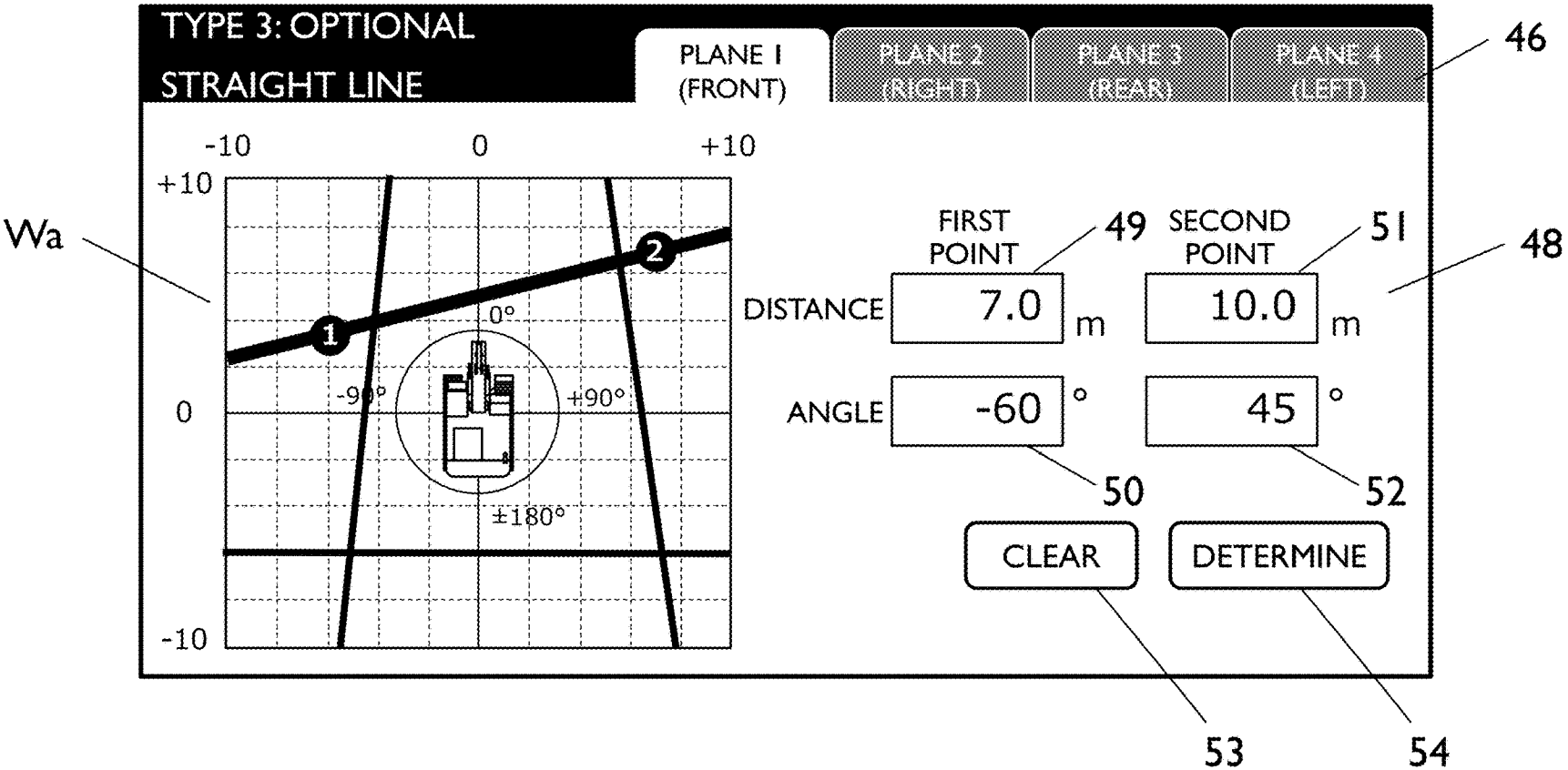
FIG. 12C is a diagram illustrating the limited area setting screen displayed when the "type 3: optional straight line" is selected on the limited area selection screen of FIG. 11, and illustrates an example of a state in which all of four planes, that is, the "plane 1 (front)," a "plane 2 (right)," a "plane 3 (rear)," and a "plane 4 (left)," are set as planes forming limited areas.

First, description will be made of an area setting method in a case where the "type 3: optional straight line" is selected as a kind of shape of a limited area boundary. FIGS. 12A to 12C are diagrams illustrating the limited area setting screen displayed when the "type 3: optional straight line" is selected on the limited area selection screen of FIG. 11. FIG. 12A illustrates an example of the limited area setting screen in a state in which no limited area is set (initial state).

As illustrated in FIG. 12A, a plurality of setting plane selection tabs 46 for selecting which limited area boundary (plane) is to be set are disposed in an upper right portion of the limited area setting screen. When the operator selects the tab of a plane that is to be set, by rotating the selection/determination switch 33, and depresses the selection/determination switch 33, a screen (limited area setting screen) for specifying the position of the plane appears. FIG. 12A illustrates a screen for specifying the position of the "plane 1 (front)" of a limited area. The "plane 1 (front)" tab and other tabs are displayed in different colors, so that the operator easily recognizes the tab being selected.

A work area diagram Wa as a diagram indicating the position of a plane forming a currently set limited area is disposed on the left side of the screen. The operator can thus visually recognize the currently set limited area. The work area diagram Wa schematically represents a space viewed from an upward direction of the machine body. The work area diagram Wa displays an illustration of the hydraulic excavator 100 which indicates the orientation of the hydraulic excavator 100 (upper swing structure 2 in particular), numerical values representing distances in the XY direction, numerical values representing angles from the angle reference line L0 (forward direction of the lower track structure), and graduation lines serving as a guide for distance.

As will be described later, when the limited area is set, a straight line corresponding to the position of the limited area is displayed in the work area diagram Wa. Incidentally, while a display range of the work area diagram Wa is a 20 m range of −10 m to +10 m in both the X-direction and the Y-direction in FIG. 12A, the display range is not limited to this. The display range of the work area diagram Wa may be changed according to a vehicle class of the hydraulic excavator 100 (size of the machine body), or may be allowed to be enlarged or reduced freely by the operator through switch operation of the numeric keys 34 or the like.

A numerical value input field 48 for the operator to specify the position of the plane of the limited area is disposed on the right side of the screen. When the kind of shape of the limited area boundary is the "type 3: optional straight line," the numerical value input field 48 displays a first distance input cell 49, a first angle input cell 50, a second distance input cell 51, and a second angle input cell 52.

When the operator moves the cursor to the first distance input cell 49 by rotating the selection/determination switch 33 and depresses the selection/determination switch 33, the first distance input cell 49 is set in a numerical value input waiting state. A numerical value can be input (numerical value can be changed) by rotating the selection/determination switch 33 or pressing numerical buttons of the numeric keys 34 while the first distance input cell 49 is in the numerical value input waiting state. Incidentally, a dedicated button may be added to the buttons of the numeric keys 34 for correction and erasure of the value at this time, or a long depression of a specific button (for example, a number 0 key) or the like may be assigned these functions.

A limitation may be imposed on the range of values that can be input by the operator. For example, even if 100 m is input as a distance from the origin O to the limited area, the limited area is so distant from the hydraulic excavator 100 that the role of the area limiting function is not performed. When an upper limit of the range of manual input by the operator is, for example, set in a practical range such as 15 m, in which the area limiting function can be utilized, a range setting can be made easy for the operator to understand.

When the operator depresses the selection/determination switch 33 in a state in which the numerical value of a distance desired to be set is set, the value of the first distance input cell 49 is determined. The operator similarly inputs a numerical value also to the first angle input cell 50, the second distance input cell 51, and the second angle input cell 52 by a similar procedure. However, an operation of setting the plane of the limited area is not yet completed in this stage.

An area clear switch 53 and an area determination switch 54 are arranged in a lower right portion of the screen. The operation of setting the plane of the limited area is completed when the operator moves the cursor to the area determination switch 54 by rotating the selection/determination switch 33 and depresses the selection/determination switch 33 in a state in which numerical values are input to all of the first distance input cell 49, the first angle input cell 50, the second distance input cell 51, and the second angle input cell 52. However, the area determination switch 54 cannot be pressed when information regarding the first coordinate point (the distance r and the angle θ) and information regarding the second coordinate point (the distance r and the angle θ) are the same.

When the operator depresses the selection/determination switch 33 in a state in which the cursor is moved to the area clear switch 53, the setting of the plane of the currently set limited area is cleared. As a result, a return is made to a state in which a work area is not limited (with regard to the plane).

Incidentally, as illustrated in FIG. 3, the monitor controller 14 transmits information regarding the coordinates of each coordinate point specifying the limited area boundary to the main controller 11. When the operation of setting the plane of the limited area by the operator is completed, the monitor controller 14 updates the information regarding the coordinates of each coordinate point specifying the limited area boundary, and transmits the information to the main controller 11. The main controller 11 computes function parameters representing the limited area boundary, on the basis of the input information, and sets the limited area.

When the operation of setting the plane of the limited area by the operator is completed, display of a straight line indicating the position of the limited area is added to the work area diagram Wa illustrated in FIG. 12A. In the present embodiment, the function and the function parameters representing the limited area boundary which are computed by the main controller 11 are input to the monitor controller 14, and the monitor controller 14 displays the straight line representing the limited area boundary on the display screen of the display device 5, on the basis of the input function and the input function parameters.

Description in association with the variable names used in the description of FIG. 8 is as follows. When a setting operation for the "plane 1 (front)" is performed, the monitor controller 14 sets V1PosR1 as a value input to the first distance input cell 49, sets V1PosT1 as a value input to the first angle input cell 50, sets V1PosR2 as a value input to the second distance input cell 51, and sets V1PosT2 as a value input to the second angle input cell 52.

When a setting operation for the "plane 2 (right)" is performed, the monitor controller 14 sets V2PosR1 as a value input to the first distance input cell 49, sets V2PosT1 as a value input to the first angle input cell 50, sets V2PosR2 as a value input to the second distance input cell 51, and sets V2PosT2 as a value input to the second angle input cell 52.

When a setting operation for the "plane 3 (rear)" is performed, the monitor controller 14 sets V3PosR1 as a value input to the first distance input cell 49, sets V3PosT1 as a value input to the first angle input cell 50, sets V3PosR2 as a value input to the second distance input cell 51, and sets V3PosT2 as a value input to the second angle input cell 52.

When a setting operation for the "plane 4 (left)" is performed, the monitor controller 14 sets V4PosR1 as a value input to the first distance input cell 49, sets V4PosT1 as a value input to the first angle input cell 50, sets V4PosR2 as a value input to the second distance input cell 51, and sets V4PosT2 as a value input to the second angle input cell 52.

The monitor controller 14 transmits these pieces of position specifying information (V1PosR1, V1PosT1, V1PosR2, V1PosT2, V2PosR1, V2PosT1, V2PosR2, V2PosT2, V3PosR1, V3PosT1, V3PosR2, V3PosT2, V4PosR1, V4PosT1, V4PosR2, and V4PosT2) to the main controller 11. In addition, the monitor controller 14 transmits information regarding the presence or absence of a setting of each limited area to the main controller 11. When the operation of setting the plane of the limited area by the operator is completed, the monitor controller 14 updates the transmission information regarding the presence or absence of a setting of the corresponding limited area.

Here, the information regarding the presence or absence of a setting of the limited area boundary (plane forming the limited area) is a numerical value of 0 or 1. Suppose that the numerical value of the presence or absence of a setting of the limited area boundary is 0 when the limited area boundary is not set (when the limited area boundary is cleared) and that the numerical value is 1 when the limited area boundary is set. Assuming that only the "plane 1 (front)" is set as the limited area boundary (plane forming the limited area), the value of the presence or absence of a setting of the "plane 1 (front)" is "1," and the values of the presence or absence of settings of the "plane 2 (right)," the "plane 3 (rear)," and the "plane 4 (left)" are "0."

FIG. 12B is a diagram illustrating an example of the limited area setting screen in a state in which only the "plane 1 (front)" is set as a plane forming a limited area. In the present example, "7.0" m is input to the first distance input cell 49, "−60"° is input to the first angle input cell 50, "10.0" m is input to the second distance input cell 51, and "45"° is input to the second angle input cell 52. Hence, the "plane 1 (front)" forming the limited area forward of the machine body is represented by a straight line passing through the two points. In the work area diagram Wa, the straight line indicating the position of the limited area, figures (circles) representing the two coordinate points, and numerical values (1 and 2) for distinguishing the first point and the second point from each other are displayed in a superimposed manner.

FIG. 12C is a diagram illustrating an example of the limited area setting screen in a state in which all of the four planes, that is, the "plane 1 (front)," the "plane 2 (right)," the "plane 3 (rear)," and the "plane 4 (left)," are set as planes forming limited areas. This diagram displays the limited area setting screen of the "plane 1 (front)" after the four planes of the limited areas are set. At this time, the work area diagram Wa displays four straight lines indicating the positions of the planes forming the four limited areas. In addition, in the work area diagram Wa, the straight line corresponding to the "plane 1 (front)" currently being selected is displayed by a thick line as compared with the three other straight lines. In addition, with regard to the display of figures (circles) representing two coordinate points and numerical values (1 and 2) for distinguishing the first point and the second point from each other, only the figures and the numerical values corresponding to the "plane 1 (front)" currently being selected are displayed.

Displaying the information corresponding to the limited area plane currently being selected in an emphasized manner as described above makes it easy for the operator to recognize which plane is being set by himself/herself, thus making it possible to improve the usability of the area limiting function.

Figure 13A:
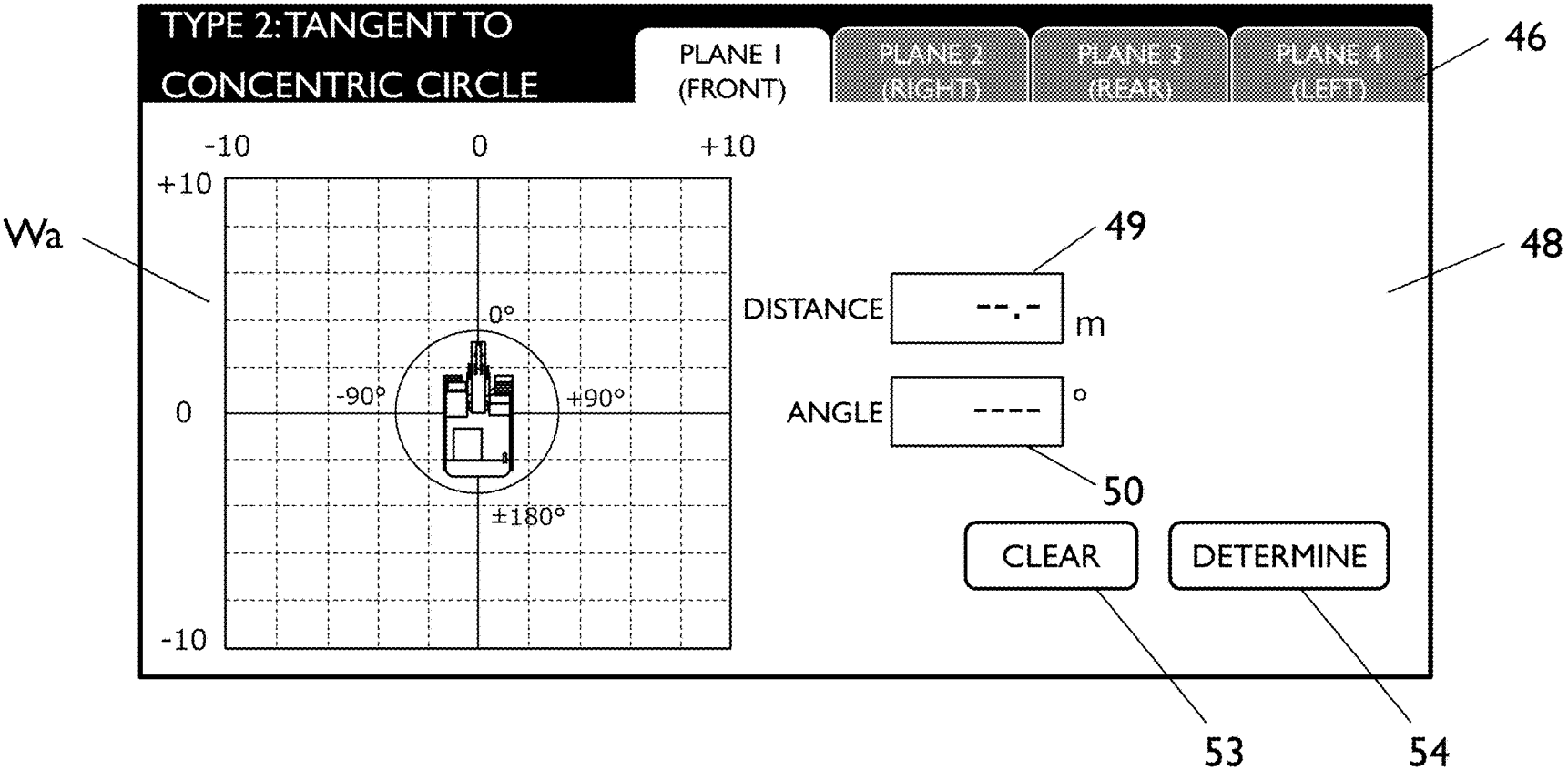
FIG. 13A is a diagram illustrating the limited area setting screen displayed when a "type 2: tangent to a concentric circle" is selected on the limited area selection screen of FIG. 11, and illustrates a state in which no limited area is set (initial state).
Figure 13B:
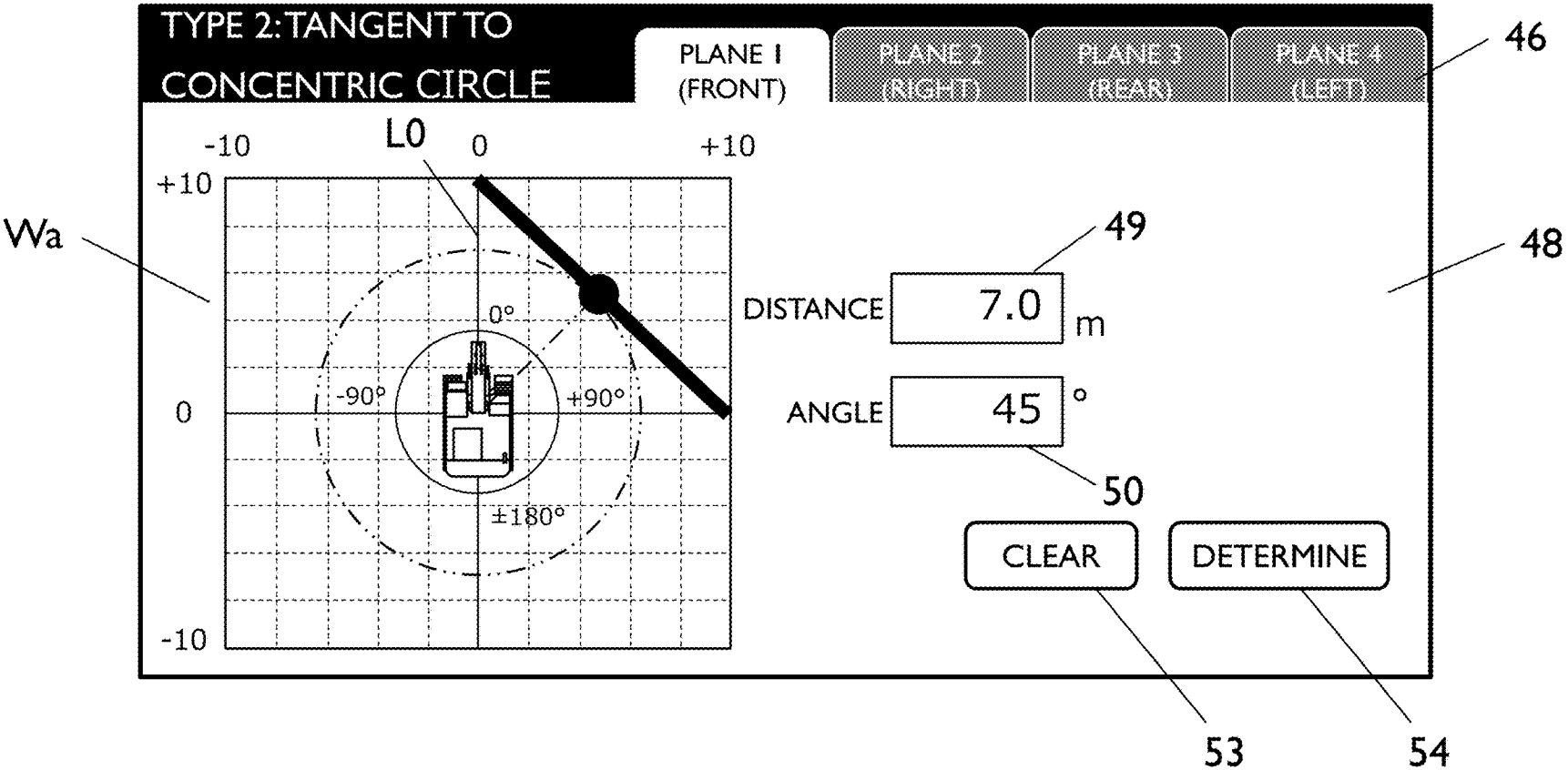
FIG. 13B is a diagram illustrating the limited area setting screen displayed when the "type 2: tangent to a concentric circle" is selected on the limited area selection screen of FIG. 11, and illustrates an example of a state in which only the "plane 1 (front)" is set as a plane forming a limited area.
Figure 13C:
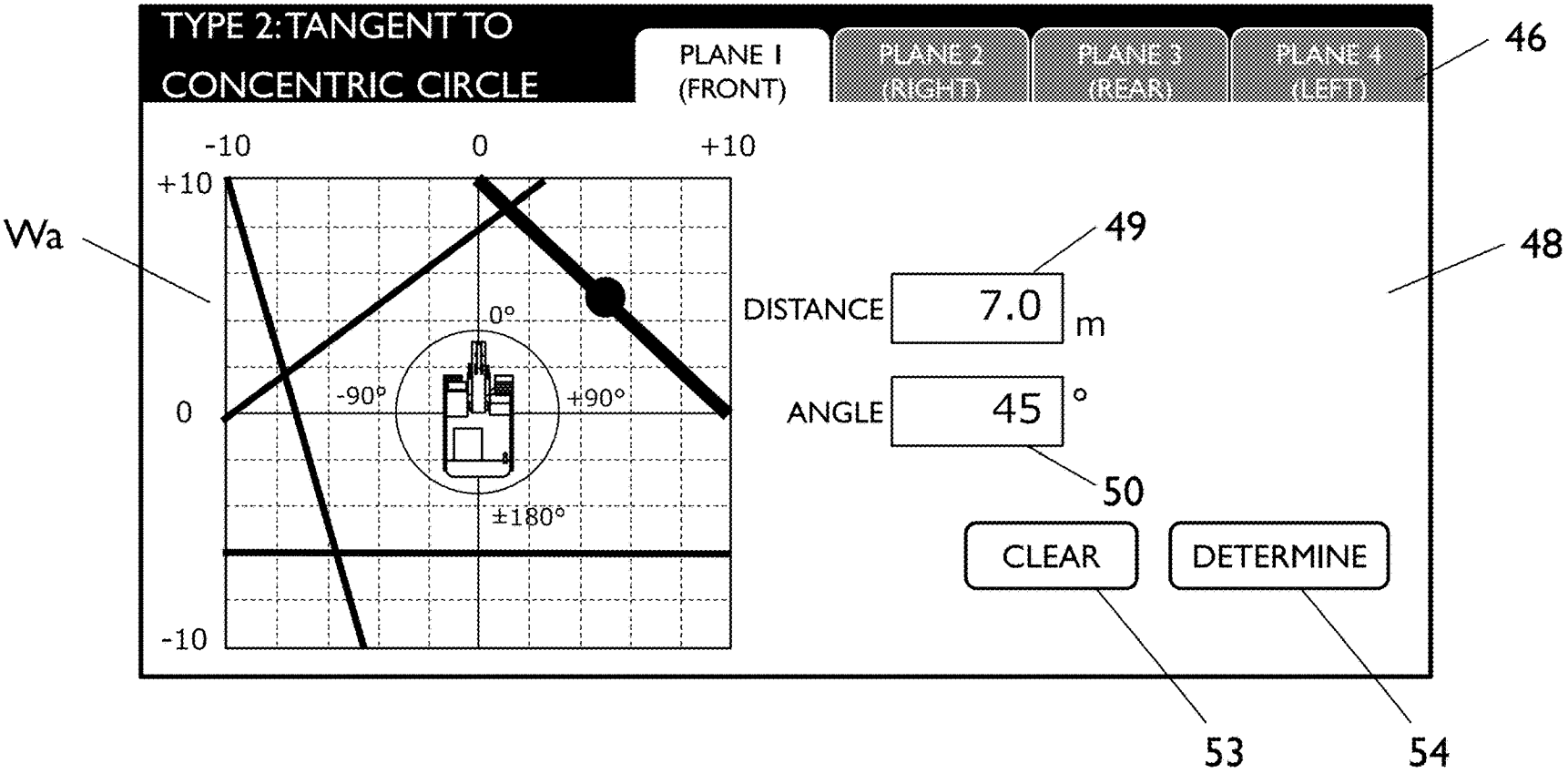
FIG. 13C is a diagram illustrating the limited area setting screen displayed when the "type 2: tangent to a concentric circle" is selected on the limited area selection screen of FIG. 11, and illustrates an example of a state in which all of the four planes, that is, the "plane 1 (front)," the "plane 2 (right)," the "plane 3 (rear)," and the "plane 4 (left)," are set as planes forming limited areas.

Next, description will be made of an area setting method in a case where the "type 2: tangent to a concentric circle" is selected as a kind of shape of a limited area boundary. FIGS. 13A to 13C are diagrams illustrating the limited area setting screen displayed when the "type 2: tangent to a concentric circle" is selected on the limited area selection screen of FIG. 11. FIG. 13A illustrates an example of the limited area setting screen in a state in which no limited area is set (initial state).

When the "type 2: tangent to a concentric circle" is selected as illustrated in FIG. 13A, the display contents of the numerical value input field 48 differ as compared with the screen at a time of selection of the "type 3: optional straight line" in FIG. 12A, and only the first distance input cell 49 and the first angle input cell 50 are displayed on the limited area setting screen.

A limited area forward of the machine body is determined when the operator presses the area determination switch 54 after inputting numerical values to the first distance input cell 49 and the first angle input cell 50. In the case of the "type 2: tangent to a concentric circle," no values are input to the second distance input cell 51 and the second angle input cell 52. Hence, variables (for example, V1PosR2 and V1PosT2) representing coordinates and transmitted from the monitor controller 14 to the area setting section 38 of the main controller 11 are not updated. At this time, these variables that are not updated are assumed to have 0 (zero) as an initial value input thereto, and the variables are transmitted from the monitor controller 14 to the main controller 11.

FIG. 13B is a diagram illustrating an example of the limited area setting screen in a state in which only the "plane 1 (front)" is set as a plane forming a limited area. In the present example, "7.0" m is input to the first distance input cell 49, and "45"° is input to the first angle input cell 50. Accordingly, the plane forming the limited area forward of the machine body is represented by a tangent circumscribing a circle having the origin O as a center thereof and having a radius of 7 m, at a position at which an angle from the angle reference line L0 is 45°. In the work area diagram Wa, a straight line indicating the position of the limited area and a figure (circle) representing the coordinate point are displayed in a superimposed manner.

FIG. 13C is a diagram illustrating an example of the limited area setting screen in a state in which all of the four planes, that is, the "plane 1 (front)," the "plane 2 (right)," the "plane 3 (rear)," and the "plane 4 (left)," are set as planes forming limited areas. This diagram displays the limited area setting screen of the "plane 1 (front)" after the four planes of the limited areas are set. At this time, the work area diagram Wa displays four straight lines indicating the positions of the planes forming the four limited areas. In addition, in the work area diagram Wa, the straight line corresponding to the "plane 1 (front)" currently being selected is displayed by a thick line as compared with the three other straight lines. In addition, with regard to the display of figures (circles) representing coordinate points, only the figure corresponding to the "plane 1 (front)" currently being selected is displayed.

Displaying the information corresponding to the limited area plane currently being selected in an emphasized manner as described above makes it easy for the operator to recognize which plane is being set by the operator, thus making it possible to improve the usability of the area limiting function.

Figure 14A:
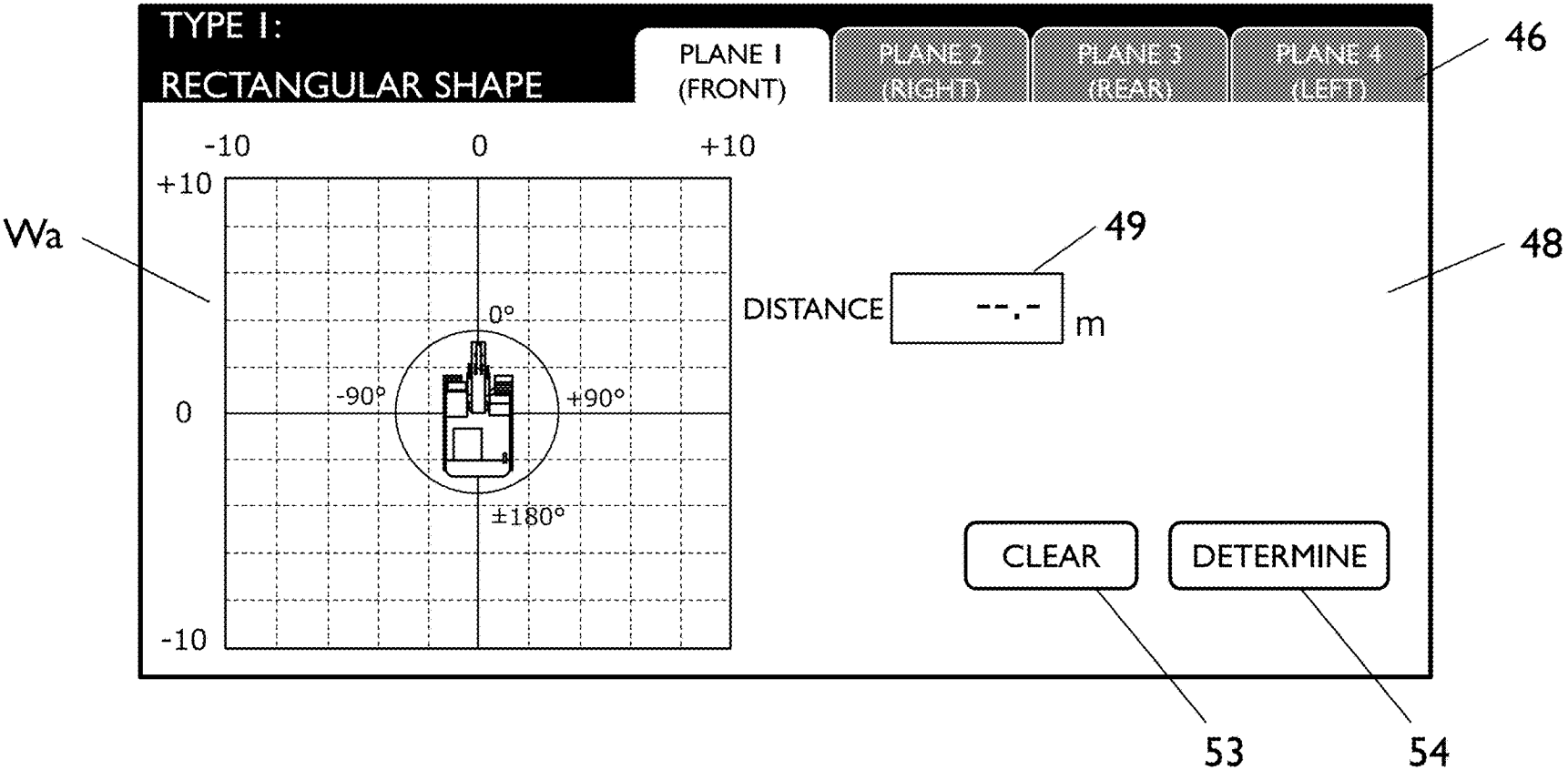
FIG. 14A is a diagram illustrating the limited area setting screen displayed when a "type 1: rectangular shape" is selected on the limited area selection screen of FIG. 11, and illustrates a state in which no limited area is set (initial state).
Figure 14B:
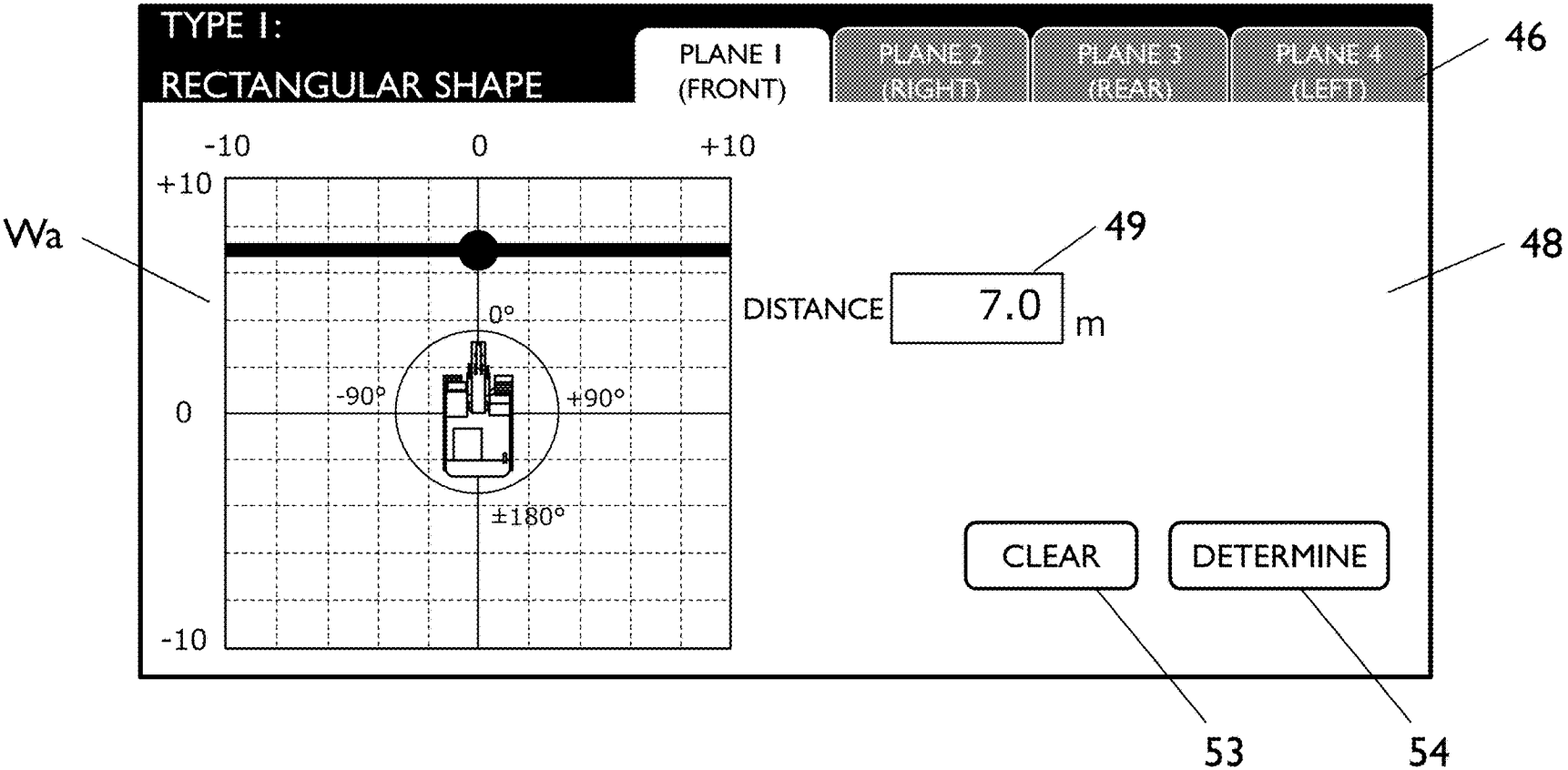
FIG. 14B is a diagram illustrating the limited area setting screen displayed when the "type 1: rectangular shape" is selected on the limited area selection screen of FIG. 11, and illustrates an example of a state in which only the "plane 1 (front)" is set as a plane forming a limited area.
Figure 14C:
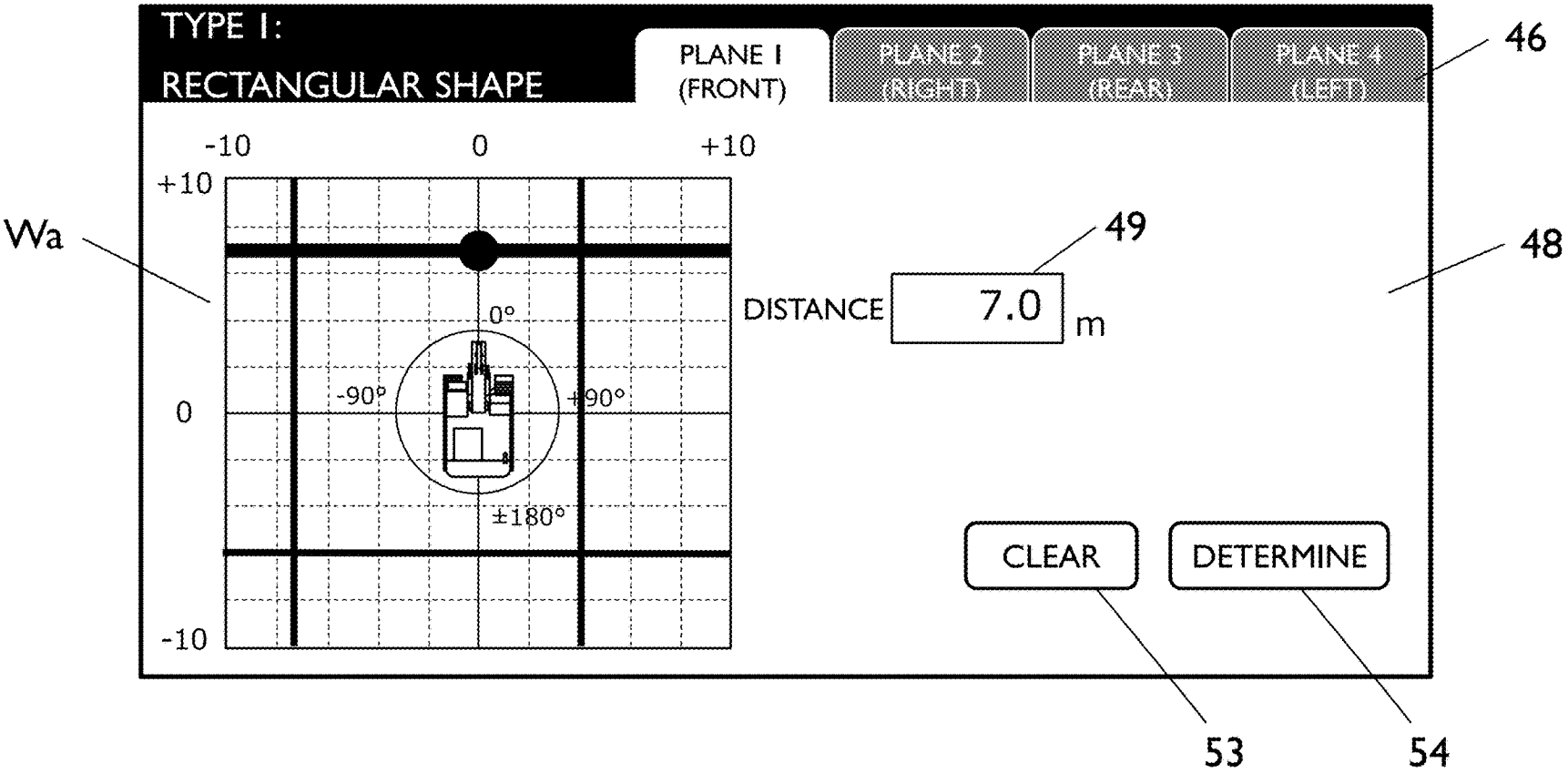
FIG. 14C is a diagram illustrating the limited area setting screen displayed when the "type 1: rectangular shape" is selected on the limited area selection screen of FIG. 11, and illustrates an example of a state in which all of the four planes, that is, the "plane 1 (front)," the "plane 2 (right)," the "plane 3 (rear)," and the "plane 4 (left)," are set as planes forming limited areas.

Next, description will be made of an area setting method in a case where the "type 1: rectangular shape" is selected as a kind of shape of a limited area boundary. FIGS. 14A to 14C are diagrams illustrating the limited area setting screen displayed when the "type 1: rectangular shape" is selected on the limited area selection screen of FIG. 11. FIG. 14A illustrates an example of the limited area setting screen in a state in which no limited area is set (initial state).

When the "type 1: rectangular shape" is selected as illustrated in FIG. 14A, the display contents of the numerical value input field 48 differ as compared with the screen at a time of selection of the "type 3: optional straight line" in FIG. 12A, and only the first distance input cell 49 is displayed on the limited area setting screen.

A limited area forward of the machine body is determined when the operator presses the area determination switch 54 after inputting a numerical value to the first distance input cell 49. In the case of the "type 1: rectangular shape," no values are input to the first angle input cell 50, the second distance input cell 51, and the second angle input cell 52. Accordingly, variables (for example, V1PosT1, V1PosR2, and V1PosT2) representing coordinates and transmitted from the monitor controller 14 to the area setting section 38 of the main controller 11 are not updated. At this time, these variables that are not updated are assumed to have 0 (zero) as an initial value input thereto, and the variables are transmitted from the monitor controller 14 to the main controller 11.

FIG. 14B is a diagram illustrating an example of the limited area setting screen in a state in which only the "plane 1 (front)" is set as a plane forming a limited area. When a limited area is set on the basis of the "type 1: rectangular shape," the controller 110 automatically determines the position of the area according to which of the "plane 1 (front)," the "plane 2 (right)," the "plane 3 (rear)," and the "plane 4 (left)" is set. That is, when the "plane 1 (front)" is set, the controller 110 automatically determines that the position of the area is in the forward direction of the machine body (0° direction when the forward direction is expressed by an angle), and determines the position of the area by mere input of the numerical value of a distance to the first distance input cell 49.

In the case of the "plane 1 (front)," the controller 110 determines that the area is in parallel with the X-axis and in a positive range of Y. In the present example, "7.0" m is input to the first distance input cell 49, and hence, the limited area is expressed by a straight line passing through (x, y)=(0, 7.0) and parallel with the X-axis. Similarly, the controller 110 determines in the case of the "plane 2 (right)" that the area is in parallel with the Y-axis and in a positive range of X, the controller 110 determines in the case of the "plane 3 (rear)" that the area is in parallel with the X-axis and in a negative range of Y, and the controller 110 determines in the case of the "plane 4 (left)" that the area is in parallel with the Y-axis and in a negative range of X.

FIG. 14C is a diagram illustrating an example of the limited area setting screen in a state in which all of the four planes, that is, the "plane 1 (front)," the "plane 2 (right)," the "plane 3 (rear)," and the "plane 4 (left)," are set as planes forming limited areas. This diagram displays the limited area setting screen of the "plane 1 (front)" after the four planes of the limited areas are set. At this time, the work area diagram Wa displays four straight lines indicating the positions of the planes forming the four limited areas. In addition, in the work area diagram Wa, the straight line corresponding to the "plane 1 (front)" currently being selected is displayed by a thick line as compared with the three other straight lines. In addition, with regard to the display of figures (circles) representing coordinate points, only the figure corresponding to the "plane 1 (front)" currently being selected is displayed.

Displaying the information corresponding to the limited area plane currently being selected in an emphasized manner as described above makes it easy for the operator to recognize which plane is being set by the operator, thus making it possible to improve the usability of the area limiting function.

(List of Variables Related to Limited Area Settings)

FIG. 15 is a diagram illustrating a list of variables related to limited area settings which is used in the present embodiment. As illustrated in FIG. 15, by the calculation of coordinate transformation from the cylindrical coordinate system to the rectangular coordinate system, the area setting section 38 transforms one combination set of a distance and an angle of a coordinate point which is transmitted from the monitor controller 14 to the area setting section 38 of the main controller 11 into one combination set of an X-coordinate and a Y-coordinate of the coordinate point.

However, as described earlier in the description with reference to FIGS. 13A to 13C and FIGS. 14A to 14C, when a kind of shape of a limited area boundary is set to be the "type 1: rectangular shape" or the "type 2: tangent to a concentric circle," not all information regarding coordinate points for identifying the position of the plane is input. Hence, a method of computing the X-coordinates and Y-coordinates of the coordinate points (that is, the position specifying method for the limited area boundary) needs to be changed according to the kind of shape of the limited area boundary and the presence or absence of a setting of the area.

(Determination of Function Parameters Representing Area from Area Setting Operation of Operator)

FIGS. 16A to 16D are block diagrams illustrating processing contents of the area setting section 38. The area setting section 38 includes an area 1 area setting section 55, an area 2 area setting section 56, an area 3 area setting section 57, and an area 4 area setting section 58 as control sections that determine function parameters representing a limited area boundary for each of the four limited areas.

In the following, the limited area forward of the machine body which is formed by the "plane 1 (front)" described earlier will also be described as a "area 1" or a "plane 1 (front)" area. The limited area rightward of the machine body which is formed by the "plane 2 (right)" described earlier will also be described as a "area 2" or a "plane 2 (right)" area. The limited area rearward of the machine body which is formed by the "plane 3 (rear)" described earlier will also be described as a "area 3" or a "plane 3 (rear)" area. The limited area leftward of the machine body which is formed by the "plane 4 (left)" described earlier will also be described as a "area 4" or a "plane 4 (left)" area.

Figure 16A:
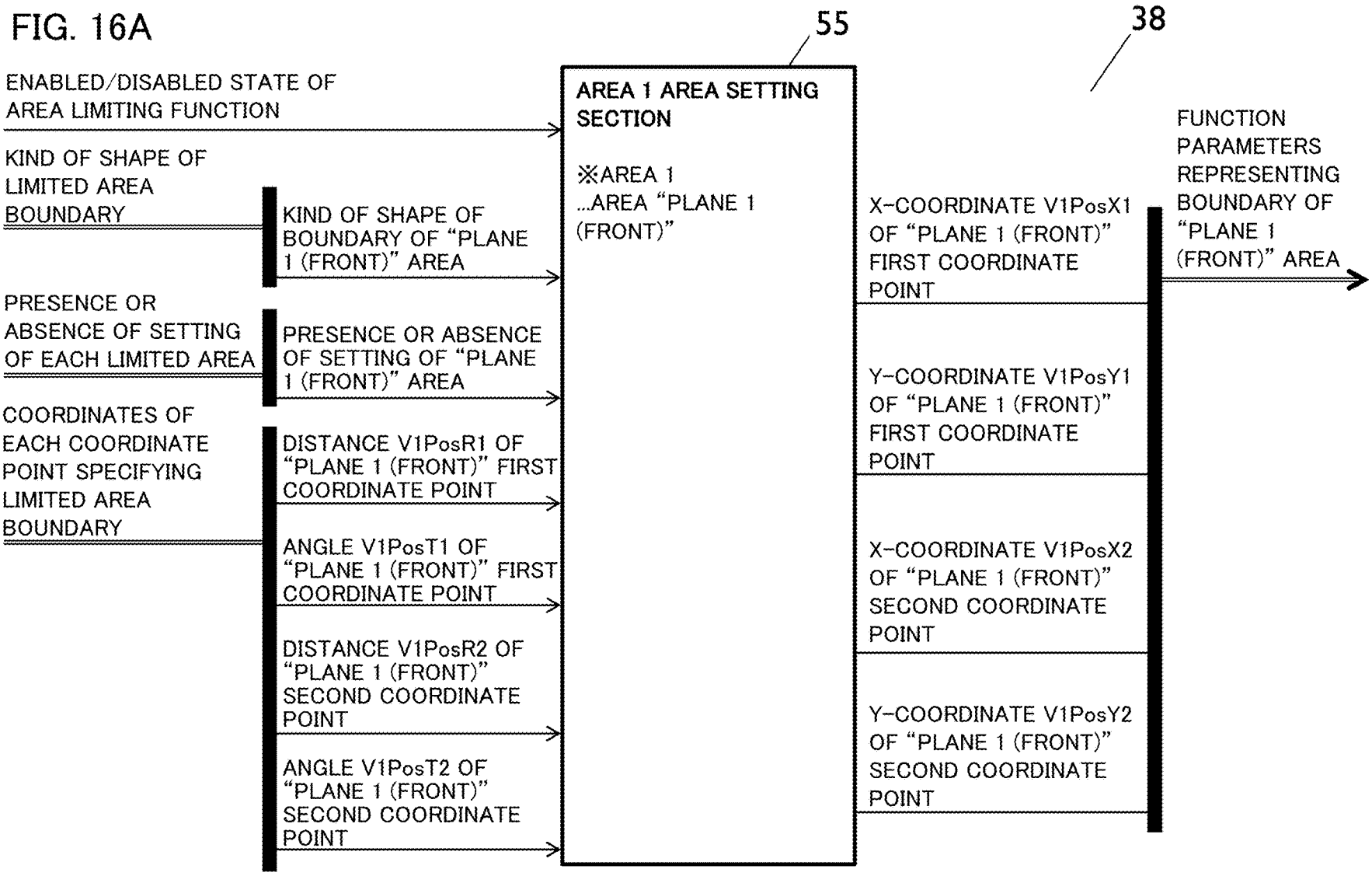
FIG. 16A is a block diagram illustrating processing contents of an area setting section, and illustrates the input and output of an area 1 area setting section.

FIG. 16A is a diagram illustrating the input and output of the area 1 area setting section 55. As illustrated in FIG. 16A, the area 1 area setting section 55 is supplied with data related to the "plane 1 (front)" area in information transmitted from the monitor controller 14, the information being the enabled/disabled state of the area limiting function, a kind of shape of a limited area boundary, the presence or absence of a setting of each limited area, and the coordinates of each coordinate point specifying the limited area boundary. Then, the area 1 area setting section 55 outputs function parameters representing the boundary of the "plane 1 (front)" area (that is, function parameters representing the "plane 1 (front)") to the distance computing section 39.

Figure 16B:
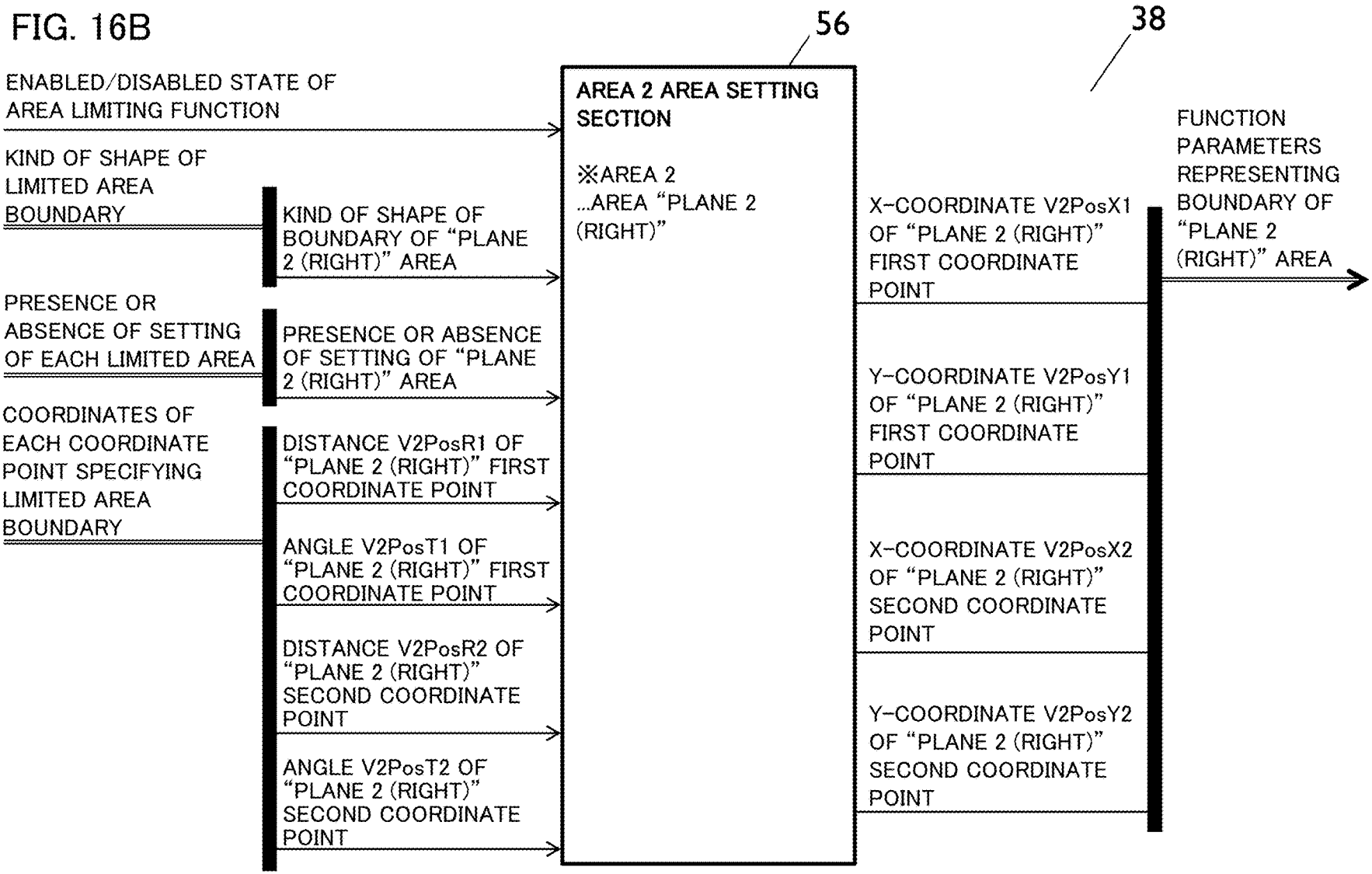
FIG. 16B is a block diagram illustrating processing contents of the area setting section, and illustrates the input and output of an area 2 area setting section.

FIG. 16B is a diagram illustrating the input and output of the area 2 area setting section 56. As illustrated in FIG. 16B, the area 2 area setting section 56 is supplied with data related to the "plane 2 (right)" area in the information transmitted from the monitor controller 14. Then, the area 2 area setting section 56 outputs function parameters representing the boundary of the "plane 2 (right)" area (that is, function parameters representing the "plane 2 (right)") to the distance computing section 39.

Figure 16C:
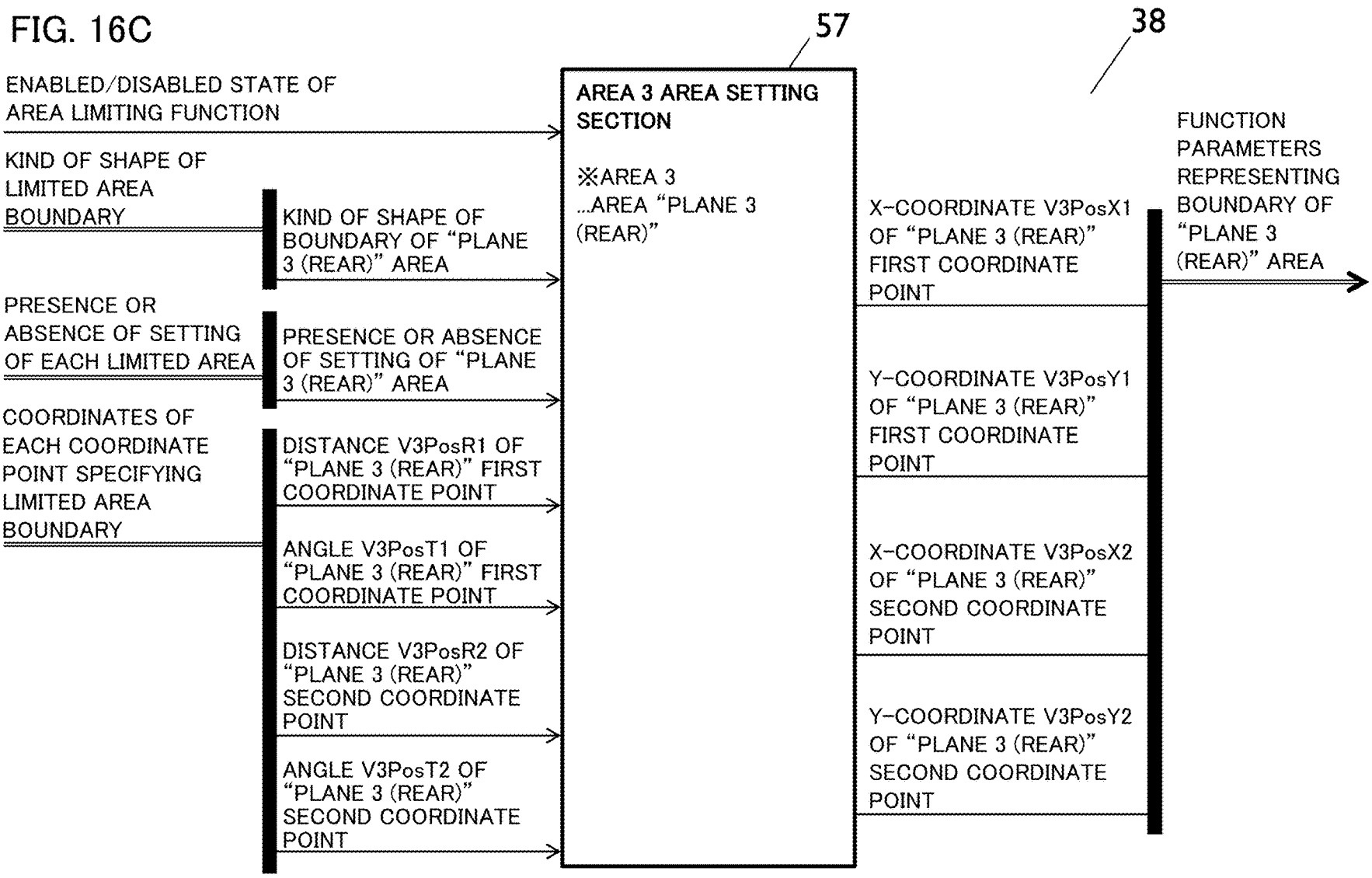
FIG. 16C is a block diagram illustrating processing contents of the area setting section, and illustrates the input and output of an area 3 area setting section.

FIG. 16C is a diagram illustrating the input and output of the area 3 area setting section 57. As illustrated in FIG. 16C, the area 3 area setting section 57 is supplied with data related to the "plane 3 (rear)" area in the information transmitted from the monitor controller 14. Then, the area 3 area setting section 57 outputs function parameters representing the boundary of the "plane 3 (rear)" (that is, function parameters representing the "plane 3 (rear)") to the distance computing section 39.

Figure 16D:
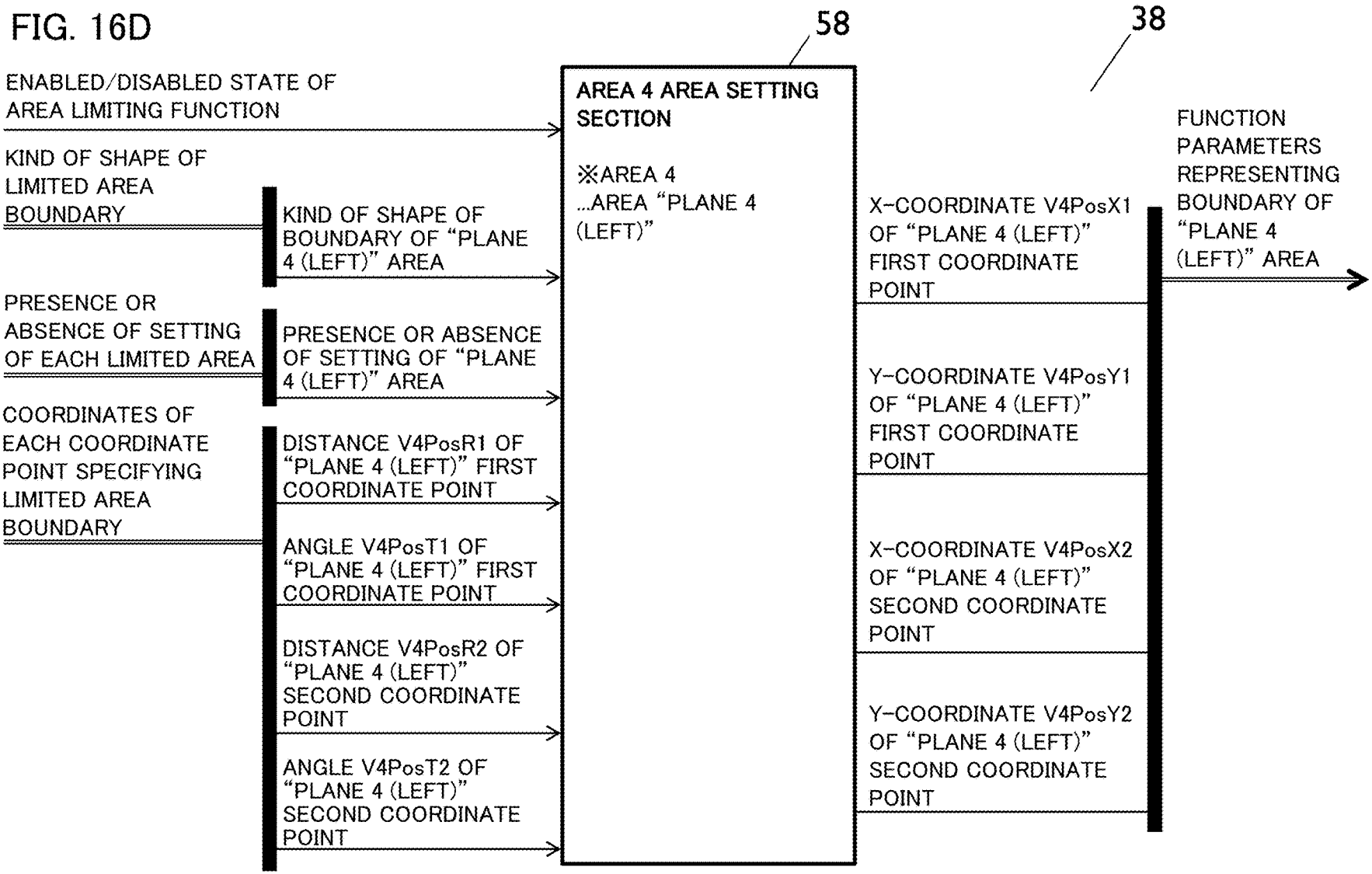
FIG. 16D is a block diagram illustrating processing contents of the area setting section, and illustrates the input and output of an area 4 area setting section.

FIG. 16D is a diagram illustrating the input and output of the area 4 area setting section 58. As illustrated in FIG. 16D, the area 4 area setting section 58 is supplied with data related to the "plane 4 (left)" area in the information transmitted from the monitor controller 14. Then, the area 4 area setting section 58 outputs function parameters representing the boundary of the "plane 4 (left)" area (that is, function parameters representing the "plane 4 (left)") to the distance computing section 39.

The contents of processing performed by the area 1 area setting section 55, the area 2 area setting section 56, the area 3 area setting section 57, and the area 4 area setting section 58 are similar. Hence, in the following, the processing contents of the area 1 area setting section 55 will representatively be described. While correspondences of variables in transformation equations and the like differ according to the arrangement of the front, rear, left, and right limited areas, a common concept of deriving the coordinates of coordinate points is applied. The description of the processing contents of the area 2 area setting section 56, the area 3 area setting section 57, and the area 4 area setting section 58 will hence be omitted. Incidentally, a list of input and output signals (variables) of these is described in FIG. 15.

Figure 17:
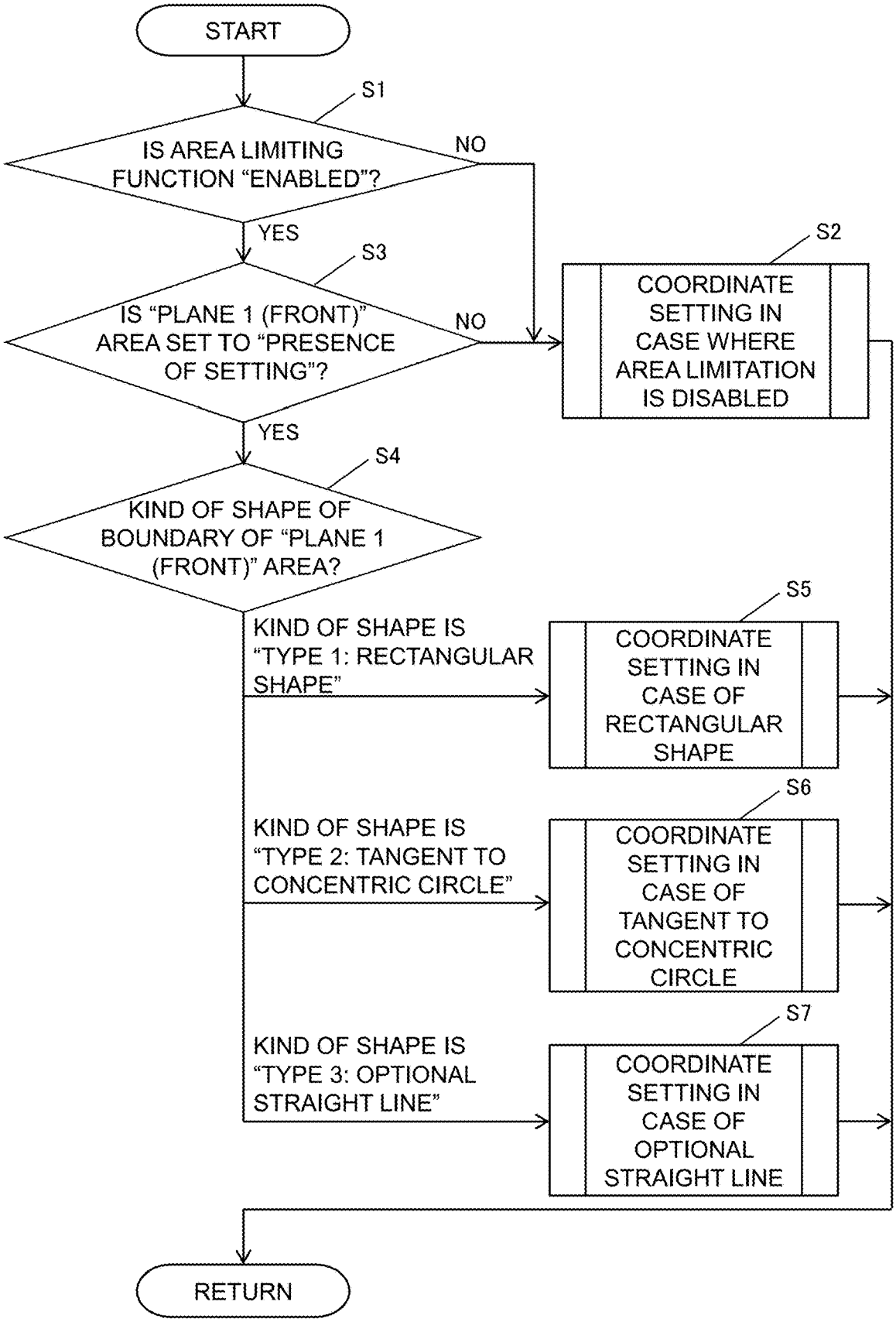
FIG. 17 is a flowchart illustrating the processing contents of the area 1 area setting section.

FIG. 17 is a flowchart illustrating the processing contents of the area 1 area setting section 55. The area 1 area setting section 55 first determines whether or not the area limiting function is "enabled" (step S1). When it is determined in step S1 that the area limiting function is not "enabled" ("disabled"), the processing proceeds to a coordinate setting subroutine in a case where the area limitation is disabled (step S2). When it is determined in step S1 that the area limiting function is "enabled," the processing proceeds to step S3.

In step S3, the area 1 area setting section 55 determines whether or not the "plane 1 (front)" area is set to "presence of a setting." When it is determined in step S3 that the "plane 1 (front)" area is not set to the "presence of a setting" (is set to "absence of a setting"), the processing proceeds to the coordinate setting subroutine (step S2) in a case where the area limitation is disabled. When it is determined in step S3 that the "plane 1 (front)" area is set to the "presence of a setting," the processing proceeds to step S4.

In step S4, the area 1 area setting section 55 determines the kind of shape of the boundary of the "plane 1 (front)" area. When it is determined in step S4 that the kind of shape of the boundary of the "plane 1 (front)" area is the "type 1: rectangular shape," the processing proceeds to a coordinate setting subroutine in a case of a rectangular shape (step S5). When it is determined in step S4 that the kind of shape of the boundary of the "plane 1 (front)" area is the "type 2: tangent to a concentric circle," the processing proceeds to a coordinate setting subroutine in a case of a tangent to a concentric circle (step S6). When it is determined in step S4 that the kind of shape of the boundary of the "plane 1 (front)" area is the "type 3: optional straight line," the processing proceeds to a coordinate setting subroutine in a case of an optional straight line (step S7).

In each of the subroutines (steps S2, S5, S6, and S7), the X-coordinate V1PosX1 of the first coordinate point, the Y-coordinate V1PosY1 of the first coordinate point, the X-coordinate V1PosX2 of the second coordinate point, and the Y-coordinate V1PosY2 of the second coordinate point as the function parameters representing the respective limited area boundary are determined on the basis of the respective position specifying method, and are then output.

(Coordinate Setting in Case where Area Limitation is Disabled)

Figure 18:
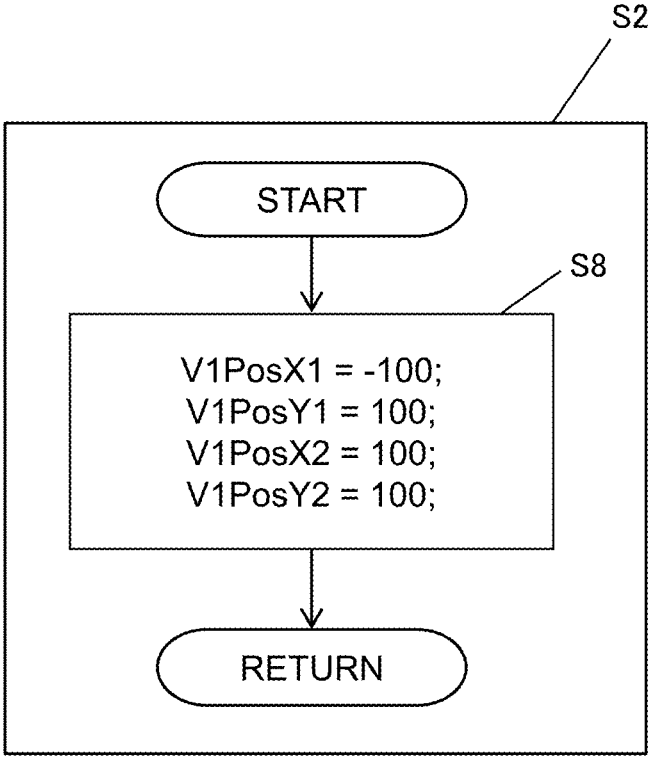
FIG. 18 is a flowchart illustrating the processing contents of a coordinate setting subroutine in a case where area limitation is disabled.

FIG. 18 is a flowchart illustrating the processing contents of the coordinate setting subroutine in a case where the area limitation is disabled (step S2). The operation of the hydraulic excavator 100 is not limited at all times in a case where the area limitation is disabled. Hence, the position of the limited area is set to a position that the front work implement 3 obviously does not reach.

When the coordinate setting subroutine in a case where the area limitation is disabled (step S2) is started, the area 1 area setting section 55 determines the coordinates V1PosX1, V1PosY1, V1PosX2, and V1PosY2 of the respective coordinate points as follows (step S8).

*X*-Coordinate *V*1Pos*X*1 of First Coordinate Point=−100 [m]

*Y*-Coordinate *V*1Pos*Y*1 of First Coordinate Point=100 [m]

*X*-Coordinate *V*1Pos*X*2 of Second Coordinate Point=100 [m]

Y-Coordinate V1PosY2 of Second Coordinate Point=100 [m]

Consequently, the plane forming the "area 1" is set as a plane parallel with an XZ plane located 100 m forward of the origin O. This plane is sufficiently separated from the front work implement 3, so that the operation of the front work implement 3 is not limited.

Incidentally, as far as the case where the area limiting function is "disabled" is concerned, the limiting control section 36 performs the processing of not limiting the operation of the hydraulic excavator 100. Hence, the coordinate setting here is not essential, but the coordinate setting here is necessary in order to make provision for a case where the area limiting function is "enabled" but the limited area is "not set."

(Coordinate Setting in Case where Kind of Shape of Limited Area Boundary is Rectangular Shape)

Figure 19:
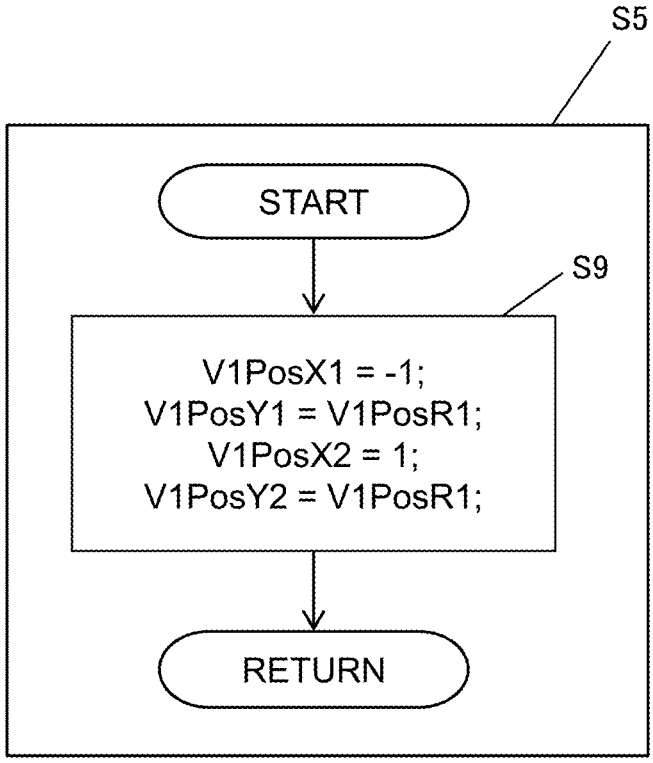
FIG. 19 is a flowchart illustrating the processing contents of a coordinate setting subroutine in a case where a kind of shape of a limited area boundary is a rectangular shape.

FIG. 19 is a flowchart illustrating the processing contents of the coordinate setting subroutine in a case where the kind of shape of the limited area boundary is a rectangular shape (step S5). Two coordinate points in the rectangular coordinate system which are at different positions are necessary for a function (equation of a straight line) representing the limited area boundary in the distance computing section 39. However, it is only the distance V1PosR1 of the first coordinate point that the operator inputs as a numerical value (position specifying information) when the kind of shape of the limited area boundary is a rectangular shape.

Hence, in the coordinate setting subroutine in the case of a rectangular shape (step S5), the area 1 area setting section 55 determines the coordinates V1PosX1, V1PosY1, V1PosX2, and V1PosY2 of the respective coordinate points as follows (step S9).

X-Coordinate V1PosX1 of First Coordinate Point=−1 [m]

Y-Coordinate V1PosY1 of First Coordinate Point=V1PosR1 [m]

X-Coordinate V1PosX2 of Second Coordinate Point=1 [m]

Y-Coordinate V1PosY2 of Second Coordinate Point=V1PosR1 [m]

Consequently, the plane forming the "area 1" is set as a plane located V1PosR1 [m] forward of the origin O and parallel with the XZ plane.

Incidentally, while −1 m is set as V1PosX1, and 1 m is set as V1PosX2, there is no meaning to the magnitude of the numerical values. In the present computing method (present position specifying method), it suffices at least to set the X-coordinate of the first point as a coordinate point and the X-coordinate of the second point as a coordinate point in such a manner as to set a plane parallel with the XZ plane. That is, in the present computing method (present position specifying method), it suffices to set different values for V1PosX1 and V1PosX2, and set the distance V1PosR1, which is the position specifying information, for each of V1PosY1 and V1PosY2.

(Coordinate Setting in Case where Kind of Shape of Limited Area Boundary is Tangent to Concentric Circle)

Figure 20:
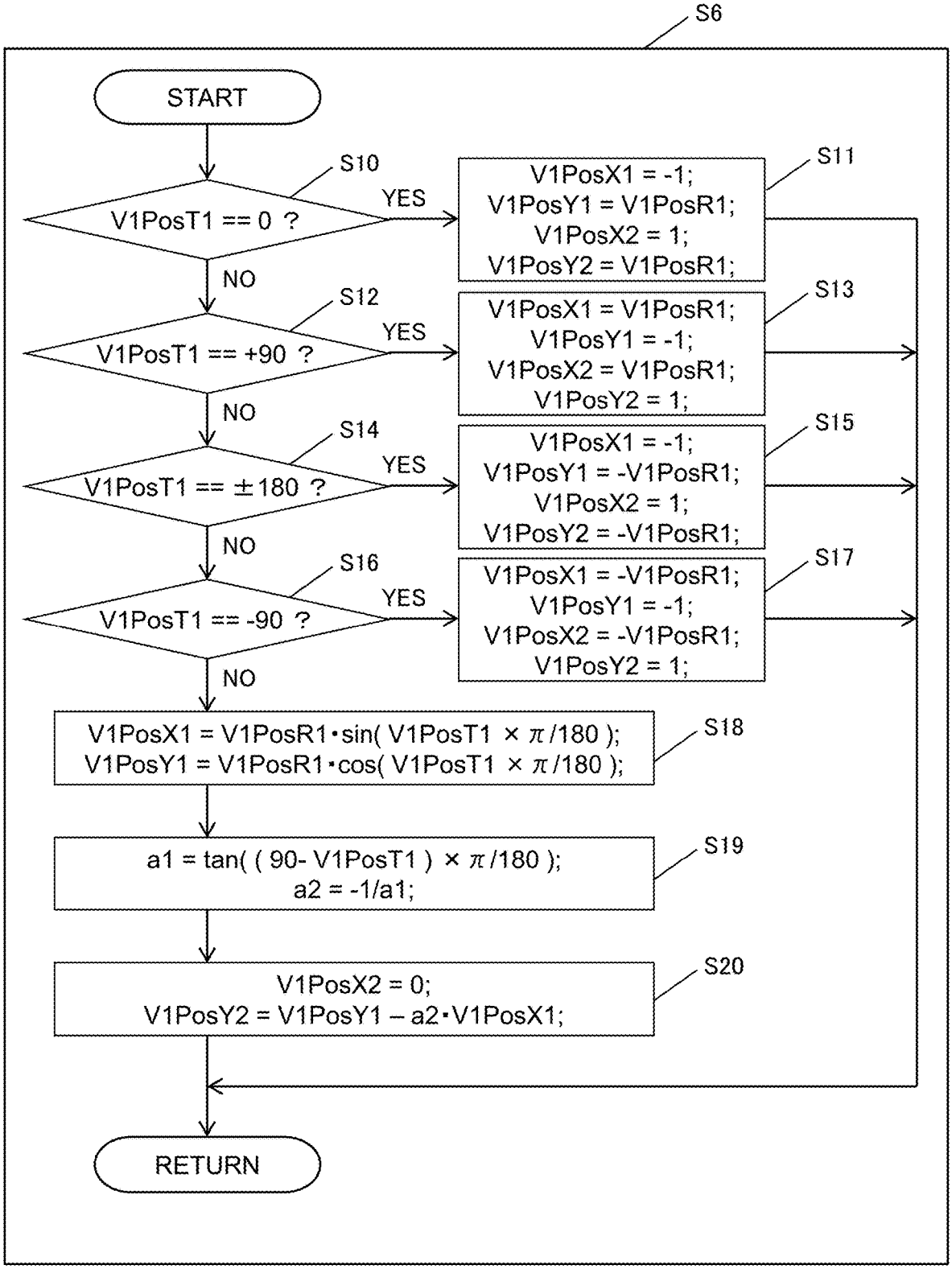
FIG. 20 is a flowchart illustrating the processing contents of a coordinate setting subroutine in a case where the kind of shape of the limited area boundary is a tangent to a concentric circle.

FIG. 20 is a flowchart illustrating the processing contents of the coordinate setting subroutine in a case where the kind of shape of the limited area boundary is a tangent to a concentric circle (step S6). Two coordinate points in the rectangular coordinate system which are at different positions are necessary for a function (equation of a straight line) representing the limited area boundary in the distance computing section 39. However, it is only the distance V1PosR1 of the first coordinate point and the angle V1PosT1 of the first coordinate point that the operator inputs as numerical values (position specifying information) when the kind of shape of the limited area boundary is a tangent to a concentric circle.

Hence, in the coordinate setting subroutine in the case of a tangent to a concentric circle (step S6), the area 1 area setting section 55 determines the coordinates V1PosX1, V1PosY1, V1PosX2, and V1PosY2 of the respective coordinate points by a computing method (position specifying method) described in the following.

When the coordinate setting subroutine in the case of a tangent to a concentric circle (step S6) is started, the area 1 area setting section 55 first determines whether or not the angle V1PosT1 of the first coordinate point is 0° (step S10). When it is determined in step S10 that the angle V1PosT1 of the first coordinate point is 0°, the processing proceeds to step S11. The position of the plane forming the limited area when the angle V1PosT1 of the first coordinate point is 0° is the same as the position of the "plane 1 (front)" set when the kind of shape of the limited area boundary is the "type 1: rectangular shape."

Hence, the area 1 area setting section 55 determines the coordinates V1PosX1, V1PosY1, V1PosX2, and V1PosY2 of the respective coordinate points as follows in step S11, and then ends the processing.

X-Coordinate V1PosX1 of First Coordinate Point=−1 [m]

Y-Coordinate V1PosY1 of First Coordinate Point=V1PosR1 [m]

X-Coordinate V1PosX2 of Second Coordinate Point=1 [m]

Y-Coordinate V1PosY2 of Second Coordinate Point=V1PosR1 [m]

When it is determined in step S10 that the angle V1PosT1 of the first coordinate point is not 0°, the processing proceeds to step S12. In step S12, the area 1 area setting section 55 determines whether or not the angle V1PosT1 of the first coordinate point is 90°. When it is determined in step S12 that the angle V1PosT1 of the first coordinate point is 90°, the processing proceeds to step S13. The position of the plane forming the limited area when the angle V1PosT1 of the first coordinate point is 90° is the same as the position of the "plane 2 (right)" set when the kind of shape of the limited area boundary is the "type 1: rectangular shape."

Hence, the area 1 area setting section 55 determines the coordinates V1PosX1, V1PosY1, V1PosX2, and V1PosY2 of the respective coordinate points as follows in step S13, and then ends the processing.

X-Coordinate V1PosX1 of First Coordinate Point=V1PosR1 [m]

Y-Coordinate V1PosY1 of First Coordinate Point=−1 [m]

X-Coordinate V1PosX2 of Second Coordinate Point=V1PosR1 [m]

Y-Coordinate V1PosY2 of Second Coordinate Point=1 [m]

When it is determined in step S12 that the angle V1PosT1 of the first coordinate point is not 90°, the processing proceeds to step S14. In step S14, the area 1 area setting section 55 determines whether or not the angle V1PosT1 of the first coordinate point is +180° or −180°. When it is determined in step S14 that the angle V1PosT1 of the first coordinate point is +180° or −180°, the processing proceeds to step S15. The position of the plane forming the limited area when the angle V1PosT1 of the first coordinate point is +180° or −180° is the same as the position of the "plane 3 (rear)" set when the kind of shape of the limited area boundary is the "type 1: rectangular shape."

Hence, the area 1 area setting section 55 determines the coordinates V1PosX1, V1PosY1, V1PosX2, and V1PosY2 of the respective coordinate points as follows in step S15, and then ends the processing.

$X$-Coordinate $V1PosX1$ of First Coordinate Point=−1 [m]

$Y$-Coordinate $V1PosY1$ of First Coordinate Point=$V1PosR1$ [m]

$X$-Coordinate $V1PosX2$ of Second Coordinate Point=1 [m]

$Y$-Coordinate $V1PosY2$ of Second Coordinate Point=−$V1PosR1$ [m]

When it is determined in step S14 that the angle V1PosT1 of the first coordinate point is neither +180° nor −180°, the processing proceeds to step S16. In step S16, the area 1 area setting section 55 determines whether or not the angle V1PosT1 of the first coordinate point is −90°. When it is determined in step S16 that the angle V1PosT1 of the first coordinate point is −90°, the processing proceeds to step S17. The position of the plane forming the limited area when the angle V1PosT1 of the first coordinate point is −90° is the same as the position of the "plane 4 (left)" set when the shape of the limited area boundary is the "type 1: rectangular shape."

Hence, the area 1 area setting section 55 determines the coordinates V1PosX1, V1PosY1, V1PosX2, and V1PosY2 of the respective coordinate points as follows in step S17, and then ends the processing.

$X$-Coordinate $V1PosX1$ of First Coordinate Point=$V1PosR1$ [m]

$Y$-Coordinate $V1PosY1$ of First Coordinate Point=−1 [m]

$X$-Coordinate $V1PosX2$ of Second Coordinate Point=−$V1PosR1$ [m]

$Y$-Coordinate $V1PosY2$ of Second Coordinate Point=1 [m]

When it is determined in step S16 that the angle V1PosT1 of the first coordinate point is not −90°, the processing proceeds to step S18. When the angle V1PosT1 of the first coordinate point is neither one of 0°, 90°, +180°, −180°, and −90°, the coordinate point input by the operator is present in a range of $-180<\theta<-90$, $-90<\theta<0$, $0<\theta<90$, or $90<\theta<180$ in the cylindrical coordinate system. Hence, in step S18, the area 1 area setting section 55 determines the two coordinate points by a coordinate transformation from the cylindrical coordinate system to the rectangular coordinate system which uses trigonometric functions.

In step S18, the area 1 area setting section 55 calculates the X-coordinate and Y-coordinate of the first coordinate point by the following Equation on the basis of information regarding the first coordinate point which information is input by the operator (the distance V1PosR1 of the first coordinate point and the angle V1PosT1 of the first coordinate point). The area 1 area setting section 55 then proceeds to step S19.

$X$-Coordinate $V1PosX1$ of First Coordinate Point=$V1PosR1\cdot\sin(V1PosT1\times\pi/180)$ [m]

$Y$-Coordinate $V1PosY1$ of First Coordinate Point=$V1PosR1\cdot\cos(V1PosT1\times\pi/180)$ [m]

The second coordinate point is set as a y-intercept of a straight line orthogonal to a straight line passing through the first coordinate point and connecting the origin O and the first coordinate point to each other. Hence, it is necessary to first compute a slope a1 of the straight line connecting the origin O and the first coordinate point to each other and a slope a2 of the straight line orthogonal to the straight line connecting the origin O and the first coordinate point to each other. In step S19, the area 1 area setting section 55 computes the slopes a1 and a2 by the following Equations on the basis of the angle V1PosT1 of the first coordinate point, the angle being input by the operator. The area 1 area setting section 55 then proceeds to step S20.

$$a1=\tan((90-V1PosT1)\times\pi/180)$$

$$a2=-1/a1$$

In step S20, the area 1 area setting section 55 computes the X-coordinate and the Y-coordinate of the second coordinate point by the following Equations with use of the slope a2 computed in step S19 and the X-coordinate V1PosX1 and the Y-coordinate V1PosY1 of the first coordinate point, the X-coordinate V1PosX1 and the Y-coordinate V1PosY1 being calculated in step S18. The area 1 area setting section 55 then ends the processing.

$X$-Coordinate $V1PosX2$ of Second Coordinate Point=0 [m]

$Y$-Coordinate $V1PosY2$ of Second Coordinate Point=$V1PosY1-a2\cdot V1PosX1$ [m]

Figure 21:
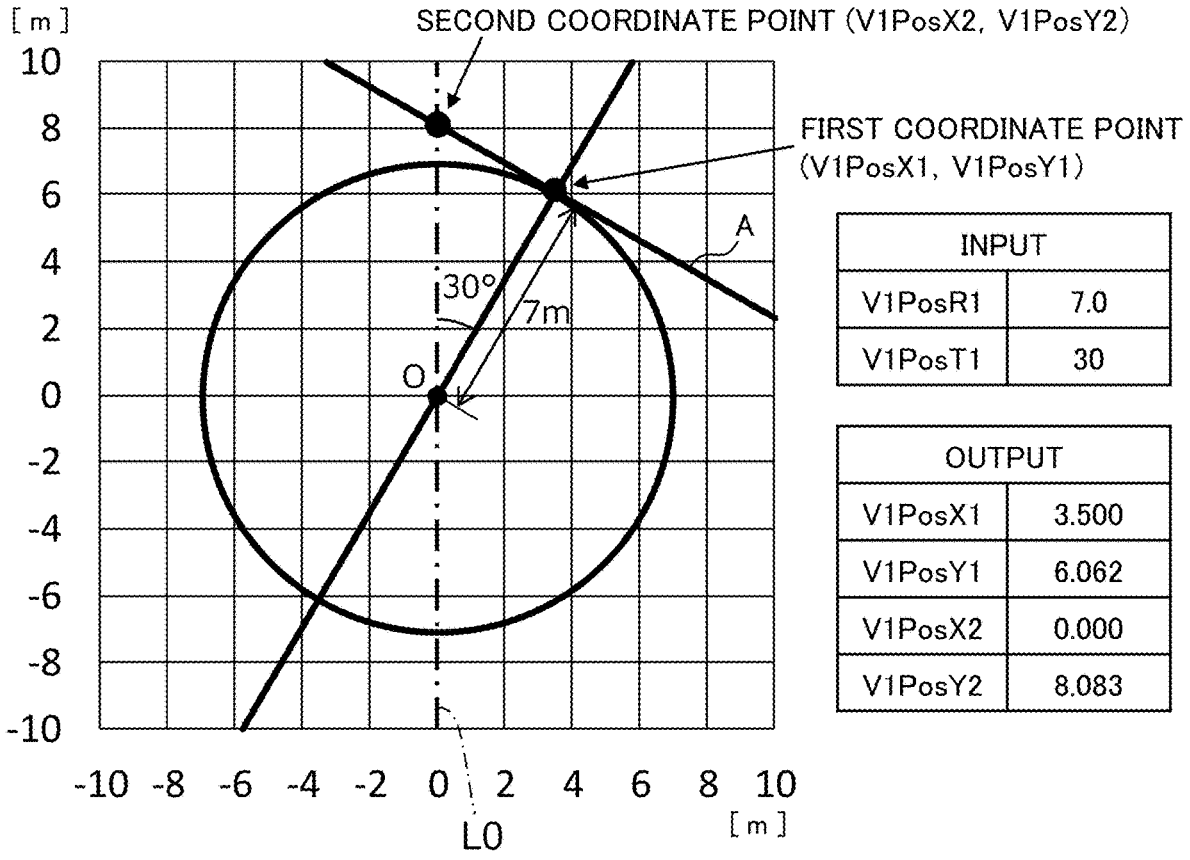
FIG. 21 is a diagram illustrating a specific example of one limited area in the case where the kind of shape of the limited area boundary is a tangent to a concentric circle.

FIG. 21 is a diagram illustrating a specific example of one limited area in a case where the kind of shape of the limited area boundary is a tangent to a concentric circle. FIG. 21 illustrates the limited area set when the operator inputs a distance (V1PosR1) of 7.0 m from the origin O and an angle (V1PosT1) of 30° from the angle reference line L0 as position specifying information (information regarding a coordinate point) specifying the position of the limited area.

The processing of the coordinate setting subroutine (step S6) illustrated in FIG. 20 computes, as the two coordinate points indicating the position of the limited area, an X-coordinate (V1PosX1) of 3.5 m of the first point, a Y-coordinate (V1PosY1) of 6.062 m of the first point, an X-coordinate (V1PosX2) of 0 m of the second point, and a Y-coordinate (V1PosY2) of 8.083 m of the second point.

It can be confirmed from a graph in FIG. 21 that a straight line A passing through the first point and the second point as coordinate points is a straight line that circumscribes a circle having the origin O as a center thereof and having a radius of 7 m, at a point of an angle of 30° from the angle reference line L0 (0°).

(Coordinate Setting in Case where Kind of Shape of Limited Area Boundary is Optional Straight Line)

Figure 22:
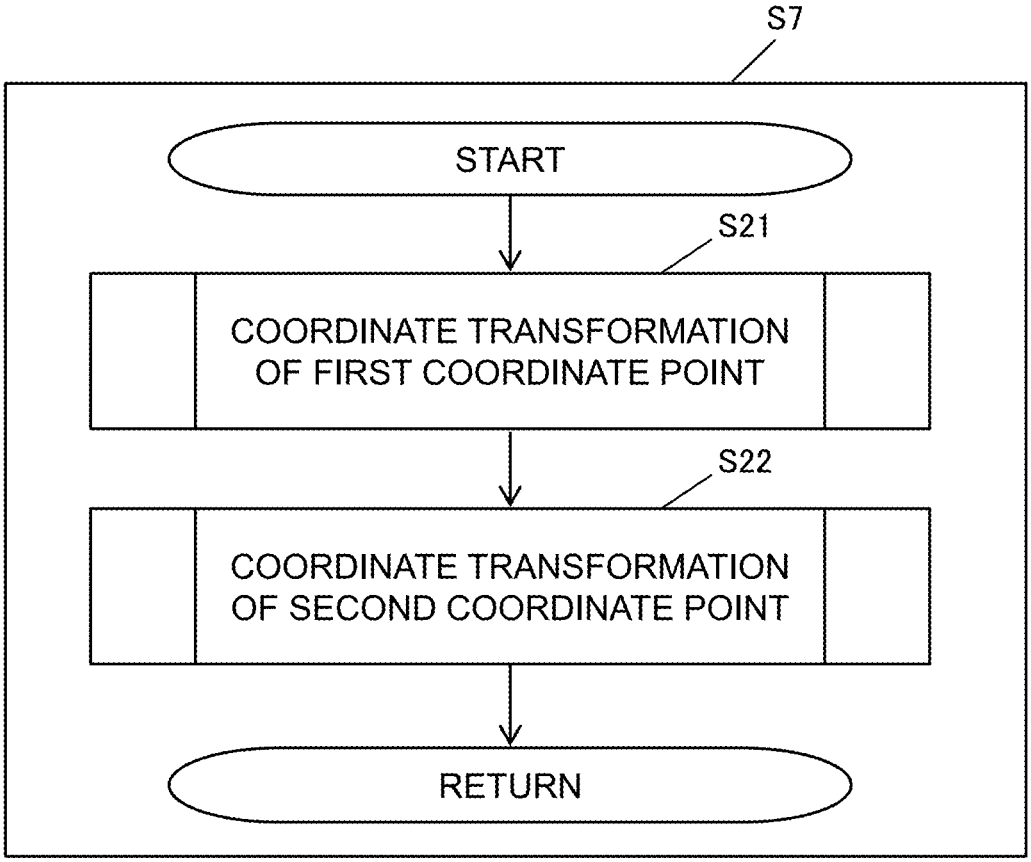
FIG. 22 is a flowchart illustrating the processing contents of a coordinate setting subroutine in a case where the kind of shape of the limited area boundary is an optional straight line.

FIG. 22 is a flowchart illustrating the processing contents of the coordinate setting subroutine in a case where the kind of shape of the limited area boundary is an optional straight line (step S7). Two coordinate points in the rectangular coordinate system which are at different positions are necessary for a function (equation of a straight line) representing the limited area boundary in the distance computing section 39. However, numerical values input by the operator when the kind of shape of the limited area boundary is an optional straight line are those of two coordinate points in the cylindrical coordinate system.

Hence, in the coordinate setting subroutine in a case of an optional straight line (step S7), the area 1 area setting section 55 performs a coordinate transformation of each of the two coordinate points from the cylindrical coordinate system to the rectangular coordinate system by a computing method (position specifying method) described in the following.

When the kind of shape of the limited area boundary is an optional straight line, the operator inputs information regarding the two coordinate points. When the coordinate setting subroutine in a case of an optional straight line (step S7) is started, the area 1 area setting section 55 executes a coordinate transformation subroutine for the first coordinate point (step S21) and a coordinate transformation subroutine for the second coordinate point (step S22) in order.

Figure 23:
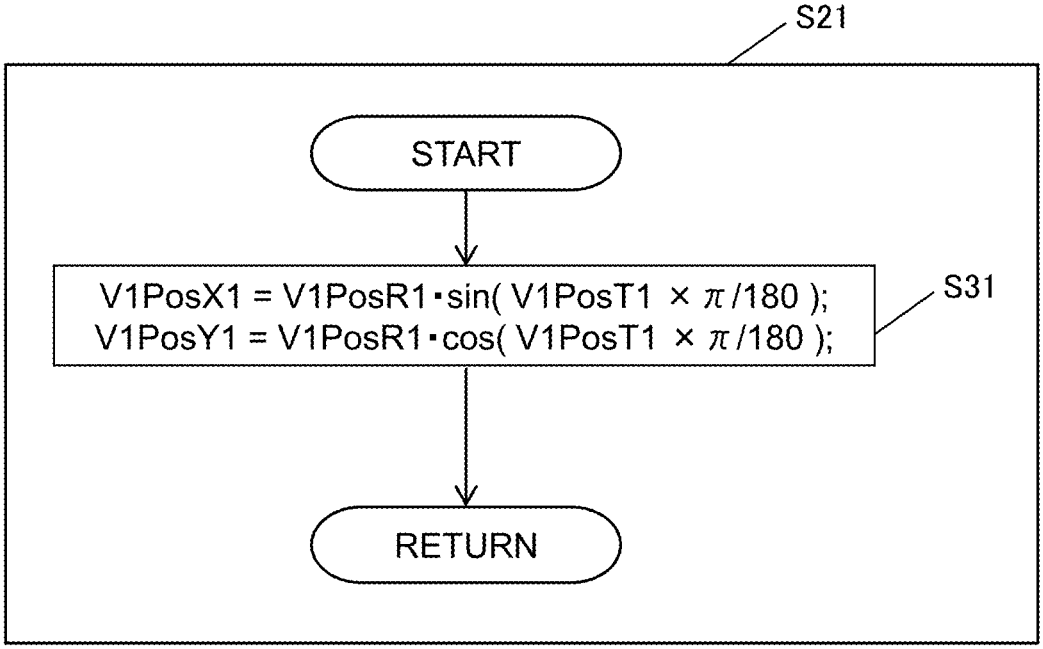
FIG. 23 is a flowchart illustrating the processing contents of a coordinate transformation subroutine for a first coordinate point in the case where the kind of shape of the limited area boundary is an optional straight line.

FIG. 23 is a flowchart illustrating the processing contents of the coordinate transformation subroutine for the first coordinate point (step S21) in a case where the kind of shape of the limited area boundary is an optional straight line. When the subroutine (step S21) is started, the area 1 area setting section 55 determines the X-coordinate V1PosX1 and the Y-coordinate V1PosY1 of the first coordinate point through a coordinate transformation from the cylindrical coordinate system to the rectangular coordinate system by the following Equations using trigonometric functions (step S31).

$$X\text{-Coordinate } V1PosX1 \text{ of First Coordinate Point} = V1PosR1 \cdot \sin(V1PosT1 \times \pi/180)\ [\text{m}]$$

$$Y\text{-Coordinate } V1PosY1 \text{ of First Coordinate Point} = V1PosR1 \cdot \cos(V1PosT1 \times \pi/180)\ [\text{m}]$$

Figure 24:
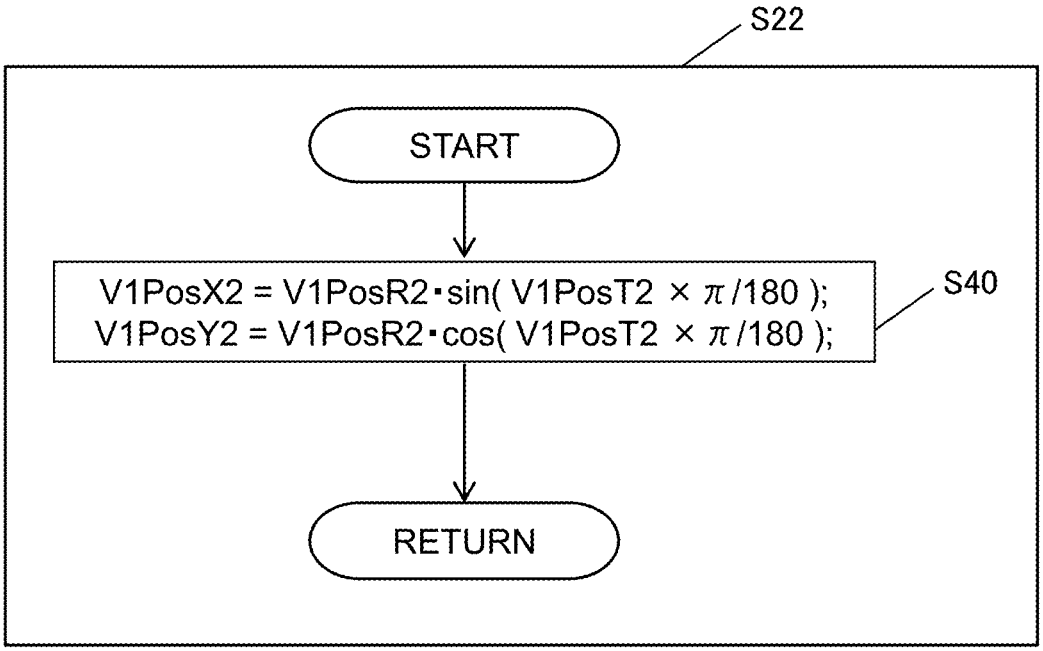
FIG. 24 is a flowchart illustrating the processing contents of a coordinate transformation subroutine for a second coordinate point in the case where the kind of shape of the limited area boundary is an optional straight line.

FIG. 24 is a flowchart illustrating the processing contents of the coordinate transformation subroutine for the second coordinate point (step S22) in a case where the kind of shape of the limited area boundary is an optional straight line. When the subroutine (step S22) is started, the area 1 area setting section 55 determines the X-coordinate V1PosX2 and the Y-coordinate V1PosY2 of the second coordinate point through a coordinate transformation from the cylindrical coordinate system to the rectangular coordinate system by the following Equations using trigonometric functions (step S40).

$$X\text{-Coordinate } V1PosX2 \text{ of Second Coordinate Point} = V1PosR2 \cdot \sin(V1PosT2 \times \pi/180)\ [\text{m}]$$

$$Y\text{-Coordinate } V1PosY2 \text{ of Second Coordinate Point} = V1PosR2 \cdot \cos(V1PosT2 \times \pi/180)\ [\text{m}]$$

(Effects of First Embodiment)

The first embodiment of the present invention which is configured as described above can provide effects illustrated in the following.

(1) The controller 110 according to the present embodiment includes the nonvolatile memory (storage device) 82 that stores boundary information related to a plurality of different kinds of shapes of limited area boundaries (a rectangular shape, a tangent to a concentric circle, and an optional straight line). The controller 110 selects one from among the plurality of kinds of shapes of limited area boundaries included in the boundary information, on the basis of the input information input from the switch box (input device) 13 according to an operation of the operator, and sets a limited area boundary of the selected kind of shape. According to this configuration, it is possible to easily set a limited area of a shape (a simple shape or a complex shape) according to work conditions and a work environment, so that the hydraulic excavator (work machine) 100 having an easy-to-use area limiting function can be provided.

In the present embodiment, the kinds of shapes of limited area boundaries which can be selected by the operator include three kinds, that is, the "type 1: rectangular shape," the "type 2: tangent to a concentric circle," and the "type 3: optional straight line" in polygonal areas in particular. Thus, the operator can make provision according to conditions even when the area desired to be limited changes according to the work conditions and the work environment.

(2) The nonvolatile memory (storage device) 92 of the controller 110 stores a position specifying method corresponding to the kind of shape of the limited area boundary. The input information input from the switch box (input device) 13 to the controller 110 includes position specifying information specifying the position of the limited area boundary. The controller 110 sets the limited area boundary on the basis of the position specifying information input from the switch box (input device) 13 and the position specifying method (see FIG. 19, FIG. 20, or FIG. 22) stored in the nonvolatile memory (storage device) 92. In the present embodiment, the controller 110 selects the position specifying method corresponding to the selected kind of shape of the limited area boundary from among a plurality of position specifying methods (see FIG. 19, FIG. 20, and FIG. 22). Further, the controller 110 sets the limited area boundary on the basis of the selected position specifying method and the position specifying information.

Limited areas of the same shapes as those in cases where the "type 1: rectangular shape" and the "type 2: tangent to a concentric circle" are selected can be set by only the position specifying method used in a case where the "type 3: optional straight line" is selected. However, in that case, the operator needs to input much coordinate point information and thus takes time and effort for a simple limited area shape. In the present embodiment, when the "type 1: rectangular shape" as the first shape is selected as a kind of shape of a limited area boundary, the controller 110 sets the limited area boundary on the basis of the position specifying method described with reference to FIG. 19. In this position specifying method, there is one input coordinate point, and numerical value input is performed at only one position (see FIG. 14B). When the "type 2: tangent to a concentric circle" as the second shape is selected as a kind of shape of a limited area boundary, the controller 110 sets the limited area boundary on the basis of the position specifying method described with reference to FIG. 20. In this position specifying method, there is one input coordinate point, and numerical value input is performed at only two positions (see FIG. 13B). When the "type 3: optional straight line" as the third shape is selected as a kind of shape of a limited area boundary, the controller 110 sets the limited area boundary on the basis of the position specifying method described with reference to FIGS. 22 to 24. In this position specifying method, there are two input coordinate points, and numerical value input is performed at four positions (see FIG. 12B). As described above, in the present embodiment, the number of times of numerical value input changes in relation to the complexity of the shape desired to be set by the operator, and the limited area boundary can be set with less time and effort when a simple shape suffices. The usability of the area limiting function can therefore be improved.

(3) The controller 110 sets the origin O of a coordinate system for setting the limited area boundary, sets a coordinate point (for example, V1PosX1 and V1PosY1) in the coordinate system on the basis of information regarding a distance r from the origin O and an angle θ from the angle reference line L0 extending from the origin O (for example, V1PosR1 and V1PosT1) when these pieces of information are input as the position specifying information from the switch box (input device) 13, and sets the limited area boundary on the basis of the coordinate point. That is, the coordinates input by the operator are coordinates in the cylindrical coordinate system rather than coordinates in the rectangular coordinate system. Hence, the operator can create an image in association with the work radius and the swing angle of the front work implement 3, to which the operator ordinarily pays attention. This can also improve the usability of the area limiting function.

(4) In the present embodiment, even when the kind of shape of the limited area boundary is changed, only the number of pieces of information input by the operator changes, and the kind of input information does not change. Suppose that while a distance r and an angle θ in the cylindrical coordinate system are made to be input as the input information when the kind of shape of the limited area boundary is the "type 2: tangent to a concentric circle," an X-coordinate and a Y-coordinate in the rectangular coordinate system are made to be input as the input information in the case of the "type 3: optional straight line." In this case, the operator needs to consider the two coordinate systems, that is, the cylindrical coordinate system and the rectangular coordinate system, according to conditions at a time of numerical value input, so that the trouble of the input is increased. On the other hand, in the present embodiment, the information to be input by the operator is a distance r and an angle θ in the cylindrical coordinate system irrespective of the kind of shape of the limited area boundary, and transformation of the distance r and the angle θ into coordinates in the rectangular coordinate system is performed in the main controller 11. It thus suffices for the operator to consider only the cylindrical coordinate system. Hence, according to the present embodiment, it is possible to facilitate using three different kinds of shapes of limited area boundaries, and thus improve the usability of the area limiting function.

(5) The controller 110 displays, side by side on the display screen of the display device 5, an input field (numerical value input field 48) for allowing a user to input the position specifying information and a diagram (work area diagram Wa) indicating the limited area boundary currently set. Thus, while checking the currently set limited area boundary by the work area diagram Wa, the operator can change the limited area boundary or set a new limited area boundary by inputting a numerical value(s). Good usability is therefore provided for the operator.

(6) The controller 110 displays a screen for selecting the shape of a limited area boundary (see FIG. 11) on the display device 5. The input information input from the switch box (input device) 13 to the controller 110 includes information regarding a kind of shape of a limited area boundary. When the input information as information for selecting the kind of shape of the limited area boundary is input from the switch box (input device) 13 to the controller 110, the controller 110 selects one from among the plurality of kinds of shapes of limited area boundaries on the basis of the input information, and displays a limited area setting screen (FIG. 12A, FIG. 13A, or FIG. 14A) corresponding to the selection result on the display device 5. When position specifying information is thereafter input from the switch box (input device) 13 to the controller 110, the controller 110 sets the limited area boundary on the basis of the position specifying information and a position specifying method corresponding to the selected kind of shape of the limited area boundary. With this configuration, the operator can select the kind of shape of the limited area boundary before inputting the position specifying information. In the present embodiment, the controller 110 displays the display screen (FIG. 12A, FIG. 13A, or FIG. 14A) corresponding to the kind of shape of the limited area boundary on the display device 5, and therefore, the operator can easily understand what to input as the position specifying information.

Second Embodiment

A hydraulic excavator 100 according to a second embodiment will be described with reference to FIGS. 25 to 31. Incidentally, in the figures, parts identical to or corresponding to those of the first embodiment are identified by the same reference characters, and differences will mainly be described. In the first embodiment, when input information for selecting a kind of shape of a limited area boundary is input (see FIG. 11), the controller 110 selects one from among the plurality of kinds of shapes of limited area boundaries on the basis of the input information, and sets the limited area boundary on the basis of position specifying information and a position specifying method corresponding to the selected kind of shape of the limited area boundary (see FIG. 19, FIG. 20, or FIG. 22) when the position specifying information is thereafter input. On the other hand, in the present second embodiment, the controller 110 selects one from among the plurality of kinds of shapes of limited area boundaries on the basis of the position specifying information input from the switch box 13. That is, in the second embodiment, the kind of shape of the limited area boundary is automatically determined from coordinate point input information.

The second embodiment of the present invention is different from the first embodiment only in terms of parts related to the setting of a limited area by the operator, and is otherwise similar to the first embodiment in terms of a system configuration and the contents of control in the main controller 11. In the following, only parts different between the first embodiment and the second embodiment will be described, and description of similar parts will be omitted.

Figure 25:
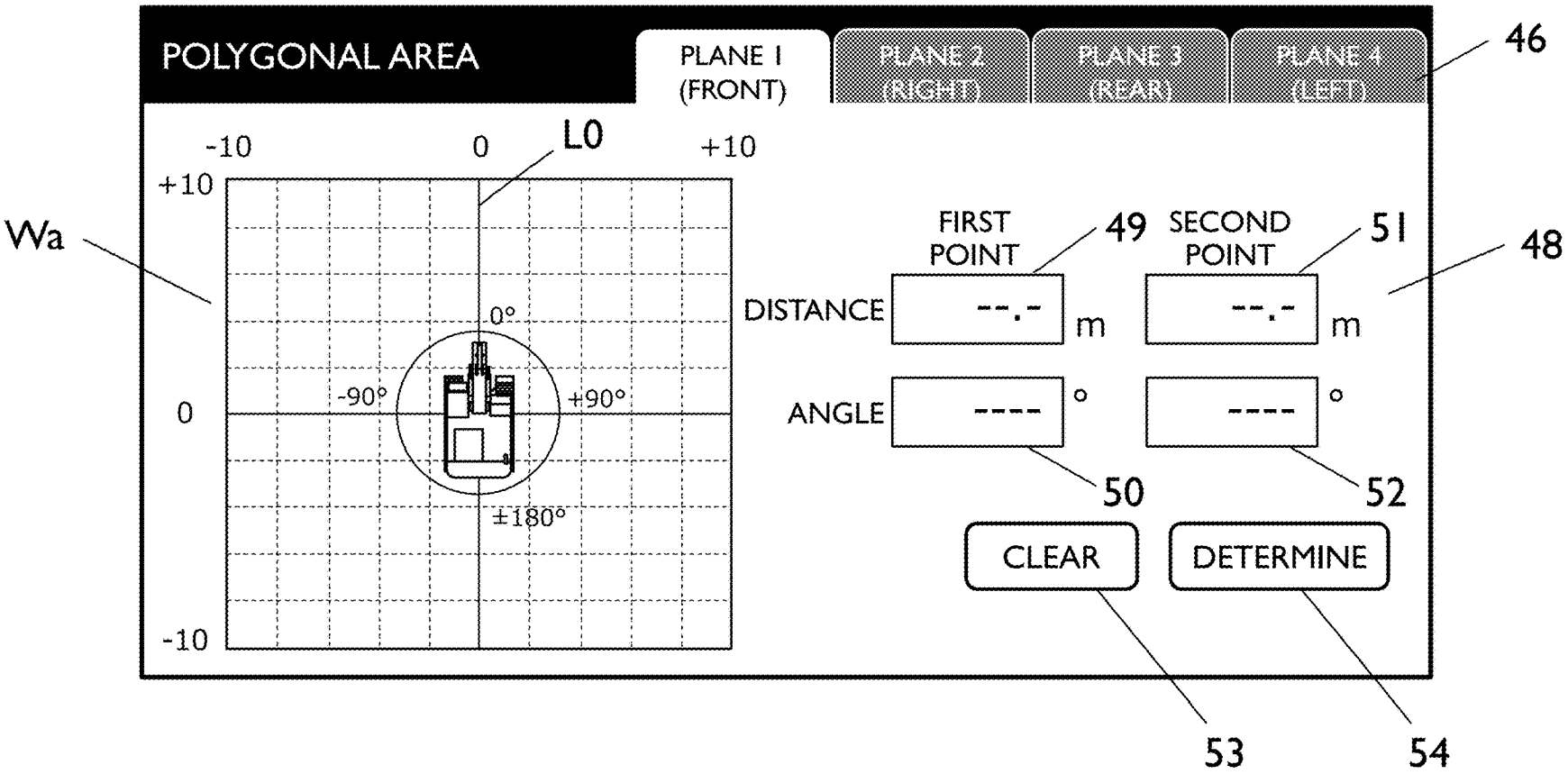
FIG. 25 is a diagram illustrating a limited area setting screen for a polygonal area in a second embodiment of the present invention, and illustrates a state in which no limited area is set (initial state).

FIG. 25 is a diagram illustrating a limited area setting screen for a polygonal area in the second embodiment of the present invention. This limited area setting screen is displayed when the "polygonal area" is selected from the "area limitation setting" in the hierarchy of the monitor menu illustrated in FIG. 9. In the foregoing first embodiment of the present invention, when the "polygonal area" is selected from the "area limitation setting" on the monitor menu, the limited area selection screen illustrated in FIG. 11 is displayed, and the operator first determines a kind of shape of a limited area boundary. On the other hand, in the present second embodiment, the limited area selection screen (see FIG. 11) is not displayed, but a limited area setting screen (see FIG. 25) is displayed.

Incidentally, FIG. 25 illustrates the setting screen in a state in which no limited area is set (initial state). The limited area setting screen illustrated in FIG. 25 is similar to the limited area setting screen (FIG. 12A) described in the first embodiment. As illustrated in FIG. 25, a plurality of setting plane selection tabs 46 for selecting which limited area boundary (plane) is to be set are disposed in an upper right portion of the limited area setting screen. When the operator selects the tab of a plane desired to be set by rotating the selection/determination switch 33, and depresses the selection/determination switch 33, a screen (limited area setting screen) for specifying the position of the plane appears. FIG. 25 illustrates a screen for setting the position of the "plane 1 (front)" of a limited area. The "plane 1 (front)" tab and the other tabs are displayed in different colors, so that the operator easily recognizes the tab being selected.

A work area diagram Wa indicating the position of a plane forming a currently set limited area is disposed on the left side of the screen. The operator can thus visually recognize the currently set limited area. The work area diagram Wa schematically represents a space viewed from an upward direction of the machine body. The work area diagram Wa displays an illustration of the hydraulic excavator 100 which indicates the orientation of the hydraulic excavator 100 (upper swing structure 2 in particular), numerical values representing distances in the XY direction, numerical values representing angles from the angle reference line L0 (forward direction of the lower track structure), and graduation lines serving as a guide for distance.

When the limited area is set, a straight line corresponding to the position of the limited area is displayed in the work area diagram Wa. Incidentally, while a display range of the work area diagram Wa is a 20 m range of −10 m to +10 m in both the X-direction and the Y-direction in FIG. 25, the display range is not limited to this. The display range of the work area diagram Wa may be changed according to a vehicle class of the hydraulic excavator 100 (size of the machine body), or may be allowed to be enlarged or reduced freely by the operator through switch operation of the numeric keys 34 or the like.

The numerical value input field 48 for the operator to specify the position of the plane of the limited area is disposed on the right side of the screen. The numerical value input field 48 displays the first distance input cell 49, the first angle input cell 50, the second distance input cell 51, and the second angle input cell 52.

When the operator moves the cursor to the first distance input cell 49 by rotating the selection/determination switch 33, and depresses the selection/determination switch 33, the first distance input cell 49 is set in a numerical value input waiting state. A numerical value can be input (numerical value can be changed) by rotating the selection/determination switch 33 or pressing numerical buttons of the numeric keys 34 while the first distance input cell 49 is in the numerical value input waiting state. Incidentally, a dedicated button may be added to the buttons of the numeric keys 34 for correction and erasure of the value at this time, or a long depression of a specific button (for example, a number 0 key) or the like may be assigned these functions.

A limitation may be imposed on the range of the value that can be input by the operator. For example, even if 100 m is input as a distance from the origin O to the limited area, the limited area is so distant from the hydraulic excavator 100 that the role of the area limiting function is not performed. When an upper limit of the range of manual input by the operator is, for example, set in a practical range such as 15 m, in which the area limiting function can be utilized, a range setting can be made easy for the operator to understand.

When the operator depresses the selection/determination switch 33 in a state in which the numerical value of a distance desired to be set is set, the value of the first distance input cell 49 is determined. The operator can similarly input a numerical value also to the first angle input cell 50, the second distance input cell 51, and the second angle input cell 52 by a similar procedure. However, an operation of setting the plane of the limited area is not yet completed in this stage.

An area clear switch 53 and an area determination switch 54 are arranged in a lower right portion of the screen. When the operator depresses the selection/determination switch 33 in a state in which the cursor is moved to the area clear switch 53, the setting of the plane of the currently set limited area is cleared. As a result, a return is made to a state in which a work area is not limited (with regard to the plane).

(Features of Second Embodiment)

A depression-enabled state and a depression-disabled state of the area determination switch 54 are determined according to numerical value input states of the four cells to which the operator inputs numerical values, that is, the first distance input cell 49, the first angle input cell 50, the second distance input cell 51, and the second angle input cell 52. When the area determination switch 54 is depressed by the selection/determination switch 33 being depressed, at a time of the depression-enabled state, a limited area boundary is set according to a combination of the presence or absence of numerical value input to the four input cells (49, 50, 51, and 52) to which the input has been performed at the time of the depression.

When the limited area boundary is set, display of a straight line indicating the position of the limited area is added to the work area diagram Wa. This part is a feature of the second embodiment of the present invention, and will be described in detail in the following.

FIG. 26 is a diagram illustrating a table of selection items of various kinds of state information according to the presence or absence of numerical value input to the numerical value input field 48 in the second embodiment of the present invention. A first column from the left of the table is assigned serial numbers 1 to 16 for the description of combination patterns. A second to a fifth column from the left of the table indicate combinations as to whether or not numerical value input is performed for each of the four cells of the numerical value input field 48, that is, the first distance input cell 49, the first angle input cell 50, the second distance input cell 51, and the second angle input cell 52. When there is display of "○" in a field, it is indicated that there is numerical value input. A blank field indicates that there is no numerical value input ("---" bar display in FIG. 25).

A sixth column from the left of the table indicates whether the area determination switch 54 is set in the depression-enabled state or the depression-disabled state in cases of the combination patterns. A seventh column from the left of the table indicates whether the presence or absence of a setting of the limited area is "0: absence of a setting (absence of an area)" or "1: presence of a setting (presence of an area)" in the cases of the combination patterns. An eighth column from the left of the table indicates whether the kind of shape of the limited area boundary is "0: unset," "1: rectangular shape," "2: tangent to a concentric circle," or "3: optional straight line" in the cases of the combination patterns.

However, a change from the "absence of a setting" to the "presence of a setting" as to the presence or absence of a setting of the limited area is made when the area determination switch 54 is depressed. Similarly, a change to other than "unset" as to the kind of shape of the limited area boundary is made when the area determination switch 54 is depressed. Until the area determination switch 54 is depressed, irrespective of the combination patterns, the presence or absence of a setting of the limited area is always "absence of a setting," and the kind of shape of the limited area boundary is always "unset."

Figure 27:
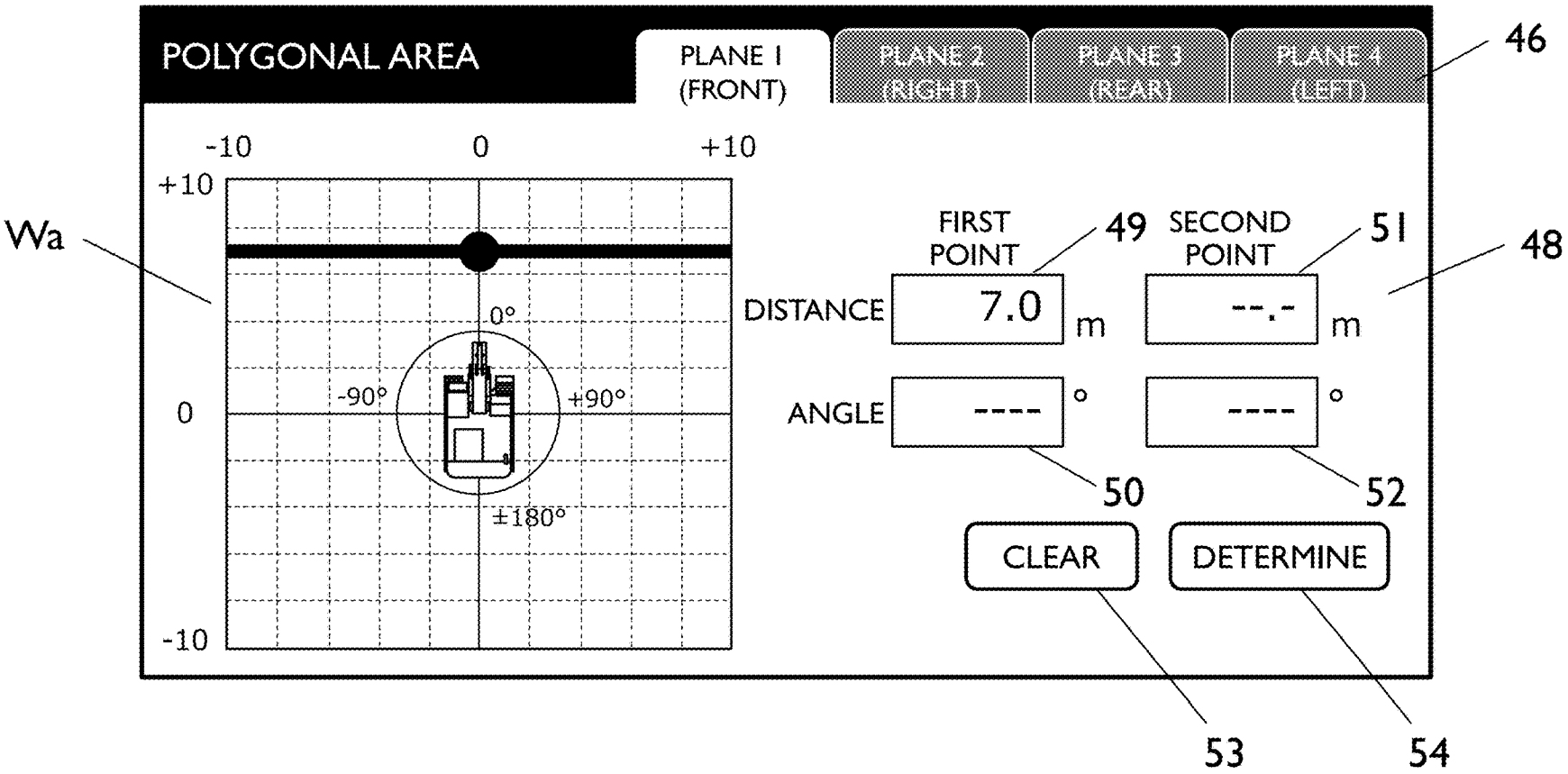
FIG. 27 is a diagram illustrating an example of the limited area setting screen in a case of inputting a numerical value only to a first distance input cell and depressing an area determination switch.

In the following, specific examples will be described in detail with reference to FIGS. 27 to 30. FIG. 27 is a diagram illustrating an example of the limited area setting screen in a case of inputting a numerical value only to the first distance input cell 49, and depressing the area determination switch 54, as in the combination pattern 2 in FIG. 26. In the example illustrated in FIG. 27, "7.0" m is input to the first distance input cell 49, but there is no input yet to the other cells, that is, the first angle input cell 50, the second distance input cell 51, and the second angle input cell 52. At this time, the area determination switch 54 is set in the depression-enabled state. When the area determination switch 54 is depressed in this state, a limited area is determined, and from the monitor controller 14 to the area setting section 38 of the main controller 11, the "presence of a setting (presence of an area)" is transmitted as information regarding the presence or absence of a setting of the "plane 1 (front)" area, and further, the "rectangular shape" is transmitted as information regarding the kind of shape of the boundary of the "plane 1 (front)" area. The transmission of information regarding the coordinates of each coordinate point specifying the limited area boundary is similar to that of the first embodiment.

Figure 28:
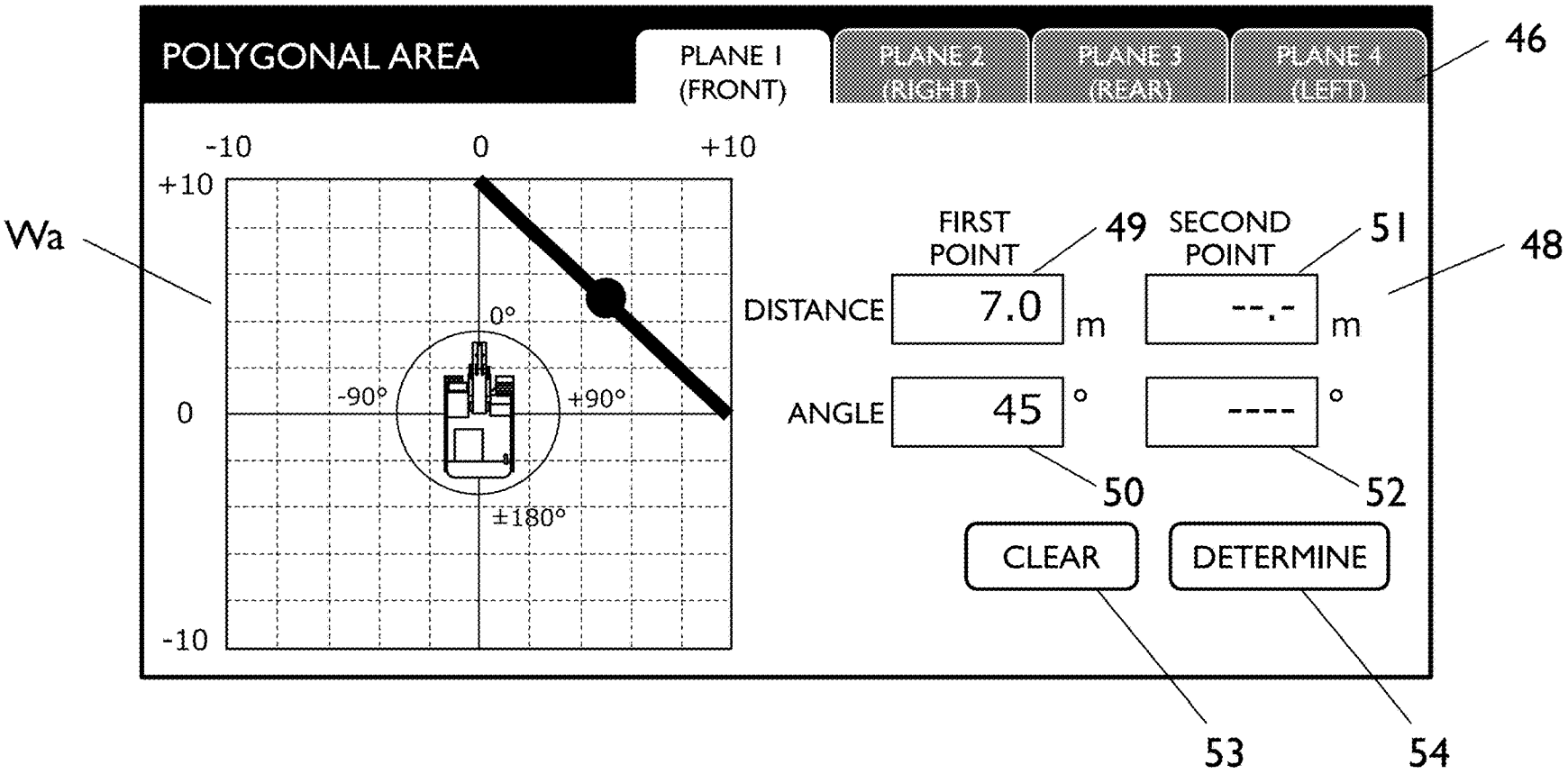
FIG. 28 is a diagram illustrating an example of the limited area setting screen in a case of inputting numerical values only to the first distance input cell and a first angle input cell and depressing the area determination switch.

FIG. 28 is a diagram illustrating an example of the limited area setting screen in a case of inputting numerical values to only the first distance input cell 49 and the first angle input cell 50, and depressing the area determination switch 54, as in the combination pattern 6 in FIG. 26. In the example illustrated in FIG. 28, "7.0" m is input to the first distance input cell 49, "45"° is input to the first angle input cell 50, but there is no input yet to the other cells, that is, the second distance input cell 51 and the second angle input cell 52. At this time, the area determination switch 54 is set in the depression-enabled state. When the area determination switch 54 is depressed in this state, a limited area is determined, and from the monitor controller 14 to the area setting section 38 of the main controller 11, the "presence of a setting (presence of an area)" is transmitted as information regarding the presence or absence of a setting of the "plane 1 (front)" area, and further, a "tangent to a concentric circle" is transmitted as information regarding the kind of shape of the boundary of the "plane 1 (front)" area. The transmission of information regarding the coordinates of each coordinate point specifying the limited area boundary is similar to that of the first embodiment.

Figure 29:
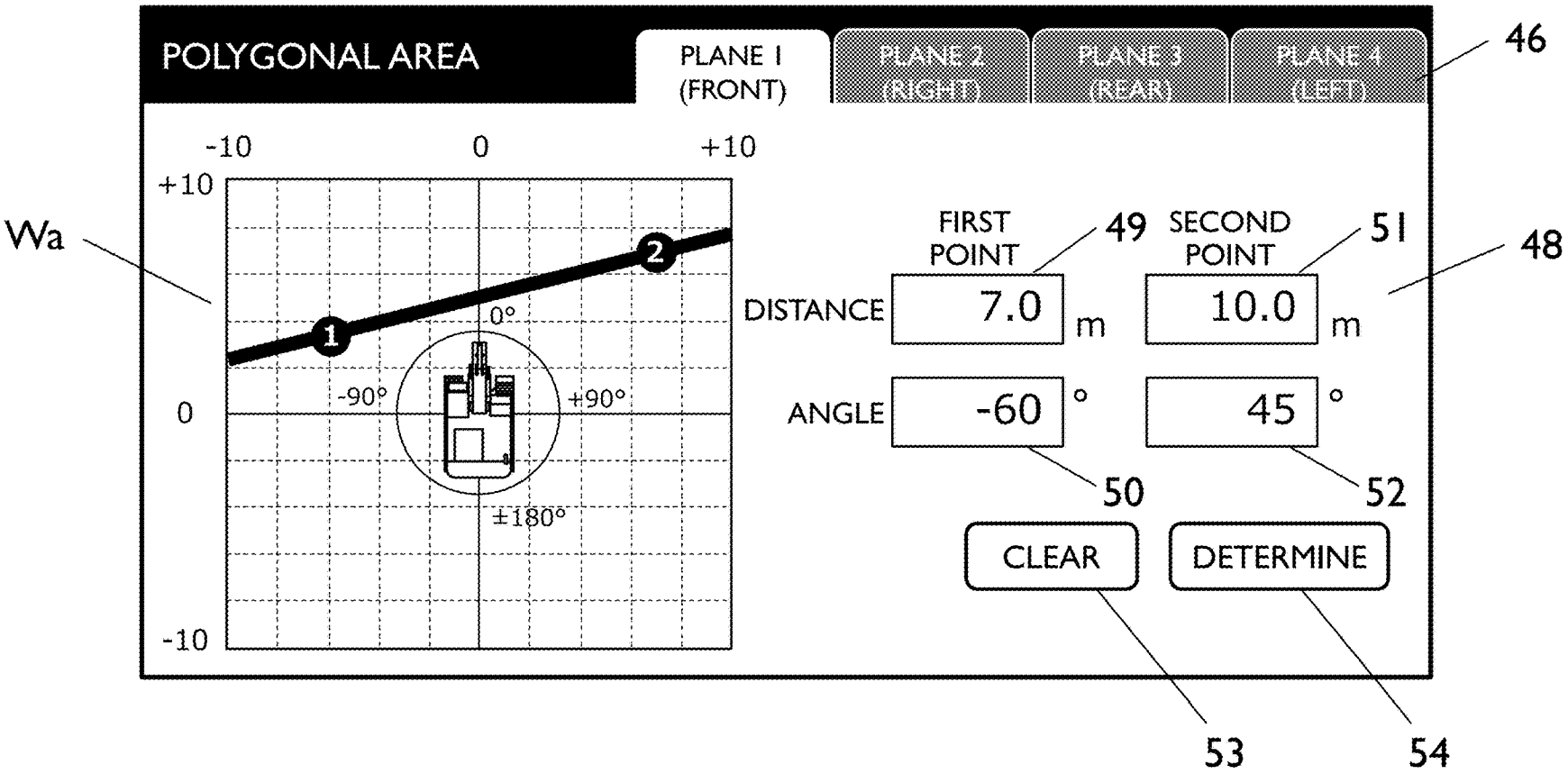
FIG. 29 is a diagram illustrating an example of the limited area setting screen in a case of inputting numerical values to all of four positions of the first distance input cell, the first angle input cell, a second distance input cell, and a second angle input cell and depressing the area determination switch.

FIG. 29 is a diagram illustrating an example of the limited area setting screen in a case of inputting numerical values to all of the four positions of the first distance input cell 49, the first angle input cell 50, the second distance input cell 51, and the second angle input cell 52, and depressing the area determination switch 54, as in the combination pattern 16 in FIG. 26. In the example illustrated in FIG. 29, "7.0" m is input to the first distance input cell 49, "−60"° is input to the first angle input cell 50, "10.0" m is input to the second distance input cell 51, and "45"° is input to the second angle input cell 52. At this time, the area determination switch 54 is set in the depression-enabled state. When the area determination switch 54 is depressed in this state, a limited area is determined, and from the monitor controller 14 to the area setting section 38 of the main controller 11, the "presence of a setting (presence of an area)" is transmitted as information regarding the presence or absence of a setting of the "plane 1 (front)" area, and further, an "optional straight line" is transmitted as information regarding the kind of shape of the boundary of the "plane 1 (front)" area. The transmission of information regarding the coordinates of each coordinate point specifying the limited area boundary is similar to that of the first embodiment.

Figure 30:
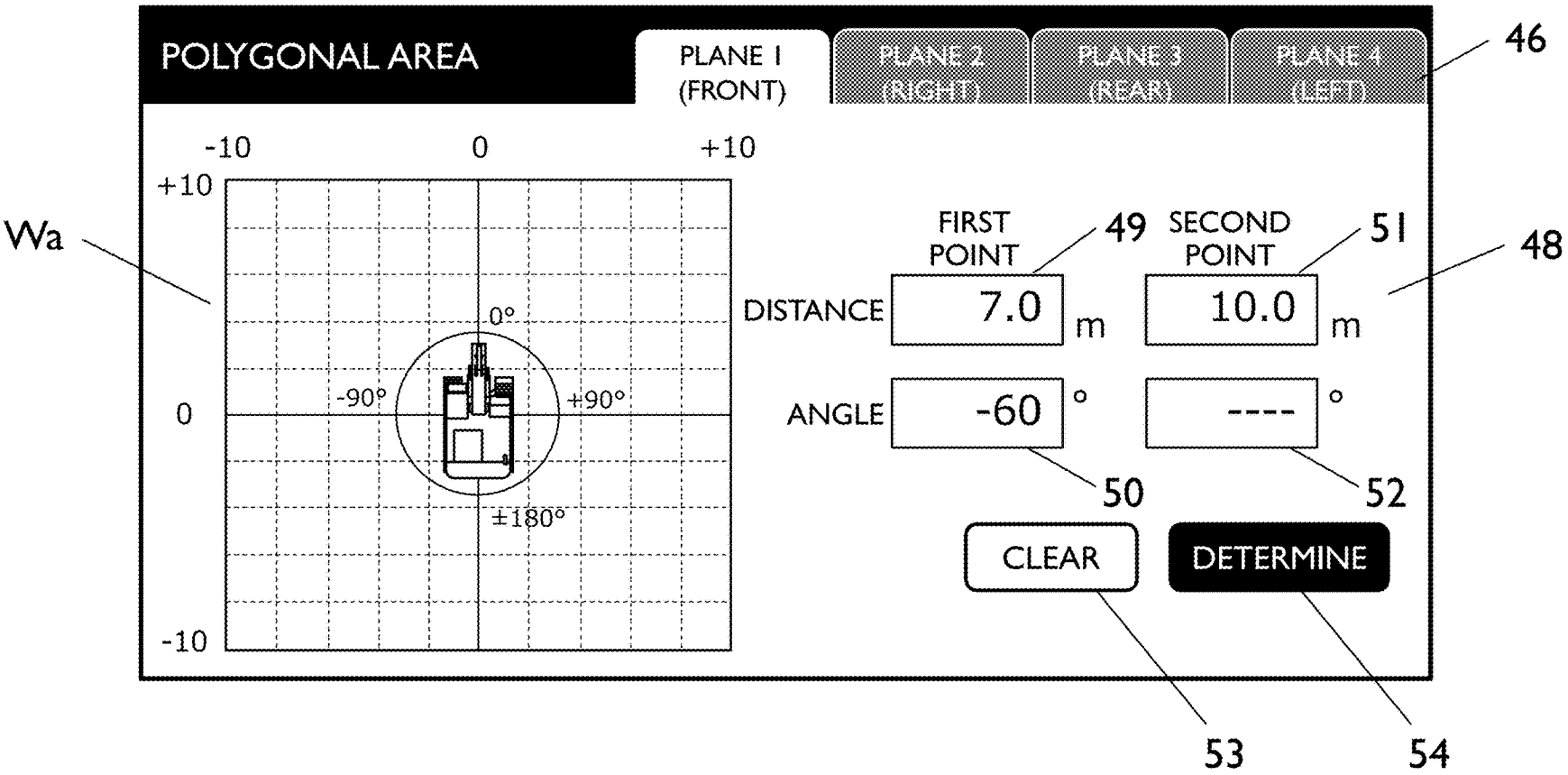
FIG. 30 is a diagram illustrating an example of the limited area setting screen in a state in which numerical values are input to the first distance input cell, the first angle input cell, and the second distance input cell, but not yet to the second angle input cell.

FIG. 30 is a diagram illustrating an example of the limited area setting screen in a state in which numerical values are input to the first distance input cell 49, the first angle input cell 50, and the second distance input cell 51, but not yet to the second angle input cell 52, as in the combination pattern 12 in FIG. 26. In the example illustrated in FIG. 30, "7.0" m is input to the first distance input cell 49, "−60"° is input to the first angle input cell 50, "10.0" m is input to the second distance input cell 51, but there is no input yet to the second angle input cell 52. At this time, the area determination switch 54 is set in the depression-disabled state. Because the area determination switch 54 cannot be depressed, a limited area cannot be determined, and from the monitor controller 14 to the area setting section 38 of the main controller 11, the "absence of a setting (absence of an area)" is transmitted as information regarding the presence or absence of a setting of the "plane 1 (front)" area, and further, "unset" is transmitted as information regarding the kind of shape of the boundary of the "plane 1 (front)" area. In addition, at this time, displaying the area determination switch 54 in a color different from that of the depression-enabled state, as in the display of FIG. 30, allows the operator to recognize the depression-enabled/disabled state of the area determination switch 54 more clearly.

As described above, in the second embodiment of the present invention, the controller 110 displays the limited area setting screen (see FIG. 25) on the display device 5, and selects one from among the plurality of kinds of shapes of limited area boundaries on the basis of the position specifying information input from the switch box (input device) 13. In the present embodiment, the controller 110 automatically determines the kind of shape of the limited area boundary and sets the limited area according to information regarding a combination of a position(s) of the four numerical value input cells of the numerical value input field 48 to which a numerical value(s) is/are input. Main processing performed by the controller 110 according to the second embodiment is summarized as follows.

When only information regarding the distance r from the origin O is input as the position specifying information from the switch box (input device) 13 to the controller 110, the controller 110 selects the first shape "type 1: rectangular shape" from among the plurality of kinds of shapes of limited area boundaries (see FIG. 26). When the controller 110 selects the first shape "type 1: rectangular shape," the controller 110 sets, as a limited area boundary, on the basis of the information regarding the distance r as the position specifying information, a plane that is disposed at a position separated from the origin O in a predetermined direction (one of the forward direction, the right direction, the rearward direction, and the left direction of the machine body) by the distance r and is parallel with the vertical direction but orthogonal to the above-described predetermined direction. In addition, the controller 110 displays a straight line representing the set limited area boundary in the work area diagram Wa displayed on the display screen of the display device 5 (see FIG. 27).

When only information regarding a first distance r from the origin O and a first angle θ from the angle reference line L0 extending from the origin O, the information being information regarding one coordinate point, is input as the position specifying information from the switch box (input device) 13 to the controller 110, the controller 110 selects the second shape "type 2: tangent to a concentric circle" from among the plurality of kinds of shapes of limited area boundaries (see FIG. 26). When the controller 110 selects the second shape "type 2: tangent to a concentric circle," the controller 110 sets a tangent plane tangent at the above-described one coordinate point to a circular cylinder having a vertical axis passing through the origin O as a central axis, as a limited area boundary, on the basis of the information regarding the one coordinate point as the position specifying information. In addition, the controller 110 displays a straight line representing the set limited area boundary in the work area diagram Wa displayed on the display screen of the display device 5 (see FIG. 28).

When information regarding a first distance r from the origin O and a first angle θ from the angle reference line L0 (for example, V1PosR1 and V1PosT1) and information regarding a second distance r from the origin O and a second angle θ from the angle reference line L0, these pieces of information being information regarding two coordinate points, are input as the position specifying information from the switch box (input device) 13 to the controller 110, the controller 110 selects the third shape "type 3: optional straight line" from among the plurality of kinds of shapes of limited area boundaries (see FIG. 26). When the controller 110 selects the third shape "type 3: optional straight line," the controller 110 sets an optional plane passing through the two coordinate points and parallel with the vertical direction, as a limited area boundary, on the basis of the information regarding the two coordinate points as the position specifying information. In addition, the controller 110 displays a straight line representing the set limited area boundary in the work area diagram Wa displayed on the display screen of the display device 5 (see FIG. 29).

Incidentally, the automatic determination of the kind of shape of the limited area boundary is made independently for each of the "plane 1 (front)," the "plane 2 (right)," the "plane 3 (rear)," and the "plane 4 (left)" as the planes of the four limited areas. Hence, the setting of the limited areas as described in the following is made possible.

Figure 31:
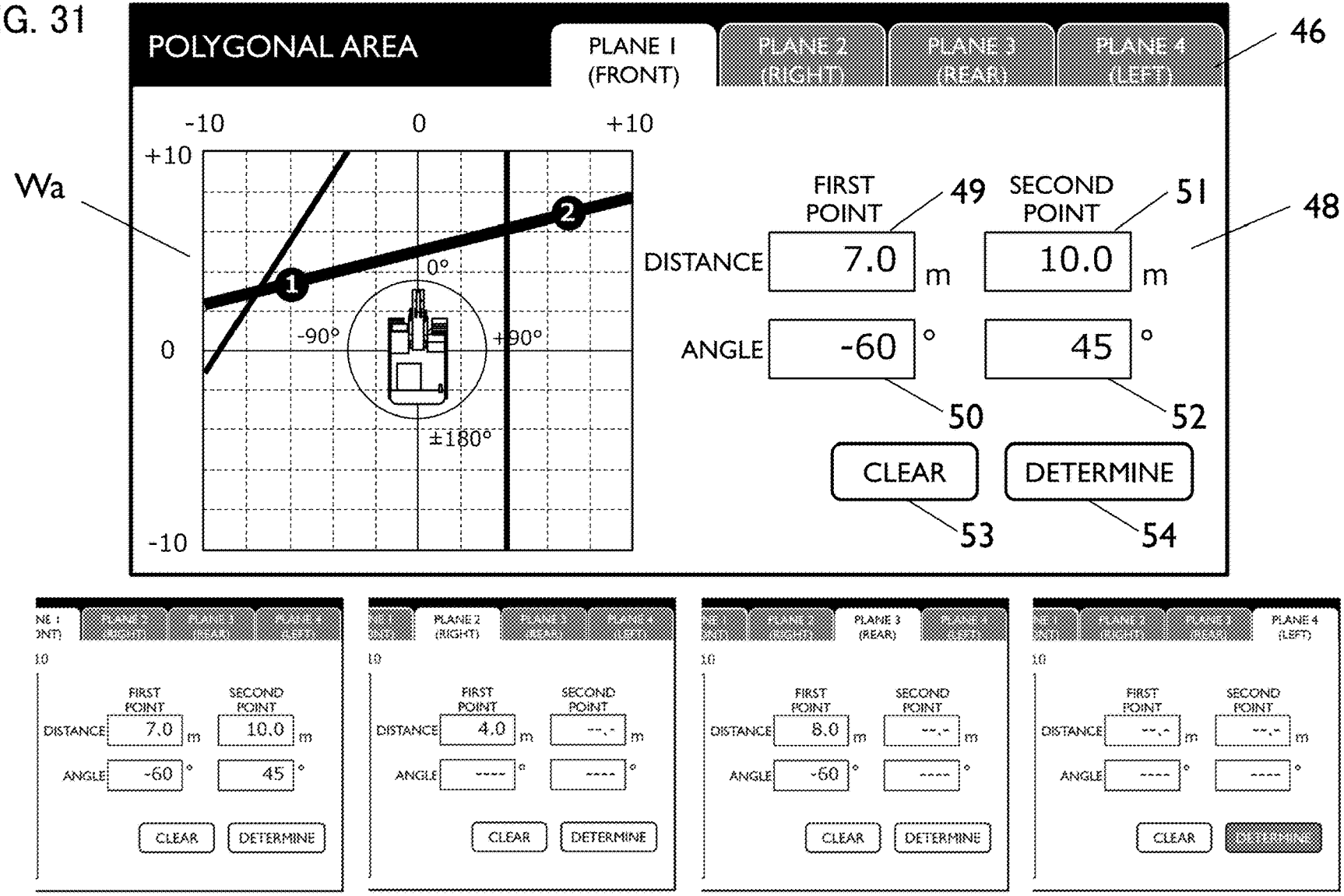
FIG. 31 is a diagram illustrating an example of the limited area setting screen in a case of combining the shapes of limited area boundaries of different kinds.

FIG. 31 is a diagram illustrating an example of the limited area setting screen in a case of combining the shapes of limited area boundaries of different kinds. In FIG. 31, each of the "plane 1 (front)," the "plane 2 (right)," the "plane 3 (rear)," and the "plane 4 (left)" as the planes of the four limited areas is set as follows.

On the limited area setting screen of the "plane 1 (front)," numerical values are input to all of the numerical value input cells at the four positions, and the kind of shape of the limited area boundary is set to be an "optional straight line." On the limited area setting screen of the "plane 2 (right)," a numerical value is input to only the first distance input cell 49, and the kind of shape of the limited area boundary is set to be a "rectangular shape." On the limited area setting screen of the "plane 3 (rear)," numerical values are input to only the first distance input cell 49 and the first angle input cell 50, and the kind of shape of the limited area boundary is set to be a "tangent to a concentric circle." On the limited area setting screen of the "plane 4 (left)," no numerical value is input to any numerical value input cell, nor are the kind of shape of the limited area boundary and the limited area boundary set. In this way, in the second embodiment, it is possible to combine the shapes of limited area boundaries of different kinds.

(Effects of Second Embodiment)

The second embodiment of the present invention configured as described above can provide effects to be illustrated in the following in addition to effects equivalent to those of (1) to (5) described in the first embodiment.

(7) When the operator sets a limited area, the operator does not need to select the kind of shape of the limited area boundary first as in the first embodiment. Therefore, a reduction in time and effort of the operator for the area setting is achieved.

(8) The operator can determine the kind of shape of the limited area boundary according to where a numerical value(s) is/are input among the numerical value input cells at the four positions. Hence, the operator can set the limited area boundary with time and effort corresponding to the complexity of the shape of the limited area desired to be set. In the present embodiment, as described earlier, when the operator desires to set the limited area boundary by a "rectangular shape," input is performed at one position. When the operator desires to set the limited area boundary by a "tangent to a concentric circle," input is performed at two positions. When the operator desires to set the limited area boundary by an "optional straight line," input is performed at four positions.

(9) In the present embodiment, the kind of shape of the limited area boundary can be set independently for each of the planes forming the four limited areas. Hence, when there is a plane that can be set by a "rectangular shape" among the four planes, input positions can be reduced, and when there is a plane desired to be set by an "optional straight line" among the four planes, it suffices to increase input positions only for the plane.

In this way, the second embodiment of the present invention can improve the usability of the area limiting function more than the first embodiment.

Others and Supplement

The following modifications are also within the scope of the present invention. It is possible to combine a configuration illustrated in a modification and a configuration described in the foregoing embodiment with each other, combine configurations described in the foregoing different embodiments with each other, or combine configurations described in the following different modifications with each other.

First Modification

In the first embodiment and the second embodiment of the present invention, description has been made of a method based on numerical value input (numerical value input setting method) as a method of setting each coordinate point of a limited area by the operator. However, the present invention is not limited to this. For example, the coordinates of the coordinate point of the front work implement 3 (for example, the coordinate point of the center of the bucket claw tip) which are computed by the posture computing section 37 can be used and applied also to a method of setting each coordinate point of a limited area (direct teaching setting method). In that case, it suffices to move the front work implement 3 to a coordinate point desired to be set, and determine the coordinates by a specific switch operation or the like of the selection/determination switch 33, the numeric keys 34, or the like.

Second Modification

In the first embodiment and the second embodiment of the present invention, the area limiting function that automatically decelerates and stops the front work implement 3 so as to prevent the front work implement 3 from entering a set limited area has been described as a function that sets and uses the limited area. However, the present invention is not limited to this. The technology of the present invention is applicable also to a machine control function as an excavation work assisting function that automatically moves the front work implement 3 along a limited area boundary set in advance. The machine control function is one kind of area limiting function. The present invention relates to area information input means used by a certain function, and the function itself that uses input area information is not limited.

Third Modification

In the first embodiment and the second embodiment of the present invention, description has been made of an example in which one from among the three kinds of shapes of limited area boundaries as the types 1 to 3 is selected in the polygonal area. However, the present invention is not limited to this. One from two kinds of shapes of limited area boundaries among the types 1 to 3 may be selected in the polygonal area. That is, in the foregoing embodiments, one kind of the types 1 to 3 may be omitted.

Fourth Modification

In the first embodiment and the second embodiment of the present invention, description has been made of an example in which the controller 110 is constituted by the main controller 11 and the monitor controller 14. However, the present invention is not limited to this. The controller 110 may be constituted by a single controller (computer) that combines the functions of the main controller 11 and the functions of the monitor controller 14. In addition, when the main controller 11 and the monitor controller 14 are provided separately from each other, the main controller 11 may have some of the functions of the monitor controller 14 described in the foregoing embodiments, or the monitor controller 14 may have some of the functions of the main controller 11 described in the foregoing embodiments.

Fifth Modification

In the first embodiment and the second embodiment of the present invention, a crawler type hydraulic excavator has been described as an example of the work machine. However, the present invention is not limited to this. For example, the present invention can also be applied to work machines such as a wheeled hydraulic excavator, a wheel loader, a forklift, a dump truck, and a crane. In a case of a work machine that performs work involving movement, such as a wheel loader, a forklift, or a dump truck, the whole of the machine can be set as a work implement, and the position of the work implement can be determined as posture information.

Embodiments of the present invention have been described above. However, the foregoing embodiments merely represent a part of examples of application of the present invention, and are not intended to limit the technical scope of the present invention to specific configurations of the foregoing embodiments.

DESCRIPTION OF REFERENCE CHARACTERS

1: Lower track structure (machine body)
2: Upper swing structure (machine body)
3: Front work implement (work implement)
5: Display device
11: Main controller
13: Switch box (input device)
14: Monitor controller
15: Operation device
36: Limiting control section
37: Posture computing section
38: Area setting section
39: Distance computing section
40: Display region
48: Numerical value input field (input field)
49: First distance input cell
50: First angle input cell
51: Second distance input cell
52: Second angle input cell
53: Area clear switch
54: Area determination switch
81: Processor
82: Nonvolatile memory (storage device)
91: Processor
92: Nonvolatile memory (storage device)
100: Hydraulic excavator (work machine)
102: Posture sensor
110: Controller

The invention claimed is:

1. A work machine comprising:

a work implement provided to a machine body;

a posture sensor that senses posture information regarding the work implement;

a controller, including a storage device, configured to:

compute a specific position of the work implement on a basis of the posture information from the posture sensor, set a limited area that the work implement is prohibited from entering, compute a movable distance as a distance between the limited area and the specific position of the work implement, and limit operation of the work implement according to the movable distance to prevent the work implement from entering the limited area; and an input device for inputting to the controller input information input by an operation of an operator, wherein the storage device stores boundary information including a plurality of different types of shapes of limited area boundaries, wherein the controller is configured to select one of the types of shapes of limited area boundaries in the boundary information, on a basis of the input information input from the input device, and set a limited area boundary according to the selected one of the types of shapes of limited area boundaries, wherein the limited area is formed by one or more planes parallel with a vertical direction, wherein the storage device stores a plurality of position specifying methods respectively corresponding to the plurality of different types of shapes of limited area boundaries, wherein the input information includes position specifying information specifying a position of the selected one of the types of shapes of limited area boundaries, wherein the controller is configured to set the selected one of the types of shapes of limited area boundaries on a basis of the position specifying information input from the input device and the position specifying method corresponding to the selected one of the types of shapes of limited area boundaries, wherein the plurality of different types of shapes of limited area boundaries include a first shape, a second shape, and a third shape, and wherein the controller is configured to:

set an origin of a coordinate system for setting the limited area boundary, set, as the limited area boundary, on a basis of information regarding a distance as the position specifying information, a plane that is disposed at a position separated from the origin in a predetermined direction by the distance and is parallel with the vertical direction but orthogonal to the predetermined direction, when the first shape is selected, set, as the limited area boundary, on a basis of information regarding one coordinate point as the position specifying information, a tangent plane tangent at the one coordinate point to a circular cylinder having a vertical axis passing through the origin as a central axis, when the second shape is selected, and set, as the limited area boundary, on a basis of information regarding two coordinate points as the position specifying information, an optional plane passing through the two coordinate points and parallel with the vertical direction, when the third shape is selected.

2. The work machine according to claim 1, wherein the controller is configured to:

set a coordinate point in the coordinate system on a basis of information regarding a distance from the origin and an angle from an angle reference line extending from the origin, when the information is input as the position specifying information from the input device, and set the limited area boundary on a basis of the coordinate point.

3. The work machine according to claim 1, wherein the controller is configured to:

select the first shape from among the plurality of different types of shapes of limited area boundaries when only information regarding a distance from the origin is input as the position specifying information from the input device, select the second shape from among the plurality of different types of shapes of limited area boundaries when only information regarding a first distance from the origin and a first angle from an angle reference line extending from the origin as the information regarding the one coordinate point is input as the position specifying information from the input device, and select the third shape from among the plurality of different types of shapes of limited area boundaries when information regarding the first distance from the origin and the first angle from the angle reference line and information regarding a second distance from the origin and a second angle from the angle reference line as the information regarding the two coordinate points are input as the position specifying information from the input device.

4. The work machine according to claim 1, comprising:

a display device coupled to the controller, wherein the controller is configured to display, side by side on a display screen of the display device, an input field receiving an input of the position specifying information and a diagram indicating the limited area boundary currently set.

5. The work machine according to claim 1 wherein the controller is configured to set, as the limited area, an area outside an area enclosed by each of a plurality of planes, when the plurality of planes are set as limited area boundaries.

* * * * *